US011610537B2

(12) United States Patent
Lim et al.

(10) Patent No.: US 11,610,537 B2
(45) Date of Patent: Mar. 21, 2023

(54) DISPLAY DEVICE

(71) Applicant: Samsung Display Co., Ltd., Yongin-Si (KR)

(72) Inventors: Jae Keun Lim, Yongin-si (KR); Hong Soo Kim, Yongin-si (KR); Jin Young Roh, Yongin-si (KR); Se Hyuk Park, Yongin-si (KR); Woo Mi Bae, Yongin-si (KR); Hyo Jin Lee, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/535,340

(22) Filed: Nov. 24, 2021

(65) Prior Publication Data

US 2022/0309998 A1 Sep. 29, 2022

(30) Foreign Application Priority Data

Mar. 29, 2021 (KR) ..... 10-2021-0040584

(51) Int. Cl.
*G09G 3/32* (2016.01)

(52) U.S. Cl.
CPC ..... *G09G 3/32* (2013.01); *G09G 2310/0267* (2013.01); *G09G 2310/08* (2013.01); *G09G 2330/021* (2013.01); *G09G 2340/0435* (2013.01)

(58) Field of Classification Search
CPC ..... G09G 2310/0267; G09G 2340/0435; G09G 2330/021; G09G 3/32; G09G 2310/08
See application file for complete search history.

(56) References Cited

U.S. PATENT DOCUMENTS

2018/0158396 A1* 6/2018 Lee ..... G02B 7/002
2018/0197481 A1* 7/2018 Choi ..... G09G 3/3266
2019/0318690 A1* 10/2019 Lee ..... H01L 27/3276
2022/0020311 A1 1/2022 Lim et al.
2022/0101774 A1 3/2022 Lim et al.

FOREIGN PATENT DOCUMENTS

KR 10-2022-0011262 A 1/2022
KR 10-2022-0044059 A 4/2022

* cited by examiner

*Primary Examiner* — Muhammad N Edun
(74) *Attorney, Agent, or Firm* — Innovation Counsel LLP

(57) ABSTRACT

Provided is a display device comprising a pixel unit including first pixel rows connected to first scan lines and second pixel rows alternating with the first pixel rows and connected to second scan lines, a scan driver including first scan stages connected to the first scan lines and second scan stages connected to the second scan lines, and an emission driver including emission stages in which each of emission lines is connected to two or more pixel rows. Accordingly, the display device is capable of changing a display frequency and maintaining the same cycle in which luminance decreases when the display frequency is changed.

20 Claims, 31 Drawing Sheets

DISPLAY DEVICE

CROSS-REFERENCE TO RELATED APPLICATION

The application claims priority to and the benefit of Korean Patent Application No. 10-2021-0040584, filed Mar. 29, 2021, which is hereby incorporated by reference for all purposes as if fully set forth herein.

BACKGROUND

1. Field

The present disclosure generally relates to a display device, and more particularly, to a display device capable of changing a display frequency and maintaining the same cycle in which luminance decreases when the display frequency is changed.

2. Description of the Related Art

With the development of information technology, the importance of display devices, which are a connection medium between users and information, has been emphasized. In response to this, the use of display devices such as a liquid crystal display device, an organic light emitting display device, and the like has been increasing.

When a display device displays a moving image, it is preferable to display an image at a high frequency in order to smoothly express the motion. However, since there is no motion when the display device displays a still image, there is no problem even if the image is displayed at a low frequency. In addition, when the image is displayed at the low frequency, it is advantageous in terms of power consumption.

However, when a display frequency of the display device is switched from the high frequency to the low frequency, flicker may be visually recognized as the period in which luminance decreases is changed.

SUMMARY

A technical problem to be solved is to provide a display device capable of changing a display frequency and maintaining the same cycle in which luminance decreases when the display frequency is changed.

A display device according to an embodiment of the present disclosure may include a pixel unit including first pixel rows connected to first scan lines and second pixel rows alternating with the first pixel rows and connected to second scan lines; a scan driver including first scan stages connected to the first scan lines and second scan stages connected to the second scan lines; and an emission driver including emission stages in which each of emission lines is connected to two or more pixel rows. The first scan stages may be connected to first scan clock lines, the second scan stages may be connected to second scan clock lines different from the first scan clock lines, one of the first scan stages and one of the second scan stages may be connected to the same scan start line, each of the first scan stages except for a first scan stage connected to the scan start line may be connected to a first scan line of a previous first scan stage, and each of the second scan stages except for a second scan stage connected to the scan start line may be connected to a second scan line of a previous second scan stage.

Each of the emission lines of the emission stages may be connected to an adjacent first pixel row and an adjacent second pixel row.

The emission stages may be connected to the same emission clock lines, and the remaining emission stages except for an emission stage connected to an emission stop line among the emission stages may be connected to an emission line of a previous emission stage.

During a first frame period, cycles of first scan clock signals applied to the first scan clock lines, cycles of second scan clock signals applied to the second scan clock lines, and cycles of emission clock signals applied to the emission clock lines may have a first time interval.

During a first sub-frame period of a second frame period, the cycles of the first scan clock signals and the cycles of the emission clock signals may have a second time interval less than the first time interval, and during the first sub-frame period, the second scan clock signals may be maintained at a constant voltage level.

During a second sub-frame period of the second frame period, the cycles of the second scan clock signals and the cycles of the emission clock signals may have the second time interval, and during the second sub-frame period, the first scan clock signals may be maintained at a constant voltage level.

Each of first emission lines of first emission stages among the emission stages may be connected to adjacent first pixel rows, and each of second emission lines of second emission stages among the emission stages may be connected to adjacent second pixel rows.

The first emission stages may be connected to first emission clock lines, the second emission stages may be connected to second emission clock lines different from the first emission clock lines, one of the first emission stages and one of the second emission stages may be connected to the same emission stop line, each of the first emission stages except for a first emission stage connected to the emission stop line may be connected to an emission line of a previous first emission stage, and each of the second emission stages except for a second emission stage connected to the emission stop line may be connected to an emission line of a previous second emission stage.

During a first frame period, cycles of first scan clock signals applied to the first scan clock lines, cycles of second scan clock signals applied to the second scan clock lines, cycles of first emission clock signals applied to the first emission clock lines, and cycles of second emission clock signals applied to the second emission clock lines may have a first time interval.

During a first sub-frame period of a second frame period, the cycles of the first scan clock signals may have a second time interval less than the first time interval, during the first sub-frame period, the cycles of the first emission clock signals may have the first time interval, and during the first sub-frame period, the second scan clock signals and the second emission clock signals may be maintained at a constant voltage level.

During a second sub-frame period of the second frame period, the cycles of the second scan clock signals may have the second time interval, during the second sub-frame period, the cycles of the second emission clock signals may have the first time interval, and during the second sub-frame period, the first scan clock signals and the first emission clock signals may be maintained at a constant voltage level.

A display device according to an embodiment of the present disclosure may include a pixel unit including first pixel rows connected to first scan lines, second pixel rows connected to second scan lines, third pixel rows connected to third scan lines, and fourth pixel rows connected to fourth scan lines; a scan driver including first scan stages connected to first scan clock lines and the first scan lines, second scan stages connected to second scan clock lines and the second scan lines, third scan stages connected to third scan clock lines and the third scan lines, and fourth scan stages connected to fourth scan clock lines and the fourth scan lines; and an emission driver including emission stages in which each of emission lines is connected to two or more pixel rows. One of the first scan stages, one of the second scan stages, one of the third scan stages, and one of the fourth scan stages may be connected to the same scan start line, each of the first scan stages except for a first scan stage connected to the scan start line may be connected to a first scan line of a previous first scan stage, each of the second scan stages except for a second scan stage connected to the scan start line may be connected to a second scan line of a previous second scan stage, each of the third scan stages except for a third scan stage connected to the scan start line may be connected to a third scan line of a previous third scan stage, and each of the fourth scan stages except for a fourth scan stage connected to the scan start line may be connected to a fourth scan line of a previous fourth scan stage.

Each of first emission lines of first emission stages among the emission stages may be connected to an adjacent first pixel row and an adjacent second pixel row, and each of second emission lines of second emission stages among the emission stages may be connected to an adjacent third pixel row and an adjacent fourth pixel row.

The first emission stages may be connected to first emission clock lines, the second emission stages may be connected to second emission clock lines different from the first emission clock lines, one of the first emission stages and one of the second emission stages may be connected to the same emission stop line, each of the first emission stages except for a first emission stage connected to the emission stop line may be connected to an emission line of a previous first emission stage, and each of the second emission stages except for a second emission stage connected to the emission stop line may be connected to an emission line of a previous second emission stage.

Each of first emission lines of first emission stages among the emission stages may be connected to an adjacent first pixel row and an adjacent third pixel row, and each of second emission lines of second emission stages among the emission stages may be connected to an adjacent second pixel row and an adjacent fourth pixel row.

The first emission stages may be connected to first emission clock lines, the second emission stages may be connected to second emission clock lines different from the first emission clock lines, one of the first emission stages and one of the second emission stages may be connected to the same emission stop line, each of the first emission stages except for a first emission stage connected to the emission stop line may be connected to an emission line of a previous first emission stage, and each of the second emission stages except for a second emission stage connected to the emission stop line may be connected to an emission line of a previous second emission stage.

Each of the emission lines of the emission stages may be connected to an adjacent first pixel row, an adjacent second pixel row, an adjacent third pixel row, and an adjacent fourth pixel row.

The emission stages may be connected to the same emission clock lines, and the remaining emission stages except for an emission stage connected to an emission stop line among the emission stages may be connected to an emission line of a previous emission stage.

During a first frame period, cycles of first scan clock signals applied to the first scan clock lines may have a first time interval, during a first sub-frame period of a second frame period, the cycles of the first scan clock signals may have a second time interval less than the first time interval, and during a first sub-frame period of a third frame period, the cycles of the first scan clock signals may have a third time interval less than the second time interval.

The second frame period may be twice the first frame period, the third frame period may be four times the first frame period, the second time interval may be ½ times the first time interval, and the third time interval may be ¼ times the first time interval.

BRIEF DESCRIPTION OF THE DRAWINGS

The accompanying drawings, which are included to provide a further understanding of the present disclosure, and are incorporated in and constitute a part of this specification, illustrate example embodiments of the present disclosure, and, together with the description, serve to explain principles of the present disclosure.

DETAILED DESCRIPTION

Figure 1:
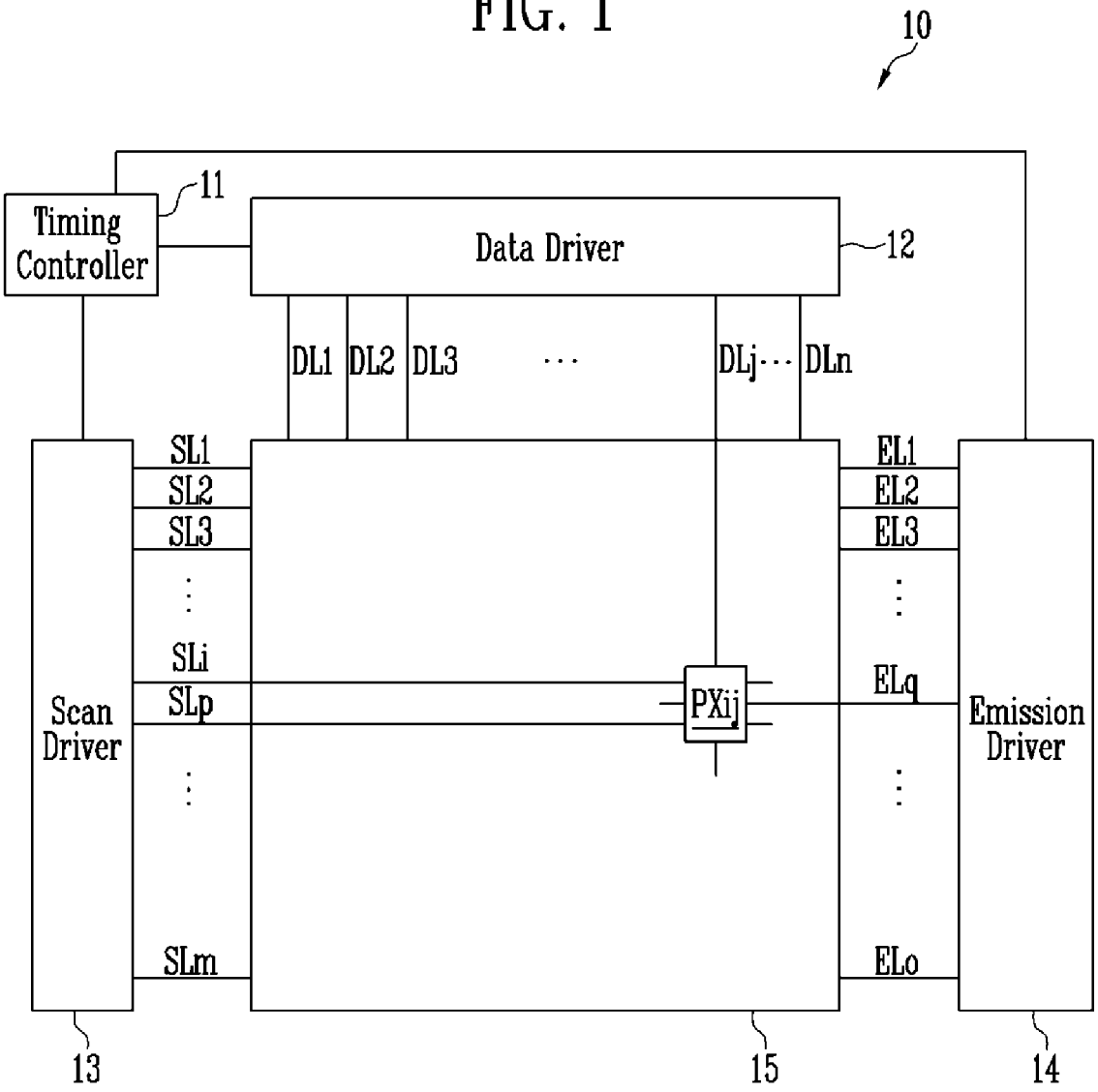
FIG. 1 is a diagram for explaining a display device according to an embodiment of the present disclosure.

Hereinafter, various embodiments of the present disclosure will be described in detail with reference to the accompanying drawings so that those of ordinary skill in the art may easily implement the present disclosure. The present disclosure may be embodied in various different forms and is not limited to the embodiments described herein.

In order to clearly describe the present disclosure, parts that are not related to the description are omitted, and the same or similar components are denoted by the same reference numerals throughout the specification. Therefore, the reference numerals described above may also be used in other drawings.

In addition, the size and thickness of each component shown in the drawings are arbitrarily shown for convenience of description, and thus the present disclosure is not necessarily limited to those shown in the drawings. In the drawings, thicknesses may be exaggerated to clearly express the layers and regions.

In addition, in the description, the expression "is the same" may mean "substantially the same". That is, it may be the same enough to convince those of ordinary skill in the art to be the same. In other expressions, "substantially" may be omitted.

FIG. 1 is a diagram for explaining a display device according to an embodiment of the present disclosure.

Referring to FIG. 1, a display device 10 according to an embodiment of the present disclosure may include a timing controller 11, a data driver 12, a scan driver 13, an emission driver 14, and a pixel unit 15.

The timing controller 11 may receive grayscales and control signals for each image frame from a processor. The timing controller 11 may provide control signals suitable for each specification to the data driver 12, the scan driver 13, and the emission driver 14 to display an image corresponding to an image frame.

The timing controller 11 may render the grayscales to correspond to a specification of the pixel unit 15. For example, the processor may provide a red grayscale, a green grayscale, and a blue grayscale for each unit dot. However, for example, when the pixel unit 15 has a pentile structure, since adjacent unit dots share pixels, the pixels may not correspond to each grayscale on a one-to-one basis. In this case, rendering of the grayscales may be necessary. When the pixels correspond to each grayscale on a one-to-one basis, the rendering of the grayscales may not be necessary.

The data driver 12 may generate data voltages to be provided to data lines DL1, DL2, DL3, DLj, and DLn using the grayscales that are rendered or not rendered and the control signals. For example, the data driver 12 may sample the grayscales using a clock signal and apply the data voltages corresponding to the grayscales to the data lines DL1 to DLn in units of pixel rows, where j may be an integer greater than 0, and n may be an integer greater than j.

The scan driver 13 may receive a clock signal, a scan start signal, and the like from the timing controller 11 to generate scan signals to be provided to scan lines SL1, SL2, SLi, SLp, and SLm, where i may be an integer greater than 0, p may be an integer greater than i, and m may be an integer greater than p.

The scan driver 13 may provide the scan signals to the scan lines SL1 to SLm. For example, the scan driver 13 may sequentially supply the scan signals having a turn-on level pulse. The scan driver 13 may include scan stages configured in the form of a shift register. For example, the scan driver 13 may generate the scan signals by sequentially transferring the scan start signal in the form of a turn-on level pulse to the next scan stage according to the control of scan clock signals.

The emission driver 14 may provide emission signals to emission lines ELL EL2, EL3, ELq, and ELo. For example, the emission driver 14 may sequentially supply the emission signals having a turn-off level pulse. The emission driver 14 may include emission stages configured in the form of a shift register. For example, the emission driver 14 may generate the emission signals by sequentially transferring an emission stop signal in the form of a turn-off level pulse to the next emission stage according to the control of emission clock signals, where q may be an integer greater than 0, and o may be an integer greater than q.

The pixel unit 15 may include a plurality of pixels. Each of the pixels may be connected to at least two of the scan lines SL1 to SLm and at least one of the emission lines EL1 to ELo. Also, each of the pixels may be connected to at least one data line. For example, a pixel PXij may be connected to an i-th scan line SLi, a p-th scan line SLp, a q-th emission line ELq, and a j-th data line DLj. A pixel row may be defined as a set of pixels connected to the same scan lines and emission line. For example, an i-th pixel row may be defined as pixels connected to the i-th scan line SLi, the p-th scan line SLp, and the q-th emission line ELq. The i-th pixel row may include the pixel PXij. The pixels constituting the i-th pixel row may be connected to different data lines.

Figure 2:
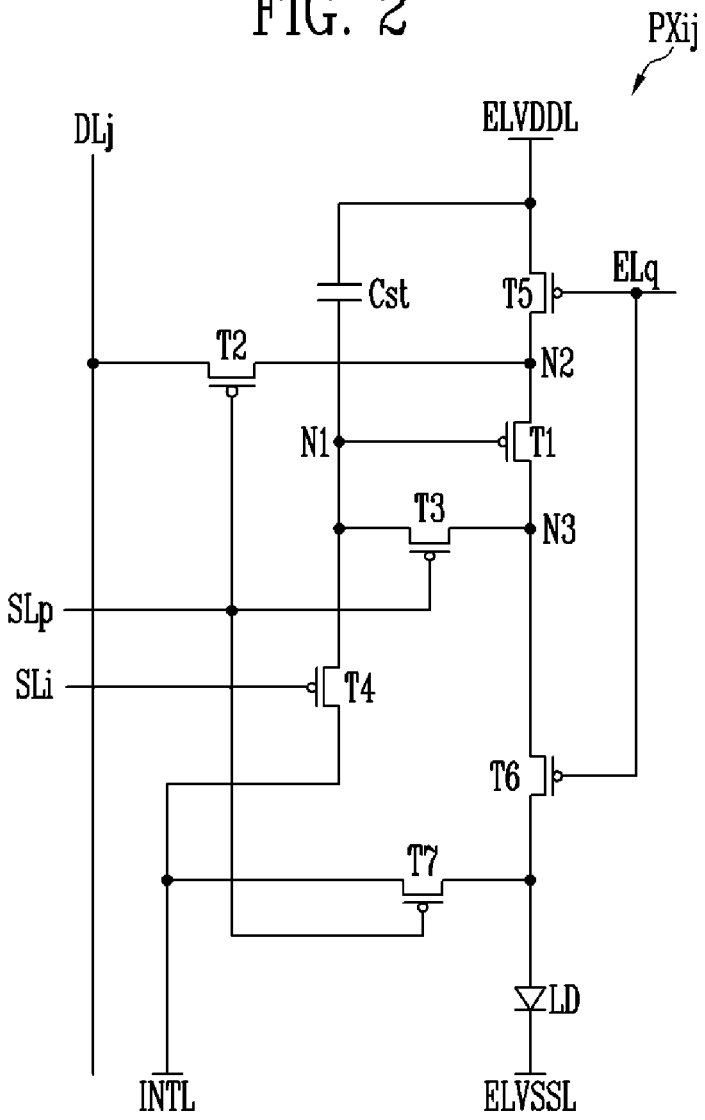
FIG. 2 is a diagram for explaining a pixel according to an embodiment of the present disclosure.

FIG. 2 is a diagram for explaining a pixel according to an embodiment of the present disclosure.

Referring to FIG. 2, a pixel PXij may include transistors T1, T2, T3, T4, T5, T6, and T7, a storage capacitor Cst, and a light emitting diode LD.

Hereinafter, a circuit composed of P-type transistors will be described as an example. However, those skilled in the art may design a circuit composed of N-type transistors by changing the polarity of a voltage applied to a gate terminal. Similarly, those skilled in the art will be able to design a circuit composed of a combination of a P-type transistor and an N-type transistor. The P-type transistor may generally refer to a transistor in which the amount of current increases when a voltage difference between a gate electrode and a source electrode increases in a negative direction. The N-type transistor may generally refer to a transistor in which the amount of current increases when the voltage difference between the gate electrode and the source electrode increases in a positive direction. The transistors may be composed of various forms such as a thin film transistor (TFT), a field effect transistor (FET), and a bipolar junction transistor (BJT).

The transistor T1 may have a gate electrode connected to a node N1, a first electrode connected to a node N2, and a second electrode connected to a node N3. The transistor T1 may be referred to as a driving transistor.

The transistor T2 may have a gate electrode connected to a p-th scan line SLp, a first electrode connected to a data line DLj, and a second electrode connected to the node N2. Transistor T2 may be referred to as a scan transistor.

The transistor T3 may have a gate electrode connected to the p-th scan line SLp, a first electrode connected to the node N1, and a second electrode connected to the node N3. Transistor T3 may be referred to as a diode-connected transistor.

The transistor T4 may have a gate electrode connected to an i-th scan line SLi, a first electrode connected to the node N1, and a second electrode connected to an initialization line INTL. In another embodiment, the gate electrode of the transistor T4 may be connected to another scan line. The transistor T4 may be referred to as a gate initialization transistor.

The transistor T5 may have a gate electrode connected to a q-th emission line ELq, a first electrode connected to a first display power source line ELVDDL, and a second electrode connected to the node N2. The transistor T5 may be referred to as a first emission transistor. In another embodiment, the gate electrode of the transistor T5 may be connected to another emission line.

The transistor T6 may have a gate electrode connected to the q-th emission line ELq, a first electrode connected to the node N3, and a second electrode connected to an anode of the light emitting diode LD. The transistor T6 may be referred to as a second emission transistor. In another embodiment, the gate electrode of the transistor T6 may be connected to another emission line.

The transistor T7 may have a gate electrode connected to the p-th scan line SLp, a first electrode connected to the initialization line INTL, and a second electrode connected to the anode of the light emitting diode LD. The transistor T7 may be referred to as an anode initialization transistor. In another embodiment, the gate electrode of the transistor T7 may be connected to another scan line. For example, the gate electrode of the transistor T7 may be connected to the i-th scan line SLi.

The storage capacitor Cst may have a first electrode which is connected to the first display power source line ELVDDL and a second electrode which is connected to the node N1.

The light emitting diode LD may have the anode connected to the second electrode of the transistor T6 and a cathode connected to a second display power source line ELVSSL. The light emitting diode LD may be composed of an organic light emitting diode, an inorganic light emitting diode, a quantum dot/well light emitting diode, or the like. Further, the light emitting diode LD may be composed of a plurality of light emitting diodes connected in series, in parallel, or in series and parallel.

A first display power source voltage may be applied to the first display power source line ELVDDL, a second display power source voltage may be applied to the second display power source line ELVSSL, and an initialization voltage may be applied to the initialization line INTL. For example, during a display period of the display device 10, the first display power source voltage may be greater than the second display power source voltage. For example, the initialization voltage may be equal to or greater than the second display power source voltage. For example, the initialization voltage may correspond to a data voltage having the smallest size among the data voltages that can be provided. For example, the size of the initialization voltage may be smaller than the sizes of the data voltages that can be provided.

Figure 3:
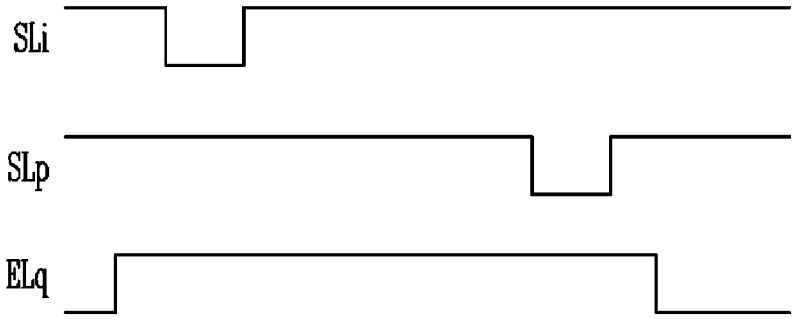
FIG. 3 is a diagram for explaining a driving method of the pixel according to an embodiment of the present disclosure.

FIG. 3 is a diagram for explaining a driving method of the pixel according to an embodiment of the present disclosure.

In FIG. 3, a driving method will be described based on the above-described pixel PXij. Also, pixels in the i-th pixel row may be driven in the same manner as in FIG. 3.

First, an i-th scan signal of a turn-on level (logic low level) may be applied to the i-th scan line SLi. In this case, since a scan signal of a turn-off level (logic high level) is applied to the p-th scan line SLp, the transistor T2 may be in a turned-off state, and a data voltage for another pixel may be prevented from being written to the pixel PXij.

In this case, since the transistor T4 is turned on, the first node N1 may be connected to the initialization line INTL, so that a voltage of the first node N1 may be initialized. Since an emission signal of a turn-off level is applied to the emission line ELi, the transistors T5 and T6 may be in the turned-off state, and unnecessary emitting light from the light emitting diode LD according to a process of applying an initialization voltage can be prevented.

Next, a data voltage for the pixel PXij may be applied to the data line DLj, and a scan signal of a turn-on-level may be applied to the p-th scan line SLp. Accordingly, the transistors T2, T1, and T3 may be in a conductive state, and the data line DLj and the first node N1 may be electrically connected. Accordingly, a compensation voltage obtained by subtracting a threshold voltage of the transistor T1 from the data voltage may be applied to the second electrode of the storage capacitor Cst (that is, the first node N1), and the storage capacitor Cst may maintain a voltage corresponding to a difference between the first display power source voltage and the compensation voltage. This period may be referred to as a threshold voltage compensation period.

In this case, since the transistor T7 is in a turned-on state, the anode of the light emitting diode LD and the initialization line INTL may be connected, and the light emitting diode LD may be initialized with the amount of charge corresponding to a voltage difference between the initialization voltage and the second display power source voltage.

Thereafter, as an emission signal of a turn-on level is applied to the q-th emission line ELq, the transistors T5 and T6 may be conducted. Accordingly, a driving current path connected through the first display power source line ELVDDL, the transistor T5, the transistor T1, the transistor T6, the light emitting diode LD, and the second display power source line ELVSSL may be formed.

The amount of driving current flowing through the first electrode and the second electrode of the transistor T1 may be adjusted according to the voltage maintained in the storage capacitor Cst. The light emitting diode LD may emit light with a luminance corresponding to the amount of driving current. The light emitting diode LD may emit light until an emission signal of the turn-off level is applied to the emission line ELq.

FIGS. 4, 5, 6, 7, 8, 9, 10, 11, 12, 13, and 14 are diagrams for explaining a scan driver, a pixel unit, and an emission driver according to a first embodiment of the present disclosure.

Figure 4:
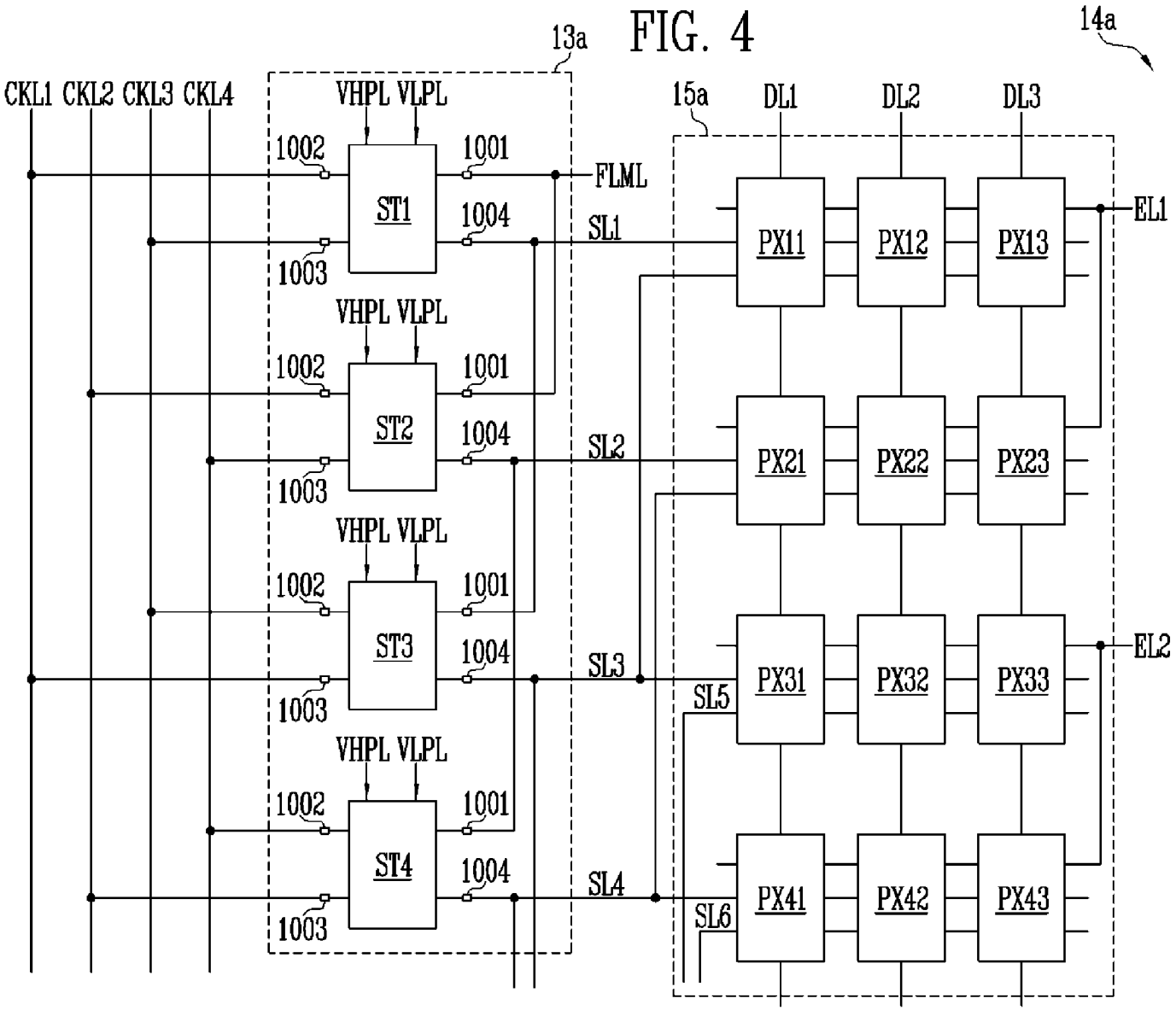
FIGS. 4, 5, 6, 7, 8, 9, 10, 11, 12, 13, and 14 are diagrams for explaining a scan driver, a pixel unit, and an emission driver according to a first embodiment of the present disclosure.

Referring to FIG. 4, a connection relationship between a scan driver 13*a*, a pixel unit 15*a*, and an emission driver 14*a* according to the first embodiment is shown.

The scan driver 13*a* may include first scan stages ST1, ST3, . . . connected to first scan lines SL1, SL3, . . . and second scan stages ST2, ST4, . . . connected to second scan lines SL2, SL4, . . . .

The pixel unit 15*a* may include first pixel rows connected to the first scan lines SL1, SL3, . . . and second pixel rows alternating with the first pixel rows and connected to the second scan lines SL2, SL4, . . . . For example, one portion of the first pixel row PX11, PX12, PX13, . . . may be connected to first scan lines SL1 and SL3, and the other portion of the first pixel row PX31, PX32, PX33, . . . may be connected to first scan lines SL3 and SL5 (not shown in FIG. 4). Furthermore, one portion of the second pixel row PX21, PX22, PX23, . . . may be connected to second scan lines SL2 and SL4, and the other portion of the second pixel row PX41, PX42, PX43, . . . may be connected to second scan lines SL4 and SL6 (not shown in FIG. 4).

The first scan lines SL1, SL3, . . . may be connected to the first pixel rows. For example, the first pixel rows may be odd-numbered pixel rows. For example, the first scan lines SL1, SL3, . . . may be odd-numbered scan lines. For example, the first scan stages ST1, ST3, . . . may be odd-numbered scan stages.

The second scan lines SL2, SL4, . . . may be connected to the second pixel rows. For example, the second pixel rows may be even-numbered pixel rows. For example, the second scan lines SL2, SL4, . . . may be even-numbered scan lines. For example, the second scan stages ST2, ST4, . . . may be even-numbered scan stages.

Each of the scan stages ST1, ST2, ST3, and ST4 may include a first input terminal 1001, a second input terminal 1002, a third input terminal 1003, and an output terminal 1004. One ST1 of the first scan stages ST1, ST3, . . . and one ST2 of the second scan stages ST2, ST4, . . . may be connected to the same scan start line FLML. For example, the first input terminal 1001 of a first scan stage ST1 and the first input terminal 1001 of a second scan stage ST2 may be connected to the same scan start line FLML. The output terminal 1004 of the first scan stage ST1 may be connected to a first scan line SL1, and the output terminal 1004 of the second scan stage ST2 may be connected to a second scan line SL2.

Each of the first scan stages ST3, . . . except for the first scan stage ST1 may be connected to a first scan line of a previous first scan stage. Each of the second scan stages ST4, . . . except for the second scan stage ST2 may be connected to a second scan line of a previous second scan stage. For example, the first input terminal 1001 of a first scan stage ST3 may be connected to the first scan line SL1 of the first scan stage ST1. Also, the first input terminal 1001 of a second scan stage ST4 may be connected to the second scan line SL2 of the second scan stage ST2.

The first scan stages ST1, ST3, . . . may be connected to first scan clock lines CKL1 and CKL3. The first scan clock lines CKL1 and CKL3 may be alternately connected to second input terminals 1002 and third input terminals 1003 of the first scan stages ST1, ST3, . . . . The second scan stages ST2, ST4, . . . may be connected to second scan clock lines CKL2 and CKL4 different from the first scan clock lines CKL1 and CKL3. The second scan clock lines CKL2 and CKL4 may be alternately connected to second input terminals 1002 and third input terminals 1003 of the second scan stages ST2, ST4, . . . .

Each of the scan stages ST1, ST2, ST3, and ST4 may be connected to a first scan power source line VHPL and a second scan power source line VLPL. Here, a voltage of the first scan power source line VHPL may be set to a turn-off level (gate-off voltage, logic high level). In addition, a voltage of the second scan power source line VLPL may be set to a turn-on level (gate-on voltage, logic low level).

The emission driver 14*a* may include the emission stages in which the emission lines ELL EL2, . . . are connected to two or more pixel rows. For example, each of the emission lines ELL EL2, . . . of the emission stages may be connected to an adjacent first pixel row and an adjacent second pixel row. For example, an emission line EL1 may be connected to an adjacent first pixel row PX11, PX12, PX13, . . . and an adjacent second pixel row PX21, PX22, PX23, . . . . For example, an emission line EL2 may be connected to an adjacent first pixel row PX31, PX32, PX33, . . . and an adjacent second pixel row PX41, PX42, PX43, . . . . An example configuration and driving method of the emission driver 14*a* will be described later with reference to FIGS. 7, 8, and 9.

Figure 5:
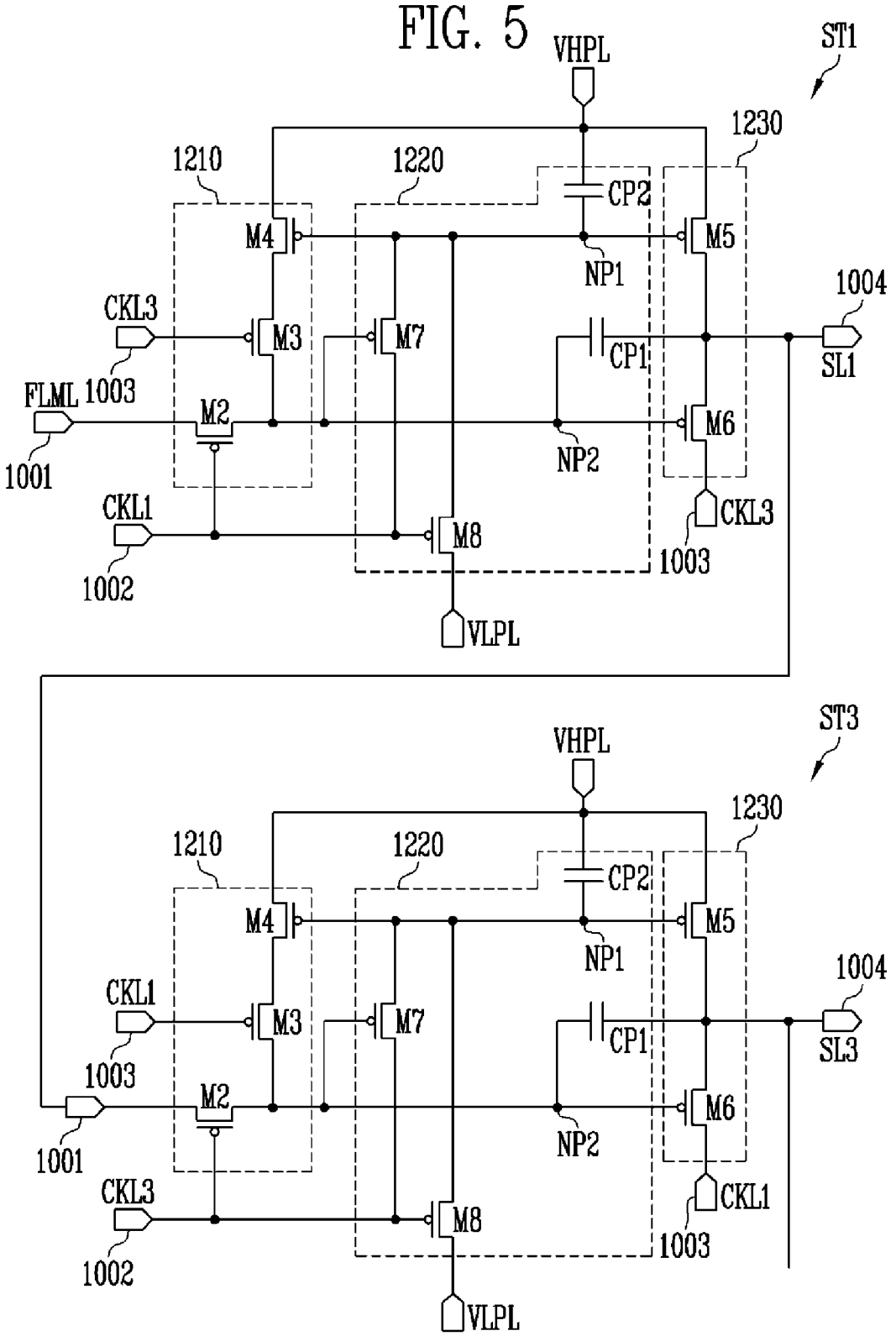

Referring to FIG. 5, first scan stages ST1 and ST3 of the scan driver 13*a* are shown as an example. Since second scan stages ST2 and ST4 of the scan driver 13*a* may have substantially the same structure as the first scan stages ST1 and ST3, duplicate descriptions will be omitted.

Referring to FIG. 5, the first scan stage ST1 may include a first driver 1210, a second driver 1220, and an output unit 1230 (a buffer).

The output unit 1230 may control a voltage supplied to the output terminal 1004 in response to voltages of a node NP1 and a node NP2. To this end, the output unit 1230 may include a transistor M5 and a transistor M6.

The transistor M5 may be positioned between the first scan power source line VHPL and the output terminal 1004, and may have a gate electrode connected to the node NP1. The transistor M5 may control the connection between the first scan power source line VHPL and the output terminal 1004 in response to a voltage applied to the node NP1.

The transistor M6 may be positioned between the output terminal 1004 and the third input terminal 1003, and may have a gate electrode connected to the node NP2. The transistor M6 may control the connection between the output terminal 1004 and the third input terminal 1003 in response to a voltage applied to the node NP2. The output unit 1230 may be driven as a buffer. Additionally, the transistor M5 and the transistor M6 may be composed of a plurality of transistors connected in parallel.

The first driver 1210 may control a voltage of the node NP2 in response to signals supplied to the first to third input terminals 1001, 1002, and 1003. To this end, the first driver 1210 may include a transistor M2, a transistor M3, and a transistor M4.

The transistor M2 may be positioned between the first input terminal 1001 and the node NP2, and may have a gate electrode connected to the second input terminal 1002. The transistor M2 may control the connection between the first input terminal 1001 and the node NP2 in response to a signal supplied to the second input terminal 1002.

The transistor M3 and the transistor M4 may be connected in series between the node NP2 and the first scan power source line VHPL. The transistor M3 may be positioned between the transistor M4 and the node NP2, and may have a gate electrode connected to the third input terminal 1003. The transistor M3 may control the connection between the transistor M4 and the node NP2 in response to a signal supplied to the third input terminal 1003.

The transistor M4 may be positioned between the transistor M3 and the first scan power source line VHPL, and may have a gate electrode connected to the node NP1. The transistor M4 may control the connection between the transistor M3 and the first scan power source line VHPL in response to a voltage of the node NP1.

The second driver 1220 may control the voltage of the node NP1 in response to voltages of the second input terminal 1002 and the node NP2. To this end, the second driver 1220 may include a transistor M7, a transistor M8, a capacitor CP1, and a capacitor CP2.

The capacitor CP1 may be connected between the node NP2 and the output terminal 1004. The capacitor CP1 may charge a voltage corresponding to turn-on and turn-off of the transistor M6.

The capacitor CP2 may be connected between the node NP1 and the first scan power source line VHPL. The capacitor CP2 may charge the voltage applied to the node NP1.

The transistor M7 may be positioned between the node NP1 and the second input terminal 1002, and may have a gate electrode connected to the node NP2. The transistor M7 may control the connection between the node NP1 and the second input terminal 1002 in response to the voltage of the node NP2.

The transistor M8 may be positioned between the node NP1 and the second scan power source line VLPL, and may have a gate electrode connected to the second input terminal 1002. The transistor M8 may control the connection between the node NP1 and the second scan power source line VLPL in response to a signal input to the second input terminal 1002.

A driving method of the first scan stage ST1 will be described with reference to FIG. 6.

Figure 6:
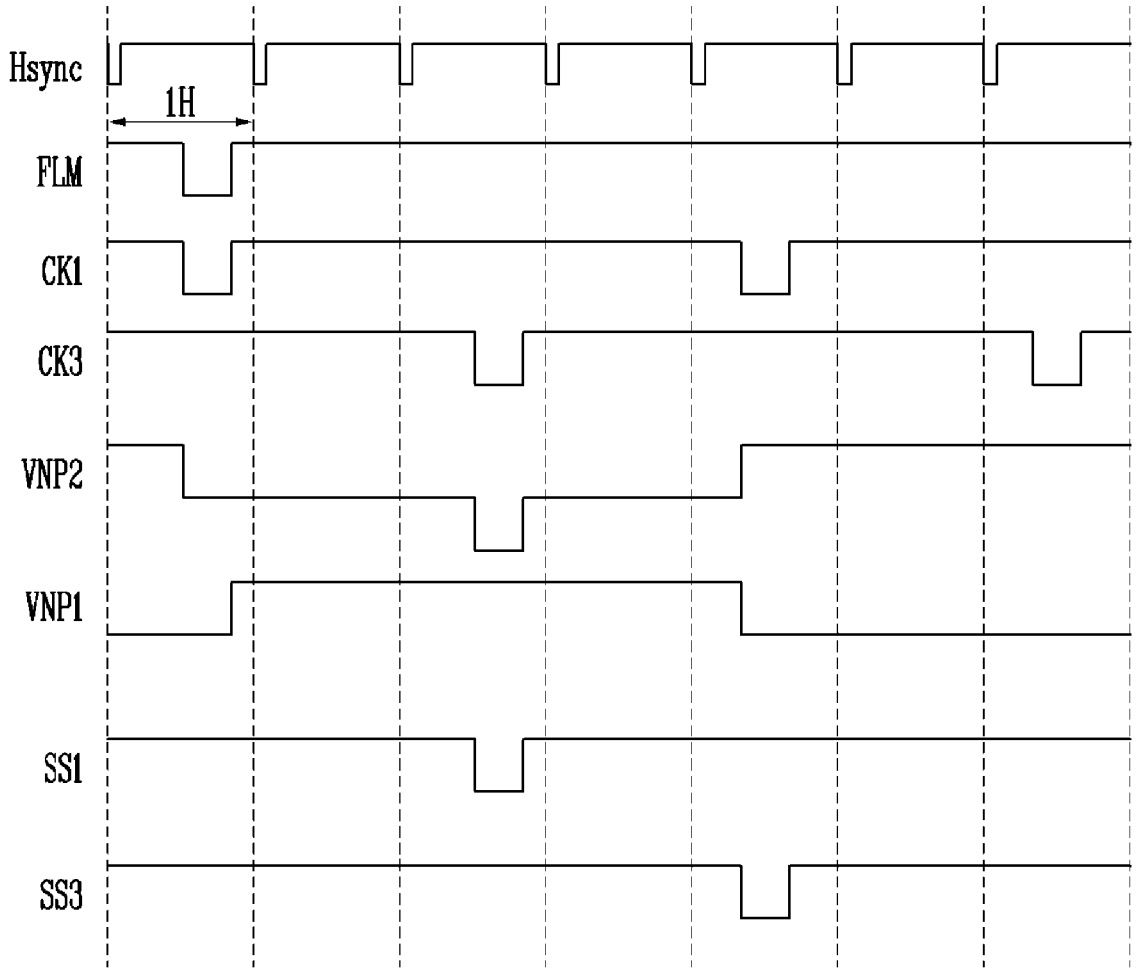

In FIG. 6, it is assumed that a first scan clock signal CK1 and a first scan clock signal CK3 have a cycle of 4 horizontal periods 4H and are supplied in different horizontal periods. The first scan clock signal CK3 may be set as a signal in which the first scan clock signal CK1 is shifted by a half cycle (that is, two horizontal periods). In addition, a scan start signal FLM supplied to the first input terminal 1001 may be supplied in synchronization with the first scan clock signal CK1 supplied to the second input terminal 1002. A cycle of pulses of a horizontal synchronization signal Hsync may be one horizontal period 1H.

The expression that specific signals are supplied may mean that the specific signals have a turn-on level (here, a logic low level). The expression that the supply of specific signals is stopped may mean that clock specific signals have a turn-off level (here, a logic high level).

Additionally, when the scan start signal FLM is supplied, the first input terminal 1001 may be set to a voltage of the logic low level, and when the scan start signal FLM is not supplied, the first input terminal 1001 may be set to a voltage of the logic high level. In addition, when the scan clock signal is supplied to the second input terminal 1002 and the third input terminal 1003, the second input terminal 1002 and the third input terminal 1003 may be set to the voltage of the logic low level, and when the scan clock signal is not supplied, the second input terminal 1002 and the third input terminal 1003 may be set to the voltage of the logic high level.

To explain the operation process in detail, first, the scan start signal FLM may be supplied to be synchronized with the first scan clock signal CK1.

When the first scan clock signal CK1 is supplied, the transistor M2 and the transistor M8 may be turned on. When the transistor M2 is turned on, the first input terminal 1001 and the node NP2 may be electrically connected.

When the first input terminal 1001 and the node NP2 are electrically connected, a voltage VNP2 of the node NP2 may be set to a low level by the scan start signal FLM supplied to the first input terminal 1001. When the voltage VNP2 of the node NP2 is set to the low level, the transistor M6 and the transistor M7 may be turned on.

When the transistor M6 is turned on, the third input terminal 1003 and the output terminal 1004 may be electrically connected. Here, the third input terminal 1003 may be set to a voltage of a high level (that is, the first scan clock signal CK3 is not supplied), and accordingly, the voltage of the high level may be output to the output terminal 1004. When the transistor M7 is turned on, the second input terminal 1002 and the node NP1 may be electrically connected. According to the first scan clock signal CK1 supplied to the second input terminal 1002, a voltage VNP1 of the node NP1 may be set to the low level.

Additionally, when the first scan clock signal CK1 is supplied, the transistor M8 may be turned on. When the transistor M8 is turned on, the voltage of the second scan power source line VLPL may be supplied to the node NP1. Here, the voltage of the second scan power source line VLPL may be set to the same (or similar) voltage as the low level of the first scan clock signal CK1, and accordingly, the node NP1 may stably maintain the voltage of the low level.

When the node NP1 is set to the voltage of the low level, the transistor M4 and the transistor M5 may be turned on. When the transistor M4 is turned on, the first scan power source line VHPL and the transistor M3 may be electrically connected. Here, since the transistor M3 is set in the turned-off state, the node NP2 may stably maintain the voltage of the low level even when the transistor M4 is turned on. When the transistor M5 is turned on, the voltage of the first scan power source line VHPL may be supplied to the output terminal 1004. Here, the voltage of the first scan power source line VHPL may be set to the same (or similar) voltage as the voltage of the high level supplied to the third input terminal 1003, and accordingly, the output terminal 1004 may stably maintain the voltage of the high level.

Thereafter, the supply of the scan start signal FLM and the first scan clock signal CK1 may be stopped. When the supply of the first scan clock signal CK1 is stopped, the transistor M2 and the transistor M8 may be turned off. In this case, the transistor M6 and the transistor M7 may be maintained in the turned-on state in response to the voltage stored in the capacitor CP1. That is, the node NP2 may be maintained in the voltage of the low level by the voltage stored in the capacitor CP1.

When the transistor M6 is maintained in the turned-on state, the output terminal 1004 and the third input terminal 1003 may be maintained in a state electrically connected. When the transistor M7 is maintained in the turned-on state, the node NP1 may be maintained in a state electrically connected to the second input terminal 1002. Here, a voltage of the second input terminal 1002 may be set to the voltage of the high level as the supply of the first scan clock signal CK1 is stopped, and accordingly, the node NP1 may also be set to the voltage of the high level. When the voltage of the high level is supplied to the node NP1, the transistor M4 and the transistor M5 may be turned off.

Thereafter, the first scan clock signal CK3 may be supplied to the third input terminal 1003. In this case, since the transistor M6 is set in the turned-on state, the first scan clock signal CK3 supplied to the third input terminal 1003 may be supplied to the output terminal 1004. In this case, the output terminal 1004 may output the first scan clock signal CK3 as a first scan signal SS1 of a turn-on level to the first scan line SL1.

On the other hand, when the first scan clock signal CK3 is supplied to the output terminal 1004, the voltage of the node NP2 may be lowered to a voltage lower than the voltage of the second scan power source line VLPL due to coupling of the capacitor CP1. Accordingly, the transistor M6 may be stably maintained in the turned-on state.

After the first scan signal SS1 of the turn-on level is output to the first scan line SL1, the supply of the first scan clock signal CK3 may be stopped. When the supply of the first scan clock signal CK3 is stopped, the voltage of the high level may be output to the output terminal 1004. In addition, the voltage VNP2 of the node NP2 may increase to approximately the voltage of the second scan power source line VLPL in response to the voltage of the high level of the output terminal 1004.

Thereafter, the first scan clock signal CK1 may be supplied. When the first scan clock signal CK1 is supplied, the transistor M2 and the transistor M8 may be turned on. When the transistor M2 is turned on, the first input terminal 1001 and the node NP2 may be electrically connected. In this case, the scan start signal FLM may not be supplied to the first input terminal 1001, and may be set to the voltage of the high level. Accordingly, when the transistor M2 is turned on, the voltage of the high level may be supplied to the node NP2, and accordingly, the transistor M6 and the transistor M7 may be turned off.

When the transistor M8 is turned on, the voltage of the second scan power source line VLPL may be supplied to the node NP1, and accordingly, the transistor M4 and the transistor M5 may be turned on. When the transistor M5 is turned on, the voltage of the first scan power source line VHPL may be supplied to the output terminal 1004. Thereafter, the transistor M4 and the transistor M5 may be maintained in the turned-on state in response to the voltage charged in the capacitor CP2, and accordingly, the voltage of the first scan power source line VHPL may be stably supplied to the output terminal 1004.

Additionally, when the first scan clock signal CK3 is supplied, the transistor M3 may be turned on. In this case, since the transistor M4 is set in the turned-on state, the voltage of the first scan power source line VHPL may be supplied to the node NP2. In this case, the transistor M6 and the transistor M7 may be stably maintained in the turned-off state.

The first scan stage ST3 may receive an output signal (that is, the first scan signal) of the first scan stage ST1 so as to be synchronized with the first scan clock signal CK3. In this case, the first scan stage ST3 may output a first scan signal SS3 of the turn-on level to the first scan line SL3 to be synchronized with the first scan clock signal CK1. The first scan stages ST1, ST3, . . . may sequentially output the scan signal of the turn-on level to the first scan lines SL1, SL3, . . . while repeating the above-described processes.

The scan stage and driving method thereof shown in FIGS. 5 and 6 are an example, and other conventional scan stages and driving methods can be used to implement the embodiments of the present disclosure.

Figure 7:
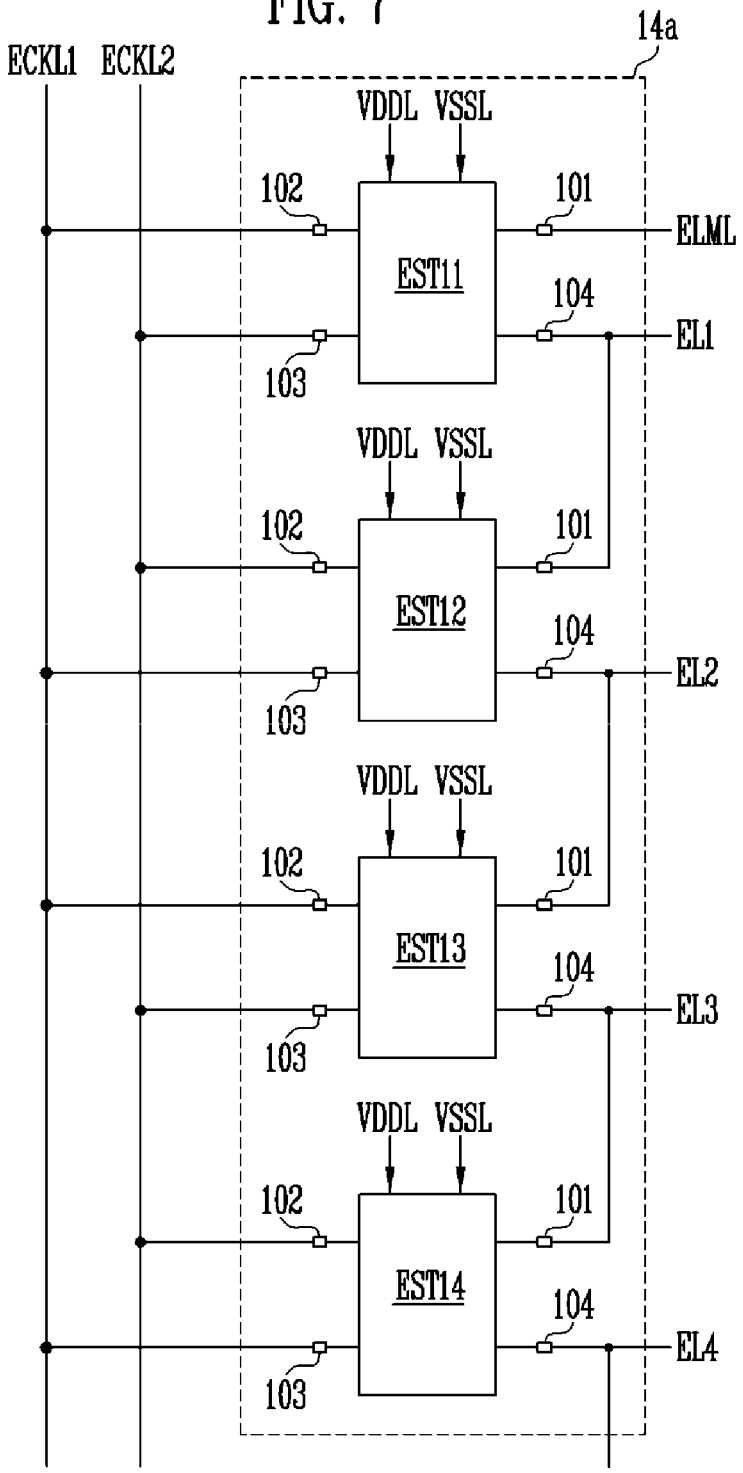

Referring to FIG. 7, the emission driver 14*a* may include emission stages EST11, EST12, EST13, and EST14. FIG. 7 shows four emission stages EST11, EST12, EST13, and EST14 for convenience of description. The emission stages EST11, EST12, EST13, and EST14 may be connected to corresponding emission lines EL1, EL2, EL3, and EL4, respectively, and may be commonly connected to emission clock lines ECKL1 and ECKL2. The emission stages EST11, EST12, EST13, and EST14 may have substantially the same circuit structure.

The emission stages EST11, EST12, EST13, and EST14 may be connected to the same emission clock lines ECKL1 and ECKL2. The emission stages EST12, EST13, and EST14 except for the first emission stage EST11 connected to an emission stop line ELML may be connected to an emission line of a previous emission stage.

Each of the emission stages EST11, EST12, EST13, and EST14 may include a first input terminal 101, a second input terminal 102, a third input terminal 103, and an output terminal 104.

The first input terminal 101 may receive an output signal (an emission signal or a carry signal) or an emission stop signal of the previous emission stage. For example, the first input terminal 101 of the emission stage EST11 may be connected to the emission stop line ELML, and first input terminals 101 of the remaining emission stages EST12 to EST14 may be connected to the emission line of the previous emission stage.

The second input terminal 102 of an l-th emission stage may be connected to an emission clock line ECKL1, and the third input terminal 103 may be connected to an emission clock line ECKL2, where 1 may be an odd number or an even number. In addition, the second input terminal 102 of an (l+1)th emission stage may be connected to the emission clock line ECKL2, and the third input terminal 103 may be connected to the emission clock line ECKL1. That is, the emission clock line ECKL1 and the emission clock line ECKL2 may be alternately connected to the second input terminal 102 and the third input terminal 103 of each emission stage. In particular, the second input terminals 102 of the odd numbered emission stages EST11 and EST13 are connected to the emission clock line ECKL1, and the third input terminals 103 of the even numbered states EST12 and EST14 are connected to the emission clock line ECKL2.

Figure 9:
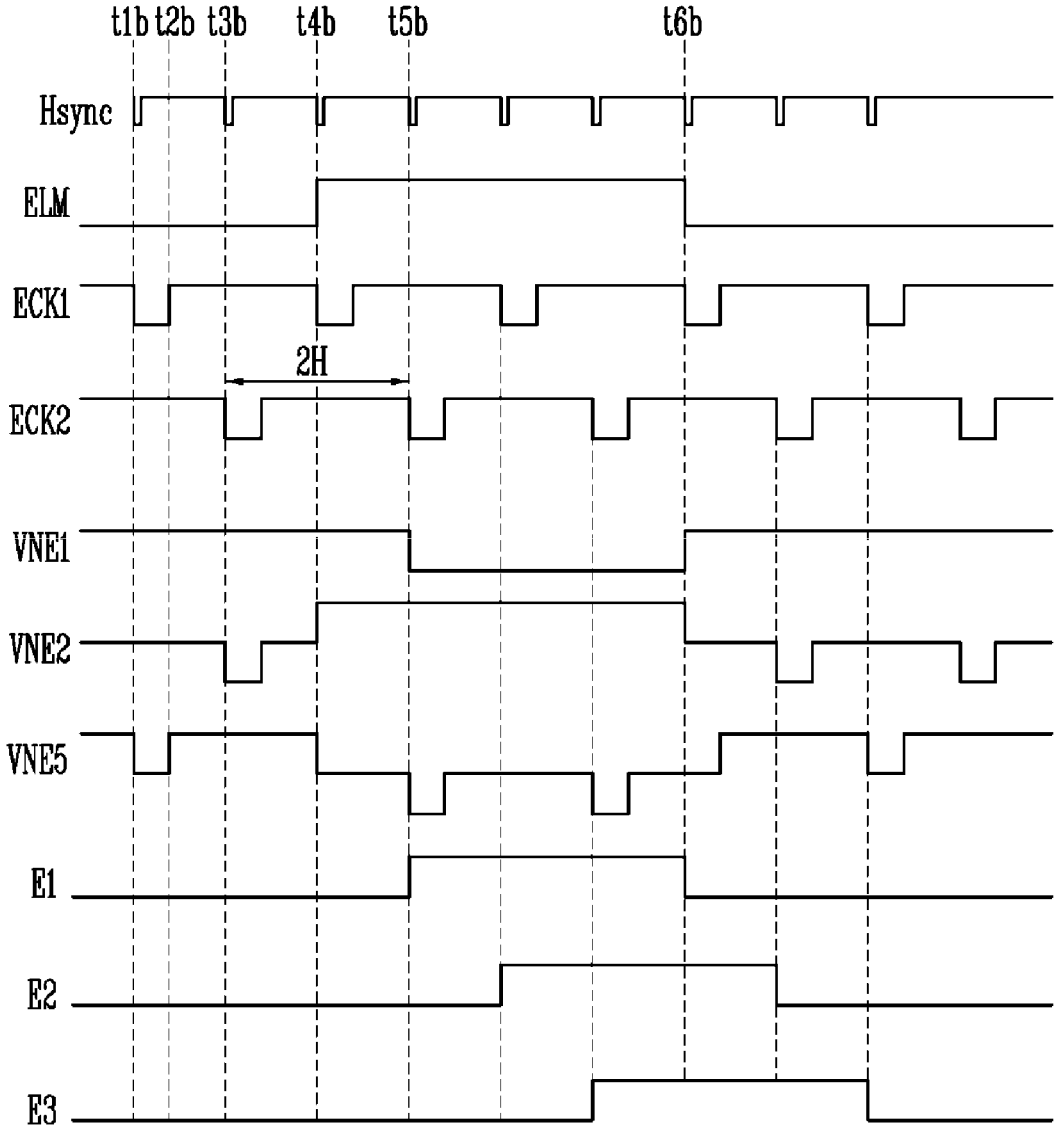

Pulses of an emission clock signal ECK1 applied to the emission clock line ECKL1 and pulses of an emission clock signal ECK2 applied to the emission clock line ECKL2 may not overlap each other in time (see FIG. 9). In this case, each of the pulses may be a turn-on level.

The emission stages EST11, EST12, EST13, and EST14 may be connected to a first emission power source line VDDL and a second emission power source line VSSL. A voltage of the first emission power source line VDDL may be set to a turn-off level, and a voltage of the second emission power source line VSSL may be set to a turn-on level. A voltage level of the emission signal may be set based on a voltage of one of the first emission power source line VDDL and the second emission power source line VSSL.

Figure 8:
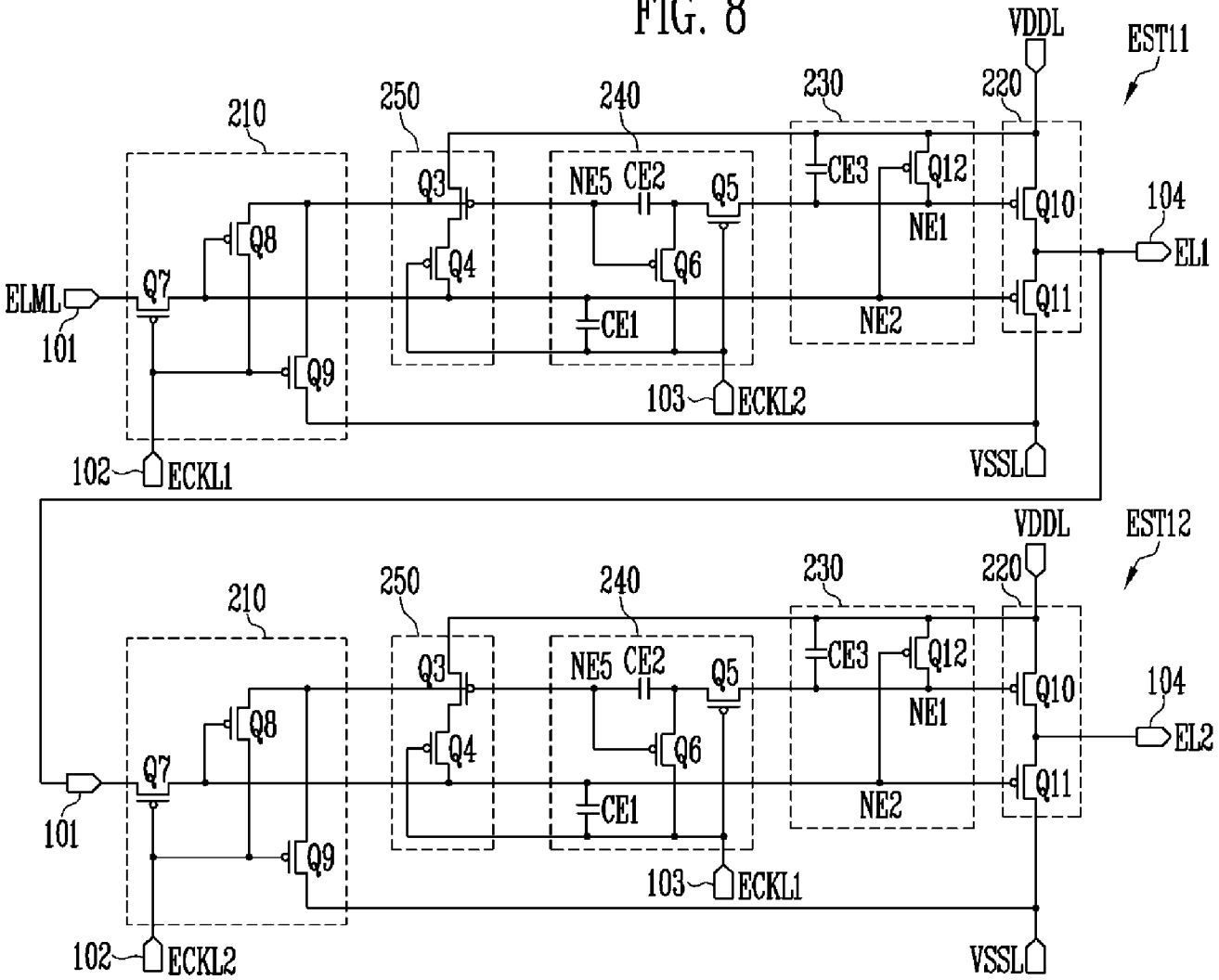

FIG. 8 is a diagram for explaining emission stages EST11 and EST12 of FIG. 7. Since other emission stages EST13, EST14, . . . may have substantially the same structure, duplicate descriptions will be omitted.

Referring to FIG. 8, the emission stage EST11 may include an input unit 210, an output unit 220, a first signal processing unit 230, a second signal processing unit 240, and a third signal processing unit 250.

The output unit 220 may supply the voltage of the first emission power source line VDDL or the second emission power source line VSSL to the output terminal 104 in response to voltages of a node NE1 and a node NE2. To this end, the output unit 220 may include a transistor Q10 and a transistor Q11.

The transistor Q10 may be connected between the first emission power source line VDDL and the output terminal 104. In addition, a gate electrode of the transistor Q10 may be connected to the node NE1. The transistor Q10 may be turned on or turned off in response to a voltage of the node NE1. Here, when the transistor Q10 is turned on, the voltage of the first emission power source line VDDL supplied to the output terminal 104 may be output as the emission signal of the turn-off level through the emission line ELL The transistor Q11 may be connected between the output terminal 104 and the second emission power source line VSSL. In addition, a gate electrode of the transistor Q11 may be connected to the node NE2. The transistor Q11 may be turned on or turned off in response to a voltage of the node NE2. Here, when the transistor Q11 is turned on, the voltage of the second emission power source line VSSL supplied to the output terminal 104 may be output as the emission signal of the turn-on level through the emission line EL1.

The input unit 210 may control voltages of the node NE2 and a node NE5 in response to signals supplied to the first and second input terminals 101 and 102. To this end, the input unit 210 may include a transistor Q7, a transistor Q8, and a transistor Q9.

The transistor Q7 may be located between the first input terminal 101 and the node NE2 and electrically connected to the first input terminal 101 and the node NE2. In addition, a gate electrode of the transistor Q7 may be connected to the second input terminal 102. The transistor Q7 may be turned on when a clock signal of a turn-on level is supplied to the second input terminal 102 to electrically connect the first input terminal 101 and the node NE2.

The transistor Q8 may be located between the node NE5 and the second input terminal 102 and electrically connected to the node NE5 and the second input terminal 102. In addition, a gate electrode of the transistor Q8 may be connected to the node NE2. The transistor Q8 may be turned on or turned off in response to the voltage of the node NE2.

The transistor Q9 may be located between the node NE5 and the second emission power source line VSSL and electrically connected to the node NE5 and the second emission power source line VSSL. In addition, a gate electrode of the transistor Q9 may be connected to the second input terminal 102. The transistor Q9 may be turned on when the clock signal of the turn-on level is supplied to the second input terminal 102 to supply the voltage of the second emission power source line VSSL to the node NE5.

The first signal processing unit 230 may control the voltage of the node NE1 in response to the voltage of the node NE2. To this end, the first signal processing unit 230 may include a transistor Q12 and a capacitor CE3.

The transistor Q12 may be located between the first emission power source line VDDL and the node NE1 and electrically connected to the first emission power source line VDDL and the node NE1. In addition, a gate electrode of the transistor Q12 may be connected to the node NE2. The transistor Q12 may be turned on or turned off in response to the voltage of the node NE2.

The capacitor CE3 may be located between the first emission power source line VDDL and the node NE1 and electrically connected to the first emission power source line VDDL and the node NE1. The capacitor CE3 may maintain a voltage applied to the node NE1.

The second signal processing unit 240 may be connected to the node NE5 and may control the voltage of the node NE1 in response to a signal supplied to the third input terminal 103. To this end, the second signal processing unit 240 may include a transistor Q5, a transistor Q6, a capacitor CE1, and a capacitor CE2.

The capacitor CE1 may be located between the node NE2 and the third input terminal 103 and electrically connected to the node NE2 and the third input terminal 103. The capacitor CE1 may maintain a voltage difference between the third input terminal 103 and the node NE2.

A first electrode of the capacitor CE2 may be connected to the node NE5, and a second electrode may be connected to the transistor Q5.

The transistor Q5 may be located between the second electrode of the capacitor CE2 and the node NE1 and electrically connected to the second electrode of the capacitor CE2 and the node NE1. In addition, a gate electrode of the transistor Q5 may be connected to the third input terminal 103. The transistor Q5 may be turned on when an emission clock signal is supplied to the third input terminal 103 to electrically connect the second electrode of the capacitor CE2 and the node NE1.

The transistor Q6 may be located between the second electrode of the capacitor CE2 and the third input terminal 103 and electrically connected to the second electrode of the capacitor CE2 and the third input terminal 103. In addition, a gate electrode of the transistor Q6 may be connected to the node NE5.

The third signal processing unit 250 may control the voltage of the node NE2 in response to a voltage of the node NE5 and the signal supplied to the third input terminal 103. To this end, the third signal processing unit 250 may include a transistor Q3 and a transistor Q4.

The transistor Q3 and the transistor Q4 may be connected in series between the first emission power source line VDDL and the node NE2. A gate electrode of the transistor Q3 may be connected to the node NE5. In addition, a gate electrode of the transistor Q4 may be connected to the third input terminal 103.

Meanwhile, the emission stage EST12 may have substantially the same configuration as the emission stage EST11 except for signals supplied to the first input terminal 101, the second input terminal 102, and the third input terminal 103. Therefore, a duplicate description of the emission stage EST12 will be omitted.

FIG. 9 is a diagram for explaining a driving method of the emission stage of FIG. 8.

In FIG. 9, an operation process will be described based on an emission stage ST1. In FIG. 9, it is assumed that pulses of the emission clock signal ECK1 and pulses of the emission clock signal ECK2 have a cycle of 2 horizontal periods, respectively, and are generated in different horizontal periods. For example, a pulse of the emission clock signal ECK2 may be a signal shifted by a half cycle (that is, one horizontal period 1H) based on a pulse of the emission clock signal ECK1.

The emission stop signal ELM of a turn-off level (high level) supplied to the first input terminal 101 may be set to overlap at least once with the pulse of a turn-on level (low level) of the emission clock signal ECK1 supplied to the second input terminal 102. To this end, the emission stop signal ELM may be supplied for a wider width than the emission clock signal ECK1, for example, for 4 horizontal periods 4H. In addition, the pulse of the turn-off level (high level) of an emission signal E1 supplied to the first input terminal 101 of the emission stage EST12 may overlap at least once with the pulse of the turn-on level (low level) of the emission clock signal ECK2 supplied to the second input terminal 102 of the emission stage EST12.

First, at a time point t1*b*, the emission clock signal ECK1 of the low level may be supplied to the second input terminal 102. That is, the pulse may be generated in the emission clock signal ECK1. Accordingly, the transistor Q7 and the transistor Q9 may be turned on.

When the transistor Q7 is turned on, the first input terminal 101 and the node NE2 may be electrically connected. During the time point t1*b*, the emission stop signal ELM of the high level may not be supplied to the first input terminal 101, and accordingly, a voltage VNE2 of the node NE2 may be set to the low level.

When the voltage of the low level is supplied to the node NE2, the transistor Q8, the transistor Q11, and the transistor Q12 may be turned on.

When the transistor Q12 is turned on, the voltage of the first emission power source line VDDL may be supplied so that a voltage VNE1 of the node NE1 may be set to the high level. Accordingly, the transistor Q10 may be turned off.

When the transistor Q11 is turned on, the voltage of the second emission power source line VSSL may be supplied to the output terminal 104. Accordingly, at the time point t1*b*, the emission signal E1 of the turn-on level (low level) may be supplied to the emission line ELL When the transistor Q8 is turned on, the emission clock signal ECK1 may be supplied to the node NE5.

Meanwhile, when the transistor Q9 is turned on, the voltage of the second emission power source line VSSL may be supplied to the node NE5. Here, the emission clock signal ECK1 may have the low level, and accordingly, a voltage VNE5 of the node NE5 may be set to the low level. Accordingly, the transistor Q3 and the transistor Q6 may be turned on.

When the transistor Q6 is turned on, the emission clock signal ECK2 of the high level may be supplied from the third input terminal 103 to the second electrode of the capacitor CE2. In this case, since the transistor Q5 is in the turned-off state, the node NE1 may be maintained at the voltage of the first emission power source line VDDL regardless of voltages of the node NE5 and the second electrode of the capacitor CE2.

When the transistor Q3 is turned on, the voltage of the first emission power source line VDDL may be supplied to the transistor Q4. In this case, the transistor Q4 may be in the turned-off state, and accordingly, the node NE2 may be maintained at the low level.

At a time point t2*b*, the emission clock signal ECK1 of the high level may be supplied to the second input terminal 102. Accordingly, the transistor Q7 and the transistor Q9 may be turned off. In this case, the node NE2 and the node NE1 may be maintained at a previous voltage by the capacitor CE1 and the capacitor CE3, and the transistor Q8, the transistor Q11, and the transistor Q12 may be maintained in the turned-on state.

When the transistor Q8 is turned on, the emission clock signal ECK1 of the high level may be supplied from the second input terminal 102 to the node NE5. Accordingly, the transistor Q3 and the transistor Q6 may be set in the turned-off state.

At a time point t3*b*, the emission clock signal ECK2 of the low level may be supplied to the third input terminal 103. That is, the pulse may be generated in the emission clock signal ECK2. Accordingly, the transistor Q4 and the transistor Q5 may be turned on.

When the transistor Q5 is turned on, the second electrode of the capacitor CE2 and the node NE1 may be electrically connected. In this case, since the transistor Q12 is in the turned-on state, the node NE1 may be maintained at the voltage of the first emission power source line VDDL.

When the transistor Q4 is turned on, a second electrode of the transistor Q3 and the node NE2 may be electrically connected. At this time, since the transistor Q3 is in the turned-off state, the voltage of the first emission power source line VDDL may not be supplied to the node NE2.

When the emission clock signal ECK2 of the low level is supplied to the third input terminal 103, the voltage of the node NE2 may be reduced to be lower than the voltage of the second emission power line VSSL by coupling of the capacitor CE1. Accordingly, voltages of gate electrodes of the transistor Q11 and the transistor Q12 may be lowered than the voltage of the second emission power source line VSSL, so that driving characteristics of the transistors may be improved.

At a time point t4*b*, the emission stop signal ELM of the turn-off level (high level) may be supplied to the first input terminal 101, and the emission clock signal ECK1 of the low level may be supplied to the second input terminal 102. That is, the pulse may be generated in the emission clock signal ECK1. Accordingly, the transistor Q7 and the transistor Q9 may be turned on.

When the transistor Q7 is turned on, the first input terminal 101 and the node NE2 may be electrically connected. Accordingly, the node NE2 may be charged with the voltage of the high level, and the transistor Q8, the transistor Q11, and the transistor Q12 may be turned off.

When the transistor Q9 is turned on, the voltage of the second emission power source line VSSL may be supplied to the node NE5, and the transistor Q3 and the transistor Q6 may be turned on. In this case, even when the transistor Q3 is turned on, the voltage of the node NE2 may be maintained because the transistor Q4 is in the turned-off state.

When the transistor Q6 is turned on, the second terminal of the capacitor CE2 and the third input terminal 103 may be electrically connected. In this case, the node NE1 may be maintained at the high level because the transistor Q5 is in the turned-off state.

At a time point t5*b*, the emission clock signal ECK2 of the low level may be supplied to the third input terminal 103. That is, the pulse may be generated in the emission clock signal ECK2. Accordingly, the transistor Q4 and the transistor Q5 may be turned on. In this case, since the node NE5 is charged with the voltage of the second emission power source line VSSL, the transistor Q3 and the transistor Q6 may be turned on.

Through the turned-on transistors Q5 and Q6, the emission clock signal ECK2 of the low level may be applied to the node NE1, and the transistor Q10 may be turned on. When the transistor Q10 is turned on, the voltage of the first emission power source line VDDL may be supplied to the output terminal 104 as the emission signal E1. Accordingly, the emission signal E1 of the turn-off level (high level) may be supplied to the emission line EL1.

When the transistor Q3 and the transistor Q4 are turned on, the voltage of the first emission power source line VDDL may be supplied to the node NE2. Accordingly, the transistor Q8 and the transistor Q11 may be stably maintained in the turned-off state.

Meanwhile, when the emission clock signal ECK2 of the low level is supplied to the second electrode of the capacitor CE2, the voltage of the node NE5 may be reduced to be lower than the voltage of the second emission power source line VSSL by coupling of the capacitor CE2. Accordingly, a voltage applied to the gate electrode of the transistor Q6 may be lowered than the voltage of the second emission power source line VSSL, and driving characteristics of the transistor Q6 may be improved.

At a time point t6*b*, the emission clock signal ECK1 of the low level may be supplied to the second input terminal 102. That is, the pulse may be generated in the emission clock signal ECK1. Accordingly, the transistor Q7 and the transistor Q9 may be turned on.

When the transistor Q7 is turned on, the node NE2 may be electrically connected to the first input terminal 101, and accordingly, the voltage of the low level may be supplied from the first input terminal 101 to the node NE2. Accordingly, the transistor Q8, the transistor Q11, and the transistor Q12 may be turned on.

When the transistor Q8 is turned on, the emission clock signal ECK1 of the low level may be supplied to the node NE5.

When the transistor Q12 is turned on, the voltage of the first emission power source line VDDL may be supplied to the node NE1, and the transistor Q10 may be turned off.

When the transistor Q11 is turned on, the voltage of the second emission power source line VSSL may be supplied to the output terminal 104. Accordingly, the emission signal E1 of the turn-on level (low level) may be supplied to the emission line EL1.

Meanwhile, the emission stage EST12 receiving the emission signal E1 of the turn-off level from the output terminal 104 of the emission stage EST11 may also supply the emission signal E2 of the turn-off level to the emission line EL2 while repeating the above-described processes. That is, the emission stages EST11 to EST14 according to the embodiments of the present disclosure may supply the emission signals to the emission lines EL1, EL2, EL3, and EL4 while repeating the above-described processes.

FIGS. 10, 11, 12, 13, and 14 are diagrams for explaining a first frame period and a second frame period according to an embodiment of the present disclosure.

Figure 10:
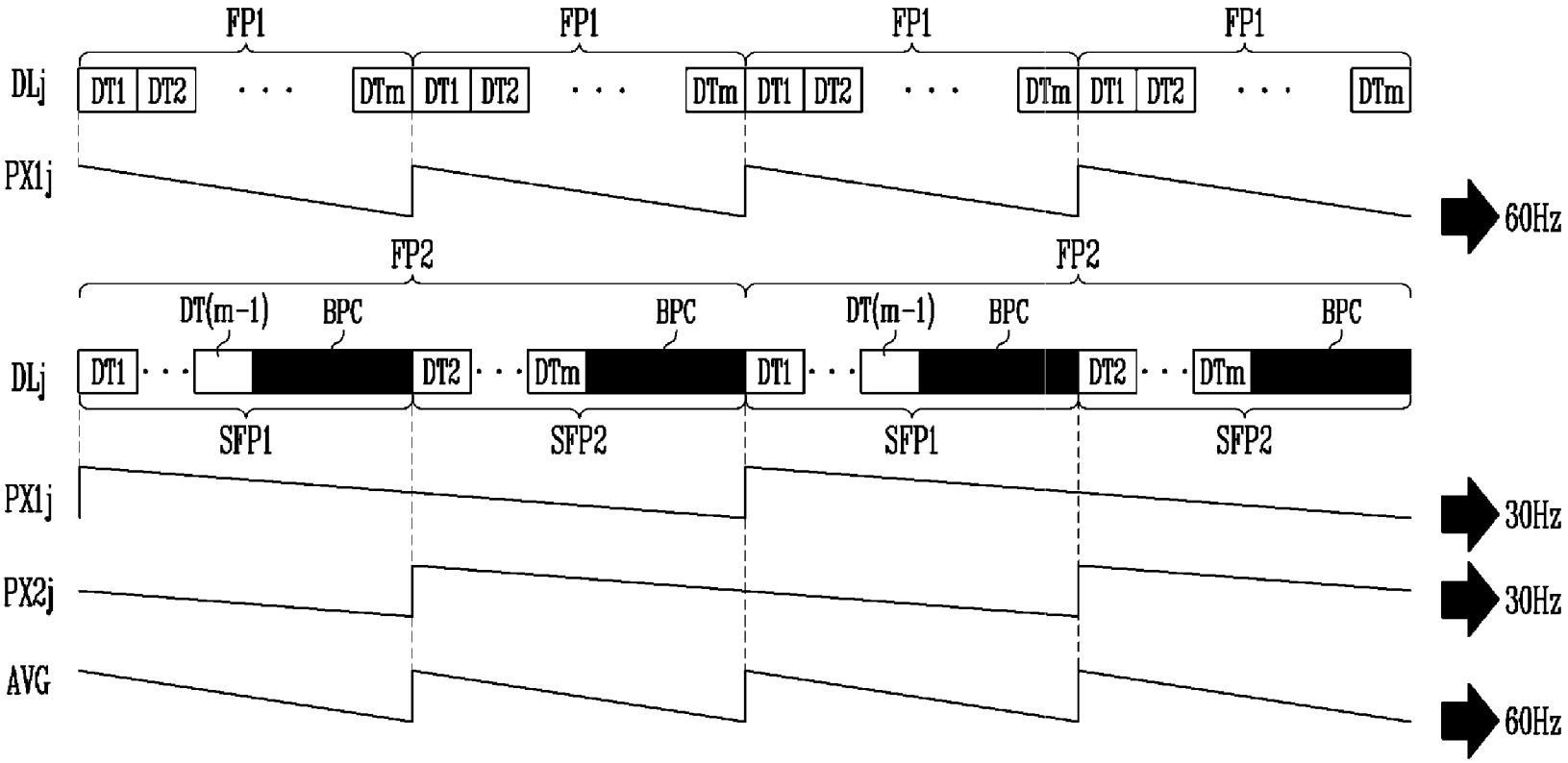

The display device 10 may operate in a first display mode including a plurality of first frame periods FP1 or a second display mode including a plurality of second frame periods FP2. A second frame period FP2 may be longer than a first frame period FP1. For example, the second frame period FP2 may be an integer multiple of the first frame period FP1. For example, the second frame period FP2 may be 2p times the first frame period FP1, where p may be an integer greater than 0. In the embodiment of FIG. 10, the second frame period FP2 may be twice the first frame period FP1.

The first display mode may be suitable for displaying a moving image by displaying input images (frames) at a high frequency. The second display mode may be suitable for displaying a still image by displaying the input images at a low frequency. When the still image is detected while displaying the moving image, the display device 10 may switch from the first display mode to the second display mode. Also, when the moving image is detected while displaying the still image, the display device 10 may switch from the second display mode to the first display mode. The first display mode and the second display mode may be selected by different algorithms or may be selected by a user.

Referring to FIG. 10, for convenience of description, the description will be made based on a j-th data line DLj and pixels PX1*j* and PX2*j*. A first pixel PX1*j* may be connected to the j-th data line and the first scan line SL1. The first pixel PX1*j* may belong to the first pixel row. A second pixel PX2*j* may be connected to the j-th data line and the second scan line SL2. The second pixel PX2*j* may belong to the second pixel row.

In each first frame period FP1, the data driver 12 may sequentially apply the data voltages corresponding to the first pixel rows and the second pixel rows to the data lines. For example, the data driver 12 may sequentially apply data voltages DT1, DT2, . . . , DT(m−1), and DTm to the j-th data line DLj. Assuming that the first frame period FP1 is 1/60 second, a first data voltage DT1 may be supplied to the first pixel PX1*j* at 60 Hz. The first pixel PX1*j* may emit light with the highest luminance when the first data voltage DT1 is applied, but the luminance may gradually decrease due to a leakage current. Referring to FIG. 10, a luminance waveform of the first pixel PX1*j* corresponding to a plurality of first frame periods FP1 is shown as an example.

Each second frame period FP2 may include a first sub-frame period SFP1 and a second sub-frame period SFP2. Lengths of the first sub-frame period SFP1 and the second sub-frame period SFP2 may be the same. For example, assuming that the second frame period FP2 is 1/30 second, each of the first sub-frame period SFP1 and the second sub-frame period SFP2 may be 1/60 second.

In each first sub-frame period SFP1, the data driver 12 may sequentially apply the data voltages corresponding to the first pixel rows to the data lines. For example, the data driver 12 may sequentially apply the data voltages DT1, DT3, . . . , and DT(m−1) to the j-th data line DLj.

A data blank period BPC may be the remaining period after the data driver 12 ends the supply of the data voltages in the first sub-frame period SFP1. During the data blank period BPC, all or at least part of the data driver 12 (for example, gamma amp, digital logic, and the like) may be powered off to reduce power consumption.

In each second sub-frame period SFP2, the data driver 12 may sequentially apply the data voltages corresponding to the second pixel rows to the data lines. For example, the data driver 12 may sequentially apply the data voltages DT2, DT4, . . . , and DTm to the j-th data line DLj. Similarly, the remaining period after the data driver 12 ends the supply of the data voltages may correspond to the data blank period BPC.

Accordingly, the first data voltage DT1 may be supplied to the first pixel PX1*j* at 30 Hz. The first pixel PX1*j* may emit light with the highest luminance when the first data voltage DT1 is applied, but the luminance may gradually decrease due to the leakage current. Referring to FIG. 10, a luminance waveform of the first pixel PX1*j* corresponding to a plurality of second frame periods FP2 is shown as an example. In addition, a second data voltage DT2 may be applied to the second pixel PX2*j* at 30 Hz. The second pixel PX2*j* may emit light with the highest luminance when the second data voltage DT2 is applied, but the luminance may gradually decrease due to the leakage current. Referring to FIG. 10, a luminance waveform of the second pixel PX2*j* corresponding to a plurality of second frame periods FP2 is shown as an example.

In this case, since the first pixel PX1*j* and the second pixel PX2*j* are located adjacent to each other, the first data voltage DT1 and the second data voltage DT2 may be the same or similar. Since a time point at which the first pixel PX1*j* has the highest luminance and a time point at which the second pixel PX2*j* has the highest luminance are alternately positioned, the user may visually recognize an average luminance waveform AVG of the first pixel PX1*j* and the second pixel PX2*j* as 60 Hz. Accordingly, even if the first display mode and the second display mode are switched to each other, visibility of flicker due to a difference in luminance waveform can be prevented.

Figure 11:
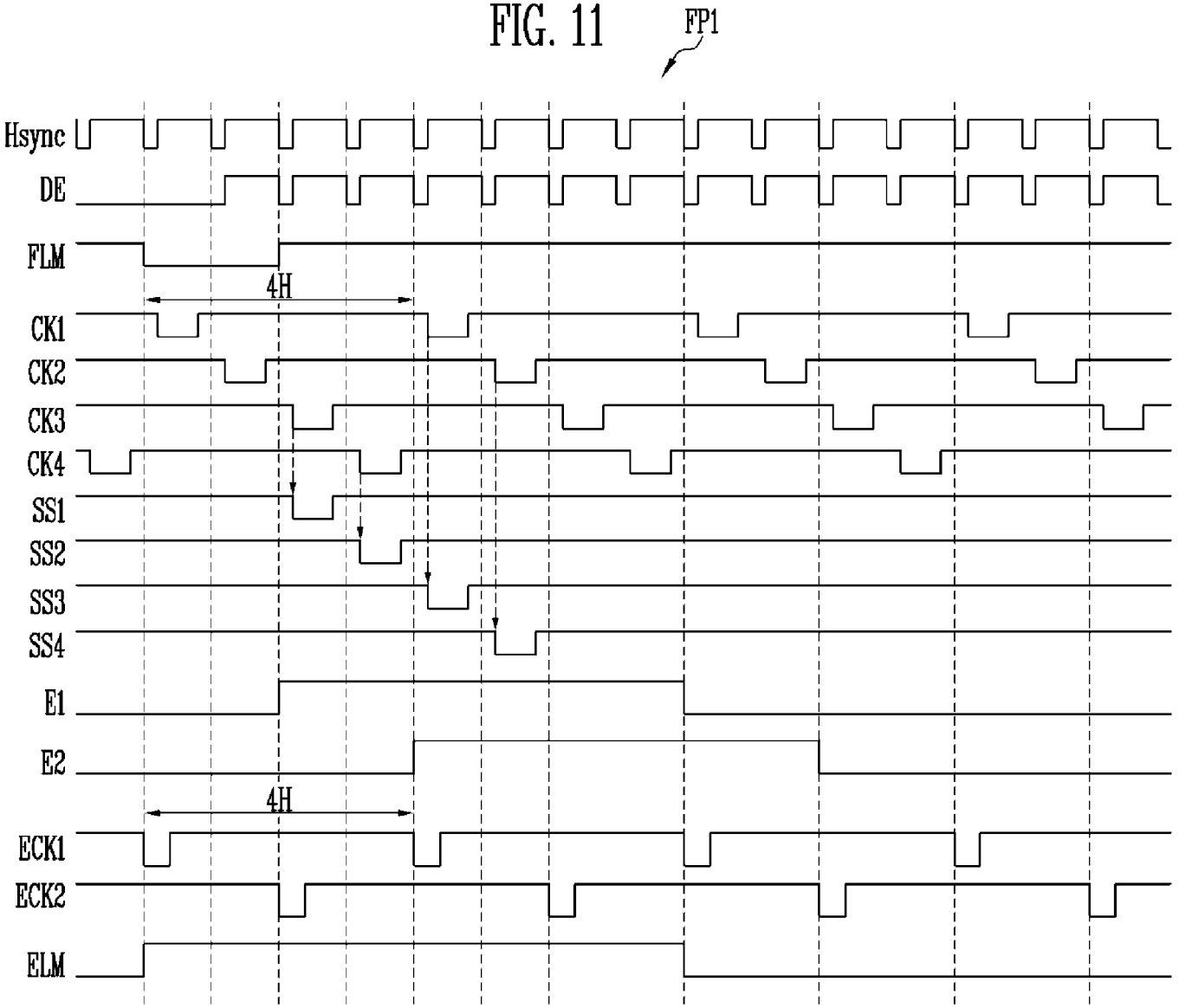

Referring to FIG. 11, the control signals in the first frame period FP1 are shown as an example.

During the first frame period FP1, the timing controller 11 may apply first scan clock signals CK1 and CK3 of a turn-on level to the first scan clock lines CKL1 and CKL3, and may apply second scan clock signals CK2 and CK4 of the turn-on level to the second scan clock lines CKL2 and CKL4. The first scan clock signals CK1 and CK3 and the second scan clock signals CK2 and CK4 may have different phases. For example, the scan clock signals CK1, CK2, CK3, and CK4 of the turn-on level may be sequentially supplied in the order of a first scan clock line CKL1, a second scan clock line CKL2, a first scan clock line CKL3, and a second scan clock line CKL4. For example, a cycle of each of the scan clock signals CK1, CK2, CK3, and CK4 of the turn-on level may be 4 horizontal periods.

Also, the timing controller 11 may apply the scan start signal FLM of a turn-on level to the scan start line FLML. In this case, a length of the scan start signal FLM of the turn-on level may be set to overlap the first scan clock signal CK1 of the turn-on level and a second scan clock signal CK2 of the turn-on level. For example, the length of the scan start signal FLM of the turn-on level may be 2 horizontal periods.

During the first frame period FP1, the scan driver 13*a* may alternately apply scan signals SS1, SS2, SS3, SS4, . . . of the turn-on level to the first scan lines SL1, SL3, . . . and the second scan lines SL2, SL4, . . . .

Referring to the driving method of FIG. 11, the first scan signal SS1 of the turn-on level may be generated in response to the first scan clock signal CK3 of the turn-on level. In addition, a second scan signal SS2 of the turn-on level may be generated in response to a second scan clock signal CK4 of the turn-on level. Similarly, the first scan signal SS3 of the turn-on level may be generated in response to the first scan clock signal CK1 of the turn-on level. In addition, a second scan signal SS4 of the turn-on level may be generated in response to the second scan clock signal CK2 of the turn-on level.

The data driver 12 may supply the data voltages so as to be synchronized with each of the scan signals SS1, SS2, SS3, SS4, . . . of the turn-on level. For example, the data driver 12 may supply the data voltages in a current horizontal period in response to grayscales latched by a data enable signal DE of a logic high level of a previous horizontal period.

During the first frame period FP1, the timing controller 11 may apply emission clock signals ECK1 and ECK2 of the turn-on level to the emission clock lines ECKL1 and ECKL2. The emission clock signals ECK1 and ECK2 may have different phases. For example, the emission clock signals ECK1 and ECK2 of the turn-on level may be sequentially supplied in the order of the emission clock line ECKL1 and the emission clock line ECKL2. For example, a cycle of each of the emission clock signals ECK1 and ECK2 of the turn-on level may be 4 horizontal periods.

Also, the timing controller 11 may apply the emission stop signal ELM of the turn-off level to the emission stop line ELML. In this case, a length of the emission stop signal ELM of the turn-off level may be 8 horizontal periods.

During the first frame period FP1, the emission driver 14*a* sequentially applies emission signals E1, E2, . . . of the turn-off level to the emission lines ELL EL2, . . . . Compared with the driving method of FIG. 9, since a cycle of the emission clock signals ECK1 and ECK2 is 4 horizontal periods, which is double, a cycle in which the emission signals E1, E2, . . . of the turn-off level are supplied may also be 2 horizontal periods, which may be double. Other operation processes may be the same as the driving method of FIG. 9, and thus duplicate descriptions will be omitted.

During the first frame period FP1, cycles of the first scan clock signals CK1 and CK3 applied to the first scan clock lines CKL1 and CKL3, cycles of the second scan clock signals CK2 and CK4 applied to the second scan clock lines CKL2 and CKL4, and cycles of the emission clock signals ECK1 and ECK2 applied to the emission clock lines ECKL1 and ECKL2 may have a first time interval. For example, in the case of FIG. 11, the first time interval may be 4 horizontal periods.

Figure 12:
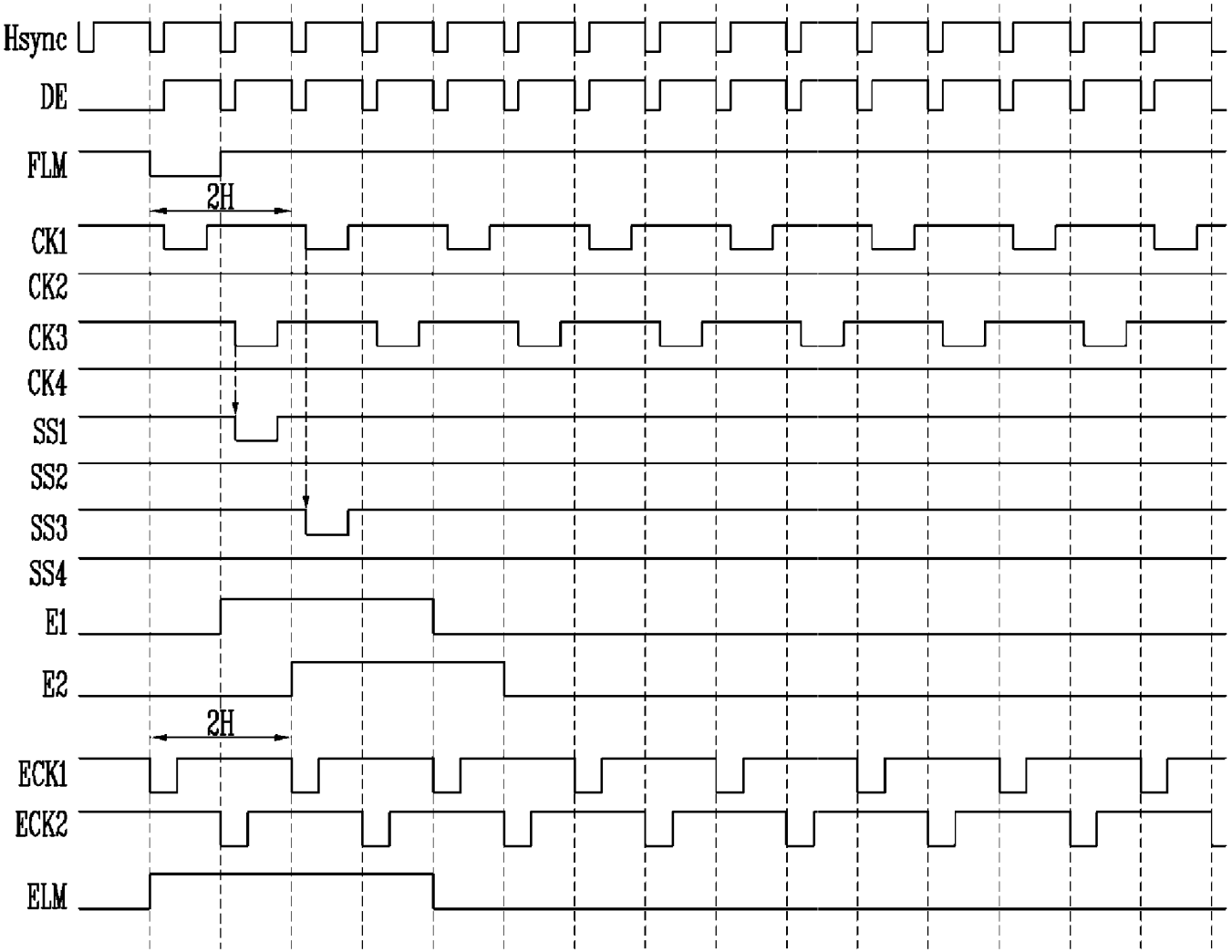

Referring to FIG. 12, the control signals in the first sub-frame period SFP1 of the second frame period FP2 are shown as an example. Specifically, FIG. 12 shows the control signals in a period other than the data blank period BPC among the first sub-frame period SFP1.

During the first sub-frame period SFP1, the timing controller 11 may apply the first scan clock signals CK1 and CK3 of the turn-on-level to the first scan clock lines CKL1 and CKL3, and may maintain the second scan clock signals CK2 and CK4 of the turn-off level in the second scan clock lines CKL2 and CKL4. In the present embodiment, a cycle in which the first scan clock signals CK1 and CK3 of the turn-on level are applied to the first scan clock lines CKL1 and CKL3 in the first sub-frame period SFP1 may be shorter than a cycle in which the first scan clock signals CK1 and CK3 of the turn-on level are applied in the first frame period FP1. For example, a cycle of each of the first scan clock signals CK1 and CK3 of the turn-on level may be 2 horizontal cycles 2H.

The timing controller 11 may apply the scan start signal FLM of the turn-on level to the scan start line FLML. In this case, the length of the scan start signal FLM of the turn-on level may be set to overlap the first scan clock signal CK1 of the turn-on level. For example, the length of the scan start signal FLM of the turn-on level may be set to one horizontal cycle.

During the first sub-frame period SFP1, the scan driver 13 may apply the first scan signals SS1, SS3, . . . of the turn-on level to the first scan lines SL1, SL3, . . . , and may maintain the second scan signals SS2, SS4, . . . of the turn-off level in the second scan lines SL2, SL4, . . . . A cycle in which the first scan signals SS1, SS3, . . . of the turn-on-level are applied to the first scan lines SL1, SL3, . . . in the first sub-frame period SFP1 may be shorter than a cycle in which the first scan signals SS1, SS3, . . . of the turn-on level are applied in the frame period FP1.

The data driver 12 may supply the data voltages so as to be synchronized with each of the first scan signals SS1, SS3, . . . of the turn-on level.

During the first sub-frame period SFP1, the timing controller 11 may apply the emission clock signals ECK1 and ECK2 of the turn-on-level to the emission clock lines ECKL1 and ECKL2. The emission clock signals ECK1 and ECK2 may have different phases. For example, the emission clock signals ECK1 and ECK2 of the turn-on level may be sequentially supplied in the order of the emission clock line ECKL1 and the emission clock line ECKL2. For example, the cycle of each of the emission clock signals ECK1 and ECK2 of the turn-on level may be two horizontal periods.

Also, the timing controller 11 may apply the emission stop signal ELM of the turn-off level to the emission stop line ELML. In this case, the length of the emission stop signal ELM of the turn-off level may be 4 horizontal periods 4H.

During the first sub-frame period SFP1, the emission driver 14*a* may sequentially apply the emission signals E1, E2, . . . of the turn-off level to the emission lines ELL EL2, . . . . Since the driving method of the emission driver 14*a* during the first sub-frame period SFP1 may be the same as the driving method of FIG. 9, duplicate descriptions will be omitted.

During the first sub-frame period SFP1 of the second frame period FP2, the cycles of the first scan clock signals CK1 and CK3 and the cycles of the emission clock signals ECK1 and ECK2 may have a second time interval smaller than the first time interval. For example, in FIG. 11, the first time interval may be 4 horizontal cycles, and in FIG. 12, the second time interval may be 2 horizontal cycles. During the first sub-frame period SFP1, the second scan clock signals CK2 and CK4 may be maintained at a constant voltage level.

Figure 13:
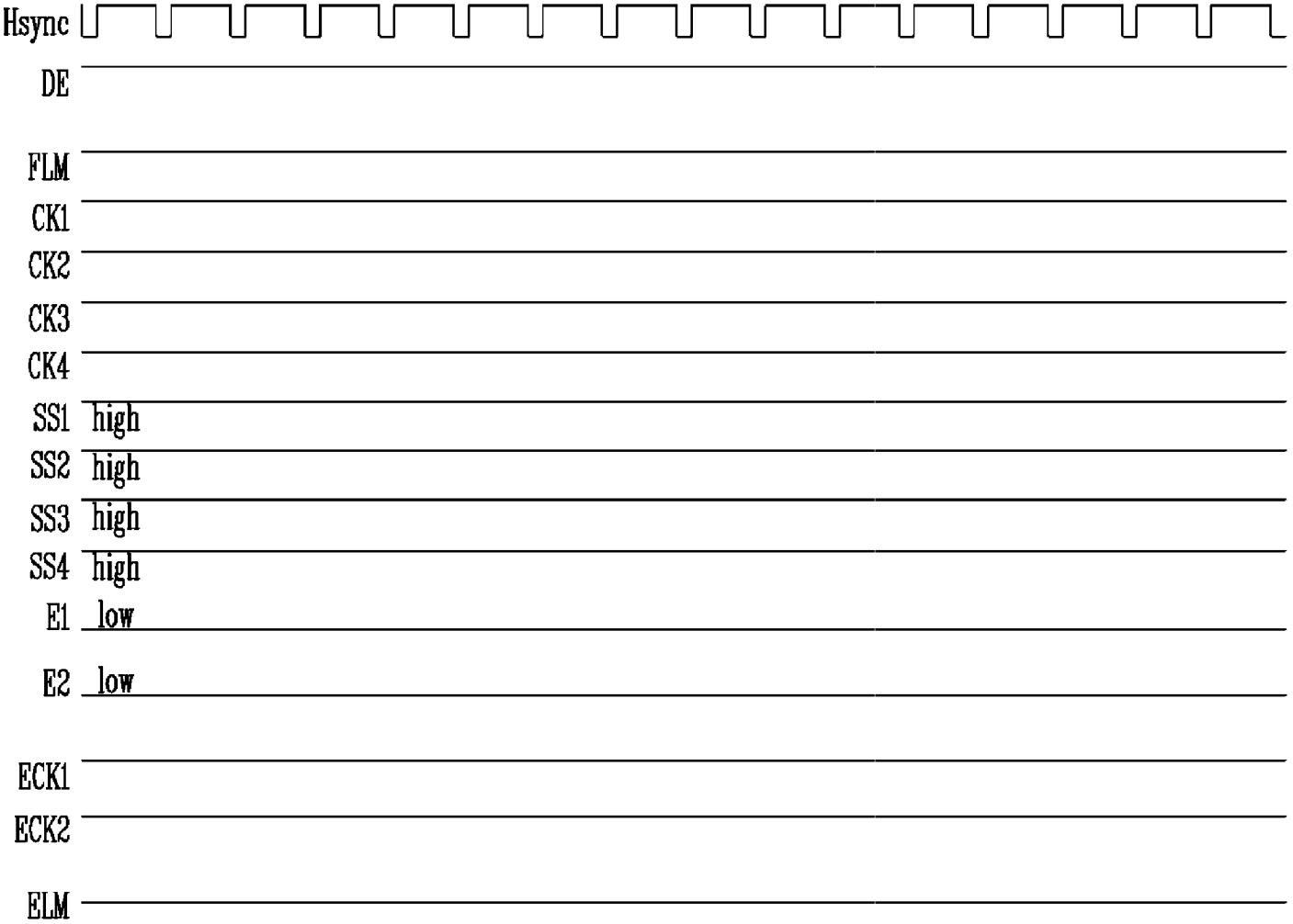

Referring to FIG. 13, the control signals in the data blank period BPC of the second frame period FP2 are shown as an example. In the data blank period BPC, the scan clock signals CK1, CK2, CK3, and CK4 of the turn-off level, the scan signals SS1, SS2, SS3, and SS4, . . . of the turn-off level, and the scan start signal FLM of the turn-off level may be maintained. In addition, in the data blank period BPC, the emission clock signals ECK1 and ECK2 of the turn-off level, the emission signals E1, E2, . . . of a turn-on level, and the emission stop signal ELM of a turn-on level may be maintained.

As described above, during the data blank period BPC, all or at least part of the data driver 12 may be powered off to reduce power consumption.

Figure 14:
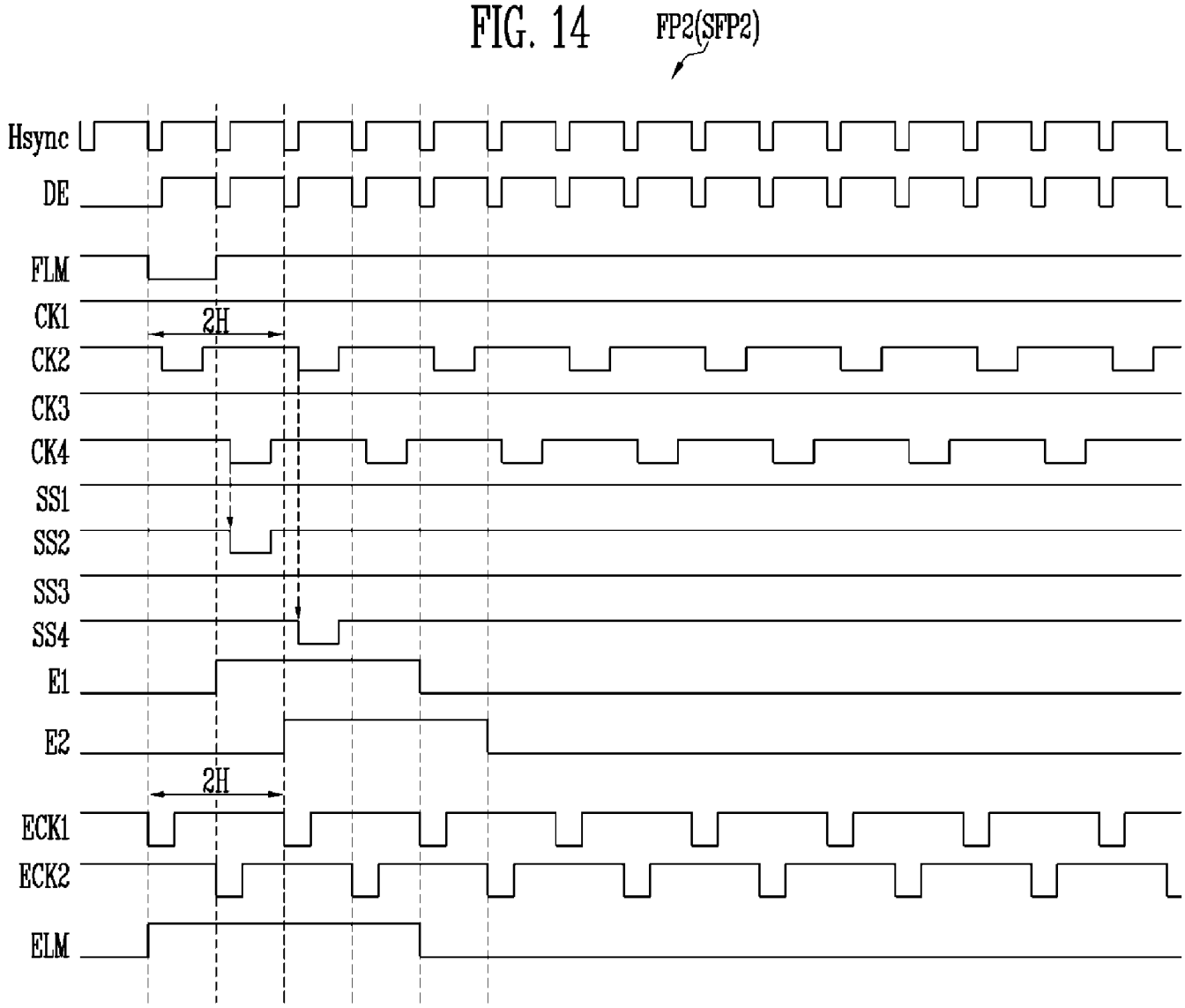

Referring to FIG. 14, the control signals in the second sub-frame period SFP2 of the second frame period FP2 are shown as an example. Specifically, FIG. 14 shows the control signals in a period other than the data blank period BPC among the second sub-frame period SFP2.

During the second sub-frame period SFP2, the second scan clock signals CK2 and CK4 of the turn-on level may be applied to the second scan clock lines CKL2 and CKL4, and the first scan clock signals CK1 and CK3 of the turn-off level may be maintained in the first scan clock lines CKL1 and CKL3. A cycle in which the second scan clock signals CK2 and CK4 of the turn-on level are applied to the second scan clock lines CKL2 and CKL4 in the second sub-frame period SFP2 may be shorter than a cycle in which the second scan clock signals CK2 and CK4 of the turn-on level are applied in the first frame period FP1. For example, a cycle of each of the second scan clock signals CK2 and CK4 of the turn-on level may be 2 horizontal cycles 2H.

Also, the timing controller 11 may apply the scan start signal FLM of the turn-on level to the scan start line FLML. In this case, the length of the scan start signal FLM of the turn-on level may be set to overlap the second scan clock signal CK2 of the turn-on level. For example, the length of the scan start signal FLM of the turn-on level may be set to one horizontal cycle.

During the second sub-frame period SFP2, the scan driver 13 may apply the second scan signals SS2, SS4, . . . of the turn-on level to the second scan lines SL2, SL4, . . . , and may maintain the first scan signals SS1, SS3, . . . of the turn-off level in the first scan lines SL1, SL3, . . . . A cycle in which the second scan signals SS2, SS4, . . . of the turn-on level are applied to the second scan lines SL2, SL4, . . . in the second sub-frame period SFP2 may be shorter than a cycle in which the second scan signals SS2, SS4, . . . of the turn-on level are applied in the frame period FP1.

The data driver 12 may supply the data voltages so as to be synchronized with each of the second scan signals SS2, SS4, . . . of the turn-on level.

During the second sub-frame period SFP2, the timing controller 11 may apply the emission clock signals ECK1 and ECK2 of the turn-on-level to the emission clock lines ECKL1 and ECKL2. The emission clock signals ECK1 and ECK2 may have different phases. For example, the emission clock signals ECK1 and ECK2 of the turn-on level may be sequentially supplied in the order of the emission clock line ECKL1 and the emission clock line ECKL2. For example, the cycle of each of the emission clock signals ECK1 and ECK2 of the turn-on level may be two horizontal periods.

Also, the timing controller 11 may apply the emission stop signal ELM of the turn-off level to the emission stop line ELML. In this case, the length of the emission stop signal ELM of the turn-off level may be 4 horizontal periods.

During the second sub-frame period SFP2, the emission driver 14*a* may sequentially apply the emission signals E1, E2, . . . of the turn-off level to the emission lines ELL EL2, . . . . Since the driving method of the emission driver 14*a* during the second sub-frame period SFP2 may be the same as the driving method of FIG. 9, duplicate descriptions will be omitted.

During the second sub-frame period SFP2 of the second frame period FP2, the cycles of the second scan clock signals CK2 and CK4 and the cycles of the emission clock signals ECK1 and ECK2 may have the second time interval. For example, in FIG. 14, the second time interval may be 2 horizontal periods. During the second sub-frame period SFP2, the first scan clock signals CK1 and CK3 may be maintained at a constant voltage level.

FIGS. 15, 16, 17, 18, and 19 are diagrams for explaining a scan driver, a pixel unit, and an emission driver according to a second embodiment of the present disclosure.

Figure 15:
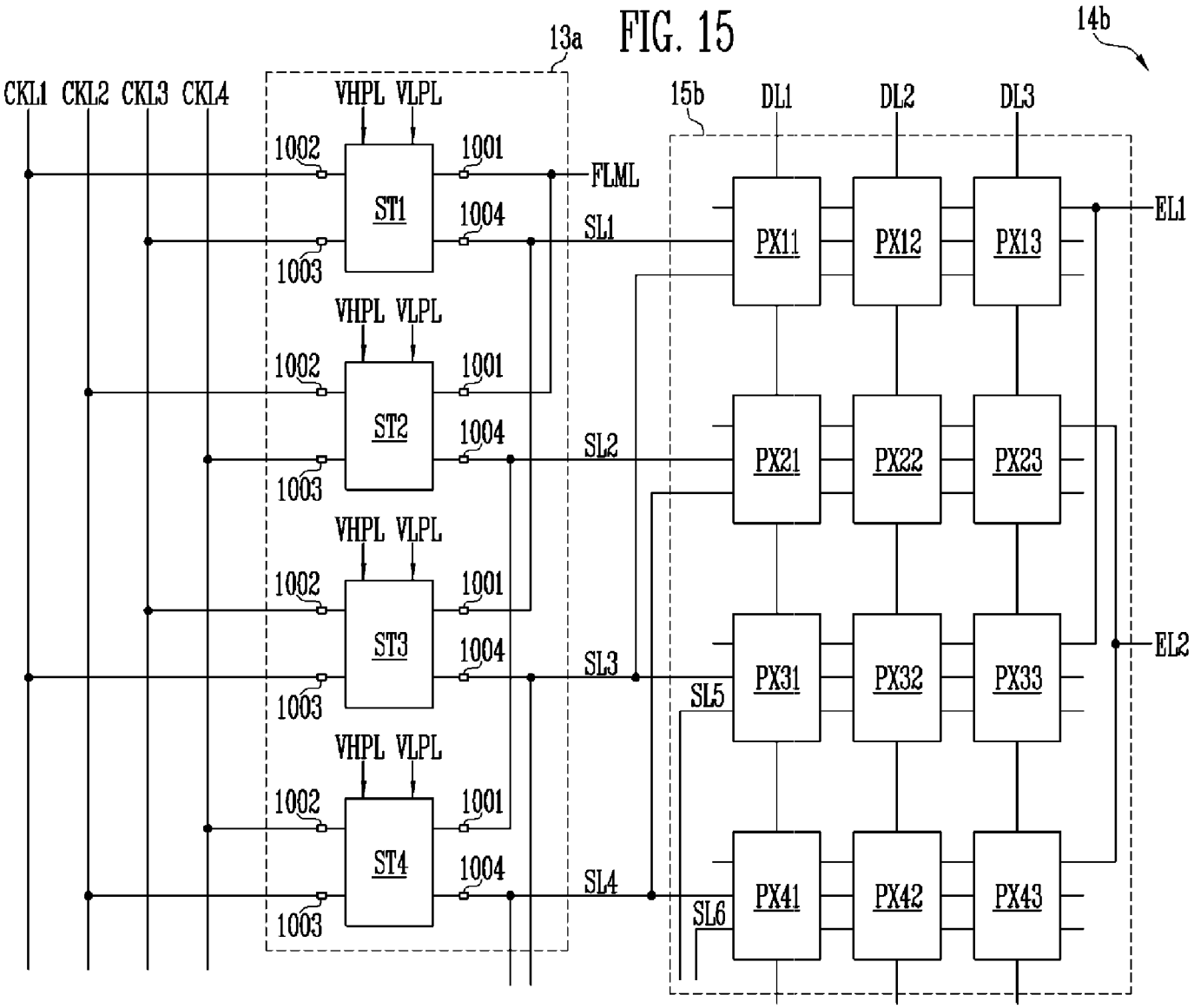
FIGS. 15, 16, 17, 18, and 19 are diagrams for explaining a scan driver, a pixel unit, and an emission driver according to a second embodiment of the present disclosure.

Referring to FIG. 15, a connection relationship between a scan driver 13*a*, a pixel unit 15*b*, and an emission driver 14*b* according to the second embodiment is shown.

Since a connection relationship between the scan driver 13*a* and the pixel unit 15*b* may be the same as in the first embodiment of FIG. 4, duplicate descriptions will be omitted.

The emission driver 14*b* may include the emission stages in which the emission lines ELL EL2, . . . are connected to two or more pixel rows. For example, each of first emission lines of first emission stages among the emission stages may be connected to adjacent first pixel rows, and each of second emission lines of second emission stages among the emission stages may be connected to adjacent second pixel rows. For example, a first emission line EL1 of a first emission stage may be connected to the adjacent first pixel row PX11, PX12, PX13, . . . and the adjacent first pixel row PX31, PX32, PX33, . . . . Meanwhile, a second emission line EL2 of a second emission stage may be connected to the adjacent second pixel row PX21, PX22, PX23, . . . and the adjacent second pixel row PX41, PX42, PX43, . . . .

Figure 16:
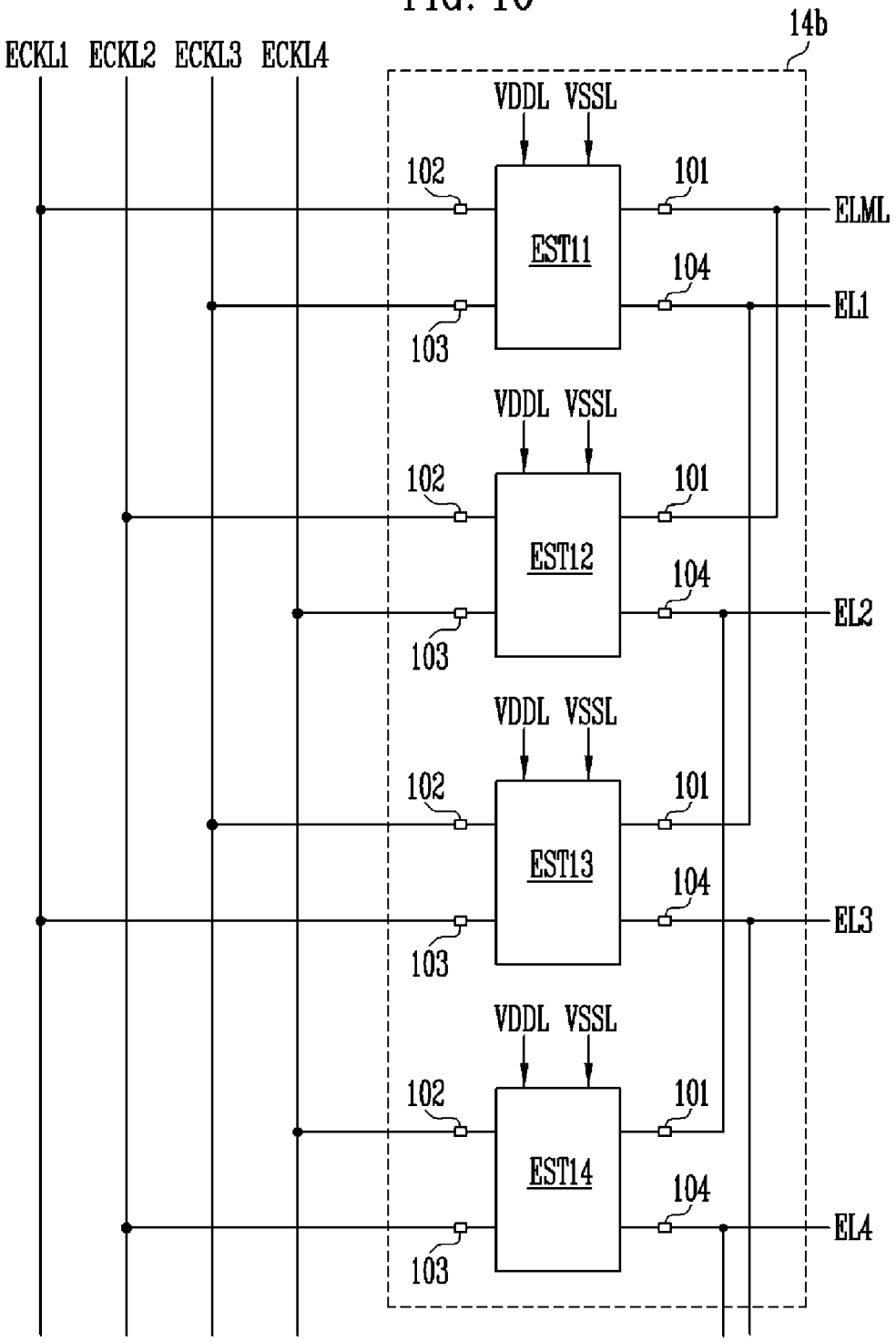

Referring to FIG. 16, a configuration of the emission driver 14*b* is shown as an example.

The emission driver 14*b* may include first emission stages EST11, EST13, . . . connected to first emission lines ELL EL3, . . . and second emission stages EST12, EST14, . . . connected to second emission lines EL2, EL4, . . . .

For example, the first emission lines ELL EL3, . . . may be odd-numbered emission lines. For example, the first emission stages EST11, EST13, . . . may be odd-numbered emission stages. For example, the second emission lines EL2, EL4, . . . may be even numbered emission lines. For example, the second emission stages EST12, EST14, . . . may be even-numbered emission stages.

Each of the emission stages EST11, EST12, EST13, and EST14 may include a first input terminal 101, a second input terminal 102, a third input terminal 103, and an output terminal 104. One EST11 of the first emission stages EST11, EST13, . . . and one EST12 of the second emission stages EST12, EST14, . . . may be connected to the same emission stop line ELML. For example, the first input terminal 101 of the emission stage EST11 and the first input terminal 101 of the emission stage EST12 may be connected to the same emission stop line ELML. The output terminal 104 of the first emission stage EST11 may be connected to the first emission line ELL and the output terminal 104 of the second emission stage EST12 may be connected to the second emission line EL2.

Each of the first emission stages except for the first emission stage EST11 may be connected to a first emission line of a previous first emission stage. Each of the second emission stages for the second emission stage EST12 may be connected to a second emission line of a previous second emission stage. For example, the first input terminal 101 of the first emission stage EST13 may be connected to the first emission line EL1 of the first emission stage EST11. In addition, the first input terminal 101 of the second emission stage EST14 may be connected to the second emission line EL2 of the second emission stage EST12.

The first emission stages EST11, EST13, . . . may be connected to first emission clock lines ECKL1 and ECKL3. The first emission clock lines ECKL1 and ECKL3 may be alternately connected to second input terminals 102 and third input terminals 103 of the first emission stages EST11, EST13, . . . . The second emission stages EST12, EST14, . . . may be connected to second emission clock lines ECKL2 and ECKL4 different from the first emission clock lines ECKL1 and ECKL3. The second emission clock lines ECKL2 and ECKL4 may be alternately connected to second input terminals 102 and third input terminals 103 of the second emission stages EST12, EST14, . . . .

Each of the emission stages EST11, EST12, EST13, and EST14 may be connected to the first emission power source line VDDL and the second emission power source line VSSL. Here, the voltage of the first emission power source line VDDL may be set to a turn-off level (gate-off voltage, logic high level). In addition, the voltage of the second emission power source line VSSL may be set to a turn-on level (gate-on voltage, logic low level).

Since a configuration and driving method of each of the emission stages EST11, EST12, EST13, and EST14 may be substantially the same as those of FIGS. 8 and 9, duplicate descriptions will be omitted.

Figure 17:
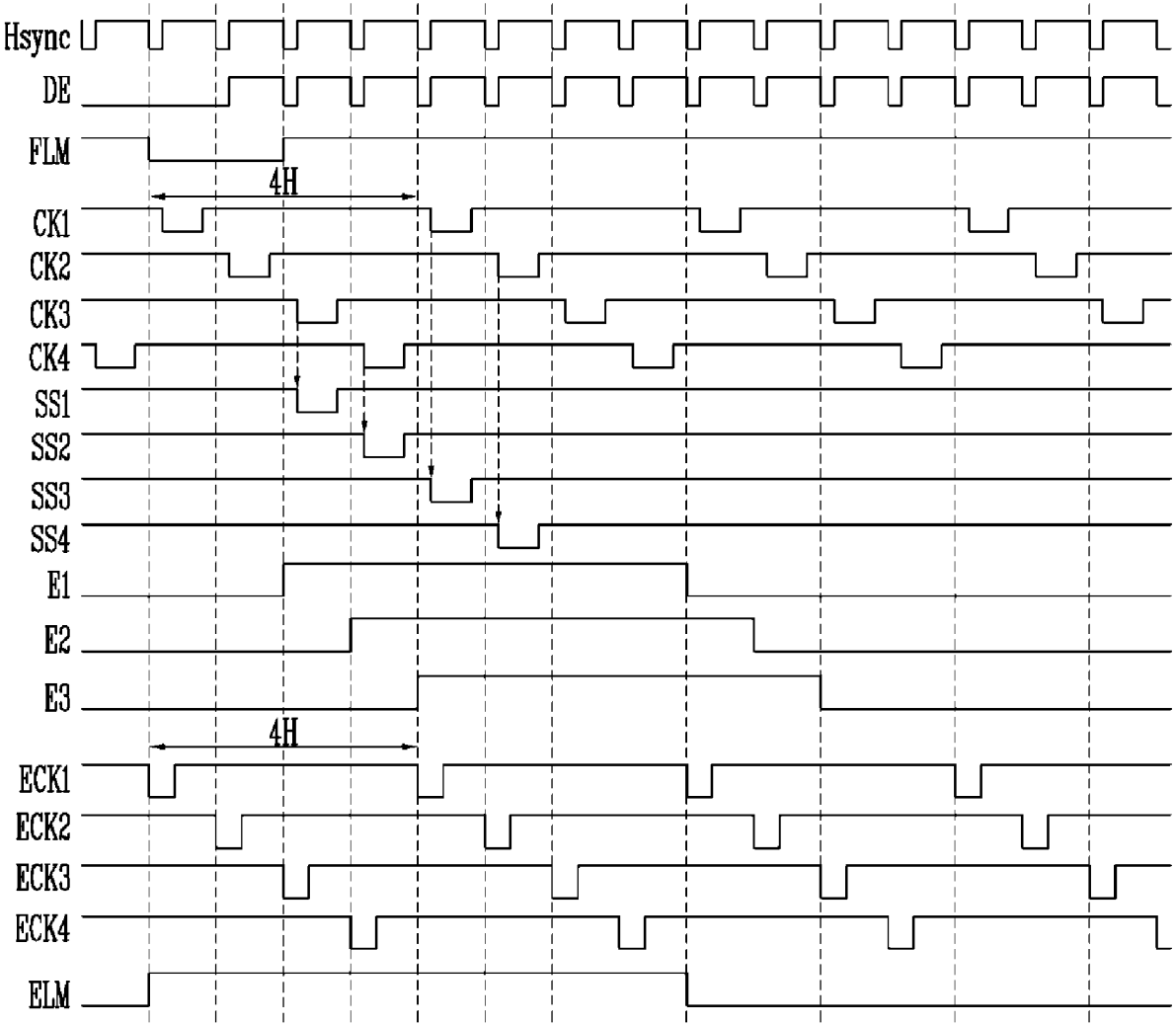

Referring to FIG. 17, the control signals in the first frame period FP1 are shown as an example. Since a driving method of the scan driver 13*a* and the data driver 12 in the first frame period FP1 may be the same as that of FIG. 11, duplicate descriptions will be omitted.

During the first frame period FP1, the timing controller 11 may apply first emission clock signals ECK1 and ECK3 of a turn-on level to the first emission clock lines ECKL1 and ECKL3, and may apply second emission clock signals ECK2 and ECK4 of the turn-on level to the second emission clock lines ECKL2 and ECKL4. The first emission clock signals ECK1 and ECK3 and the second emission clock signals ECK2 and ECK4 may have different phases. For example, emission clock signals ECK1, ECK2, ECK3, and ECK4 of the turn-on level may be sequentially supplied in the order of a first emission clock line ECKL1, a second emission clock line ECKL2, a first emission clock line ECKL3, and a second emission clock line ECKL4. For example, the cycle of each of the emission clock signals ECK1, ECK2, ECK3, and ECK4 of the turn-on level may be 4 horizontal periods.

Also, the timing controller 11 may apply an emission stop signal ELM of the turn-off level to the emission stop line ELML. For example, the length of the emission stop signal ELM of the turn-off level may be 8 horizontal periods.

During the first frame period FP1, the emission driver 14*b* may alternately apply emission signals E1, E2, E3, . . . of the turn-off level to the first emission lines ELL EL3, . . . and the second emission lines EL2, . . . . A driving method of the first emission stages EST11, EST13, . . . of the emission driver 14*b* may correspond to the driving method of the emission driver 14*a* of FIG. 11. In addition, a driving method of the second emission stages EST12, EST14, . . . of the emission driver 14*b* may correspond to the driving method of the emission driver 14*a* of FIG. 11. Therefore, duplicate descriptions will be omitted.

During the first frame period FP1, the cycles of first scan clock signals CK1 and CK3 applied to the first scan clock lines CKL1 and CKL3, the cycles of second scan clock signals CK2 and CK4 applied to second scan clock lines CKL2 and CKL4, the cycles of the first emission clock signals ECK1 and ECK3 applied to the first emission clock lines ECKL1 and ECKL3, and cycles of the second emission clock signals ECK2 and ECK4 applied to the second emission clock lines ECKL2 and ECKL4 may have the first time interval. In FIG. 17, the first time interval may be 4 horizontal cycles 4H.

Figure 18:
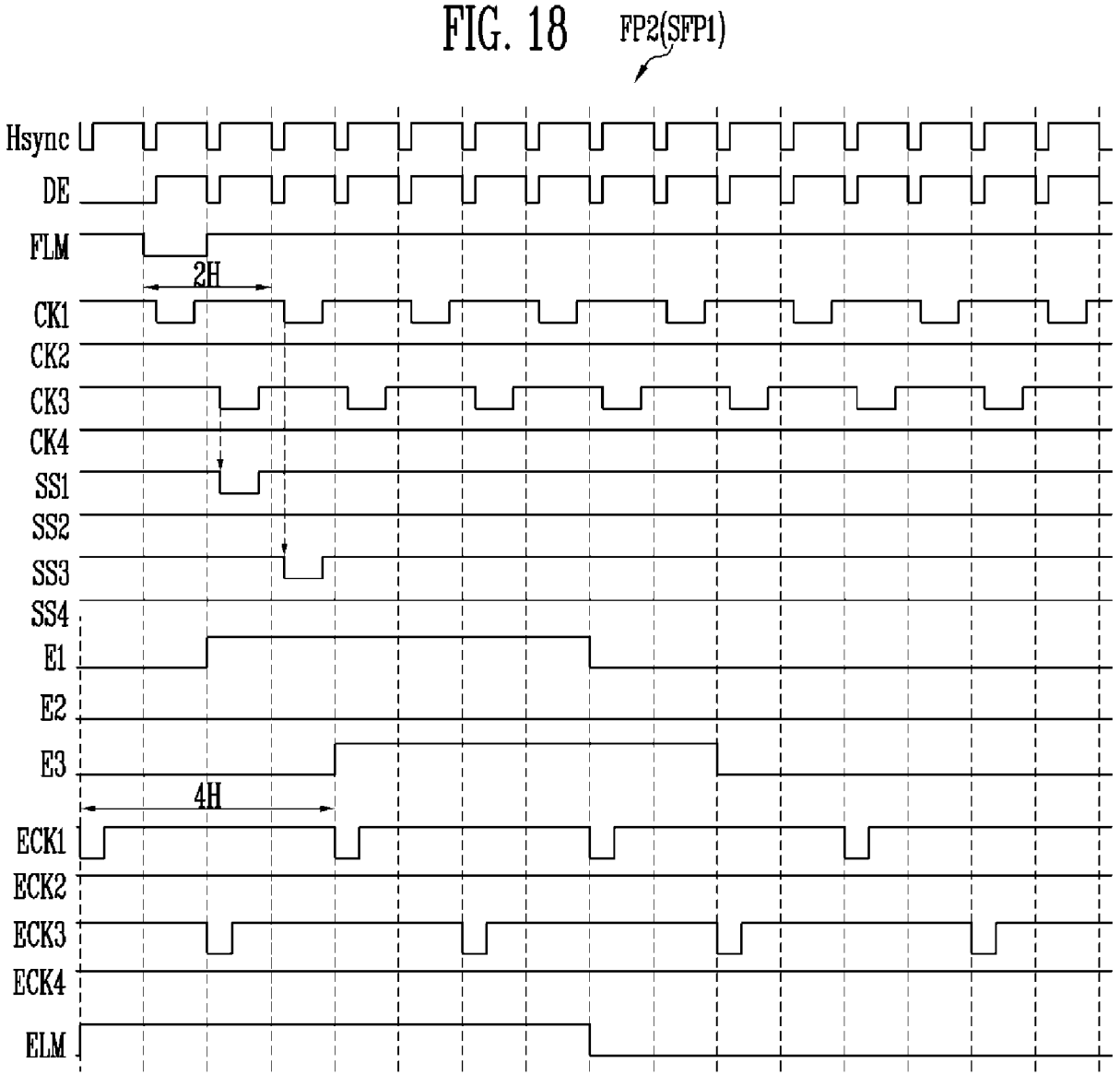

Referring to FIG. 18, the control signals in the first sub-frame period SFP1 of the second frame period FP2 are shown as an example. Specifically, FIG. 18 shows the control signals in a period other than the data blank period BPC among the first sub-frame period SFP1. Since a driving method of the scan driver 13*a* and the data driver 12 in the first sub-frame period SFP1 may be the same as that of FIG. 12, duplicate descriptions will be omitted.

During the first sub-frame period SFP1, the timing controller 11 may apply the first emission clock signals ECK1 and ECK3 of the turn-on level to the first emission clock lines ECKL1 and ECKL3, and may maintain the second emission clock signals ECK2 and ECK4 of the turn-off level in the second emission clock lines ECKL2 and ECKL4. In the present embodiment, a cycle in which the first emission clock signals ECK1 and ECK3 of the turn-on level are applied to the first emission clock lines ECKL1 and ECKL3 in the first sub-frame period SFP1 may be the same as a cycle in which the first emission clock signals ECK1 and ECK3 of the turn-on level are applied in the first frame period FP1. For example, a cycle of each of the first emission clock signals ECK1 and ECK3 of the turn-on level may be 4 horizontal cycles 4H.

The timing controller 11 may apply the emission stop signal ELM of the turn-off level to the emission stop line ELML. For example, the length of the emission stop signal ELM of the turn-off level may be set to 8 horizontal cycles 8H.

During the first sub-frame period SFP1, the emission driver 14*b* may apply the first emission signals E1, E3, . . . of the turn-off level to the first emission lines EL1, EL3, . . . , and may maintain the second emission signals E2, . . . of the turn-on level in the second emission lines EL2, . . . . A cycle in which the first emission signals E1, E3, . . . of the turn-off level are applied to the first emission lines EL1, EL3, . . . in the first sub-frame period SFP1 may be the same as a cycle in which the first emission signals E1, E3, . . . of the turn-off level are applied in the frame period FP1.

Since a driving method of the first emission stages EST11, EST13, . . . of the emission driver 14*b* may be the same as that of FIG. 17, duplicate descriptions will be omitted.

Since the control signals in the data blank period BPC may be substantially the same as those of FIG. 13, duplicate descriptions will be omitted.

During the first sub-frame period SFP1 of the second frame period FP2, the cycles of the first scan clock signals CK1 and CK3 may have the second time interval smaller than the first time interval. During the first sub-frame period SFP1, the cycles of the first emission clock signals ECK1 and ECK3 may have the first time interval. For example, the first time interval may be 4 horizontal cycles 4H, and the second time interval may be 2 horizontal cycles 2H. During the first sub-frame period SFP1, the second scan clock signals CK2 and CK4 and the second emission clock signals ECK2 and ECK4 may be maintained at a constant voltage level.

Figure 19:
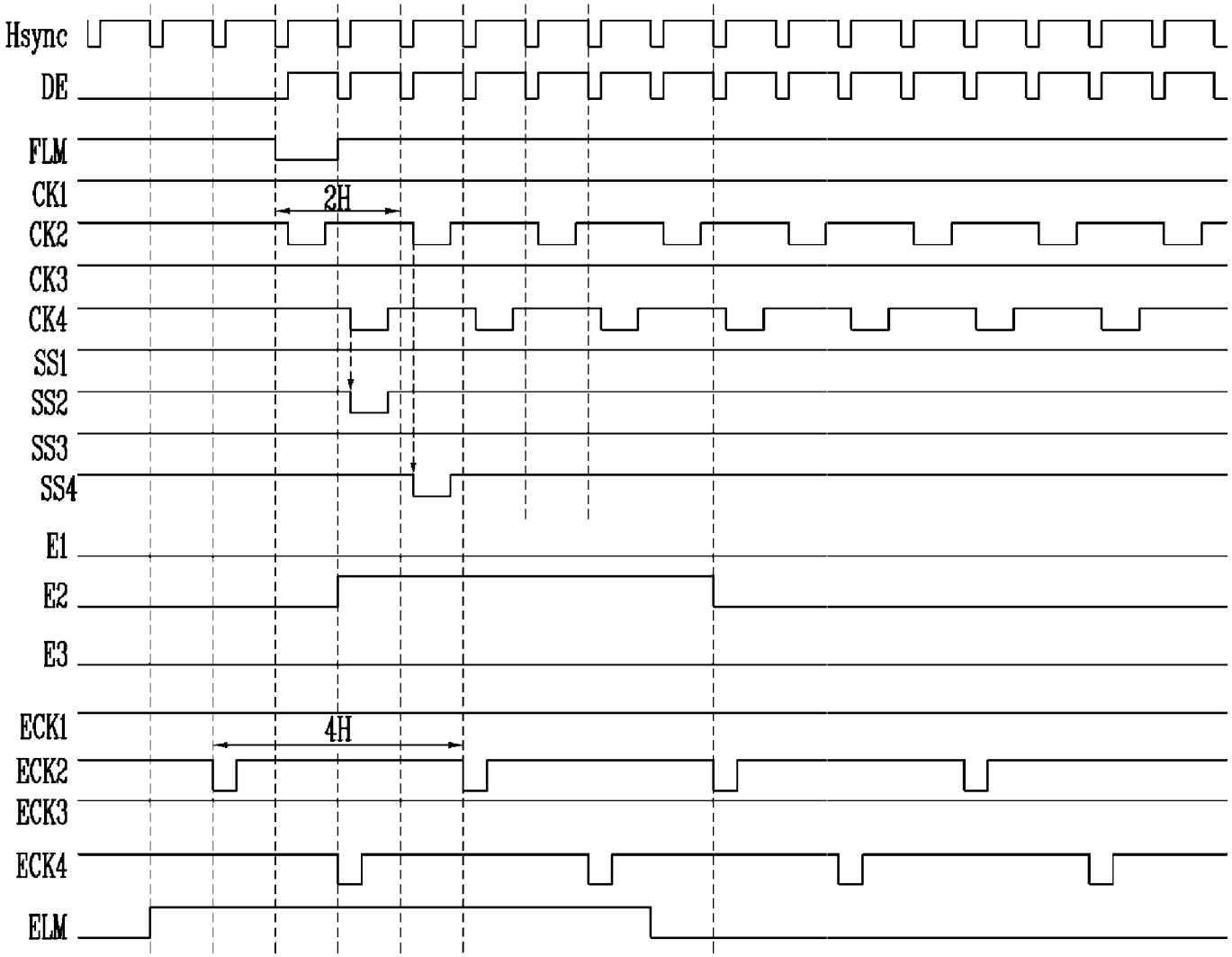

Referring to FIG. 19, the control signals in the second sub-frame period SFP2 of the second frame period FP2 are shown as an example. Specifically, FIG. 19 shows the control signals in a period other than the data blank period BPC among the second sub-frame period SFP2. Since a driving method of the scan driver 13*a* and the data driver 12 in the second sub-frame period SFP2 may be the same as that of FIG. 12, duplicate descriptions will be omitted.

During the second sub-frame period SFP2, the timing controller 11 may apply the second emission clock signals ECK2 and ECK4 of the turn-on level to the second emission clock lines ECKL2 and ECKL4, and may maintain the first emission clock signals ECK1 and ECK3 of the turn-off level in the first emission clock lines ECKL1 and ECKL3. In the present embodiment, a cycle in which the second emission clock signals ECK2 and ECK4 of the turn-on level are applied to the second emission clock lines ECKL2 and ECKL4 in the second sub-frame period SFP2 may be the same as a cycle in which the second emission clock signals ECK2 and ECK4 of the turn-on level are applied in the first frame period FP1. For example, a cycle of each of the second emission clock signals ECK2 and ECK4 of the turn-on level may be 4 horizontal cycles 4H.

The timing controller 11 may apply the emission stop signal ELM of the turn-off level to the emission stop line ELML. For example, the length of the emission stop signal ELM of the turn-off level may be set to 8 horizontal cycles 8H.

During the second sub-frame period SFP2, the emission driver 14*b* may apply the second emission signals E2, . . . of the turn-off level to the second emission lines EL2, . . . , and may maintain the first emission signals E1, E3, . . . of the turn-on level in the first emission lines ELL EL3, . . . . A cycle in which the second emission signals E2, . . . of the turn-off level are applied to the second emission lines EL2, EL4, . . . in the second sub-frame period SFP2 may be the same as a cycle in which the second emission signals E2, . . . of the turn-off level are applied in the first frame period FP1.

Since a driving method of the second emission stages EST12, EST14, . . . of the emission driver 14*b* may be the same as that of FIG. 17, duplicate descriptions will be omitted.

During the second sub-frame period SFP2 of the second frame period FP2, the cycles of the second scan clock signals CK2 and CK4 may have the second time interval. During the second sub-frame period SFP2, the cycles of the second emission clock signals ECK2 and ECK4 may have the first time interval. For example, the first time interval may be 4 horizontal cycles, and the second time interval may be 2 horizontal cycles. During the second sub-frame period SFP2, the first scan clock signals CK1 and CK3 and the first emission clock signals ECK1 and ECK3 may be maintained at a constant voltage level.

FIGS. 20, 21, 22, 23, and 24 are diagrams for explaining a scan driver, a pixel unit, and an emission driver according to a third embodiment of the present disclosure.

Figure 20:
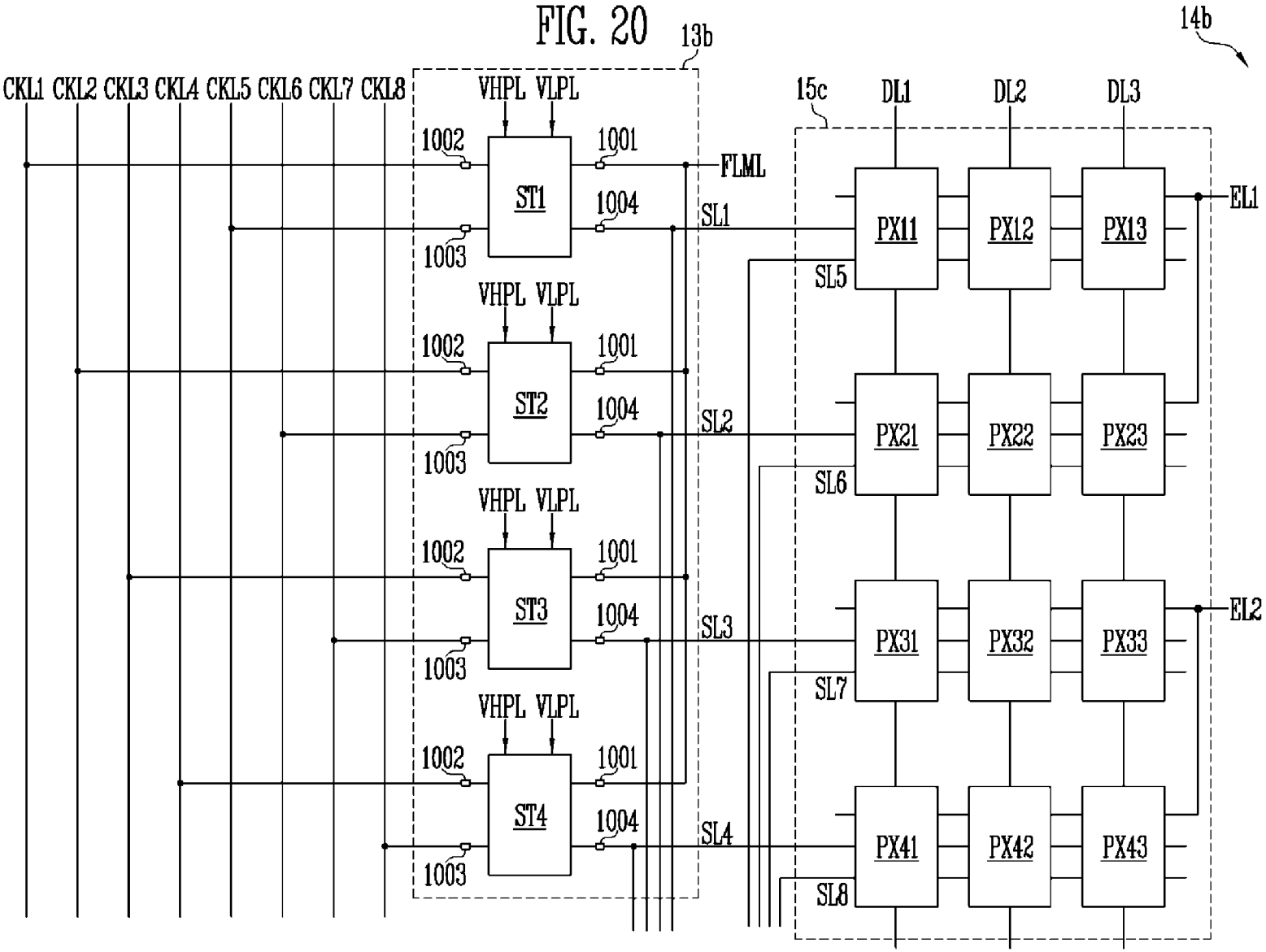
FIGS. 20, 21, 22, 23, and 24 are diagrams for explaining a scan driver, a pixel unit, and an emission driver according to a third embodiment of the present disclosure.

Referring to FIG. 20, a connection relationship of a scan driver 13*b*, a pixel unit 15*c*, and an emission driver 14*b* according to the third embodiment is shown.

The scan driver 13*b* may include first scan stages ST1, . . . connected to first scan clock lines CKL1 and CKL5 and first scan lines SL1, SL5, . . . , second scan stages ST2, . . . connected to second scan clock lines CKL2 and CKL6 and second scan lines SL2, SL6, . . . , third scan stages ST3, . . . connected to third scan clock lines CKL3 and CKL7 and third scan lines SL3, SL7, . . . , and fourth scan stages ST4, . . . connected to fourth scan clock lines CKL4 and CKL8 and fourth scan lines SL4, SL8, . . . .

Unlike the scan driver 13*a* of FIG. 4 divided into two scan stage groups (odd-numbered scan stages and even-numbered scan stages), the scan driver 13*b* of FIG. 20 may be divided into four scan stage groups. For example, a first scan stage group may include (4x+1)th first scan stages ST1, . . . , and each of the first scan stages ST1, . . . may be alternately connected to the first scan clock lines CKL1 and CKL5, where x may be an integer greater than or equal to 0. A second scan stage group may include (4x+2)th second scan stages ST2, . . . , and each of the second scan stages ST2, . . . may be alternately connected to the second scan clock lines CKL2 and CKL6. A third scan stage group may include (4x+3)th third scan stages ST3, . . . , and each of the third scan stages ST3, . . . may be alternately connected to the third scan clock lines CKL3 and CKL7. A fourth scan stage group may include (4x+4)th fourth scan stages ST4, . . . , and each of the fourth scan stages ST4, . . . may be alternately connected to the fourth scan clock lines CKL4 and CKL8.

At least one of the first scan stages ST1, . . . , at least one of the second scan stages ST2, . . . , at least one of the third scan stages ST3, . . . , and at least one of the fourth scan stages ST4, . . . may be connected to the same scan start line FLML.

Each of the first scan stages except for the first scan stage ST1 connected to the scan start line FLML may be connected to a first scan line of a previous first scan stage. Each of the second scan stages except for the second scan stage ST2 connected to the scan start line FLML may be connected to a second scan line of a previous second scan stage. Each of the third scan stages except for a third scan stage ST3 connected to the scan start line FLML may be connected to a third scan line of a previous third scan stage. Each of the fourth scan stages except for a fourth scan stage ST4 connected to the scan start line FLML may be connected to a fourth scan line of a previous fourth scan stage.

The pixel unit 15*c* may include first pixel rows connected to first scan lines SL1, SL5, . . . , second pixel rows connected to second scan lines SL2, SL6, . . . , third pixel rows connected to third scan lines SL3, SL7, . . . , and fourth pixel rows connected to fourth scan lines SL4, SL8, . . . . For example, a first pixel row PX11, PX12, PX13, . . . may be connected to the first scan lines SL1 and SL5. A second pixel row PX21, PX22, PX23, . . . may be connected to the second scan lines SL2 and SL6. A third pixel row PX31, PX32, PX33, . . . may be connected to the third scan lines SL3 and SL7. A fourth pixel row PX41, PX42, PX43, . . . may be connected to the fourth scan lines SL4 and SL8.

The first pixel rows may be (4x+1)th pixel rows, the second pixel rows may be (4x+2)th pixel rows, the third pixel rows may be (4x+3)th pixel rows, and the fourth pixel rows may be (4x+4)th pixel rows.

The emission driver 14*b* may include emission stages EST11, EST12, EST13, EST14, . . . in which each of the emission lines ELL EL2, . . . are connected to two or more pixel rows (See FIG. 16). For example, each of first emission lines ELL EL3, . . . of first emission stages EST11, EST13, . . . among the emission stages EST11, EST12, EST13, EST14, . . . may be connected to the adjacent first pixel row and the adjacent second pixel row. For example, the first emission line EL1 of the first emission stage EST11 may be connected to the adjacent first pixel row PX11, PX12, PX13, . . . and the adjacent second pixel row PX21, PX22, PX23, . . . . For example, each of second emission lines EL2 and EL4 of second emission stages EST12, EST14, . . . among the emission stages EST11, EST12, EST13, EST14, . . . may be connected to an adjacent third pixel row and an adjacent fourth pixel row. For example, the second emission line EL2 of the second emission stage EST12 may be connected to an adjacent third pixel row PX31, PX32, PX33, . . . and an adjacent fourth pixel row PX41, PX42, PX43, . . . .

Figure 21:
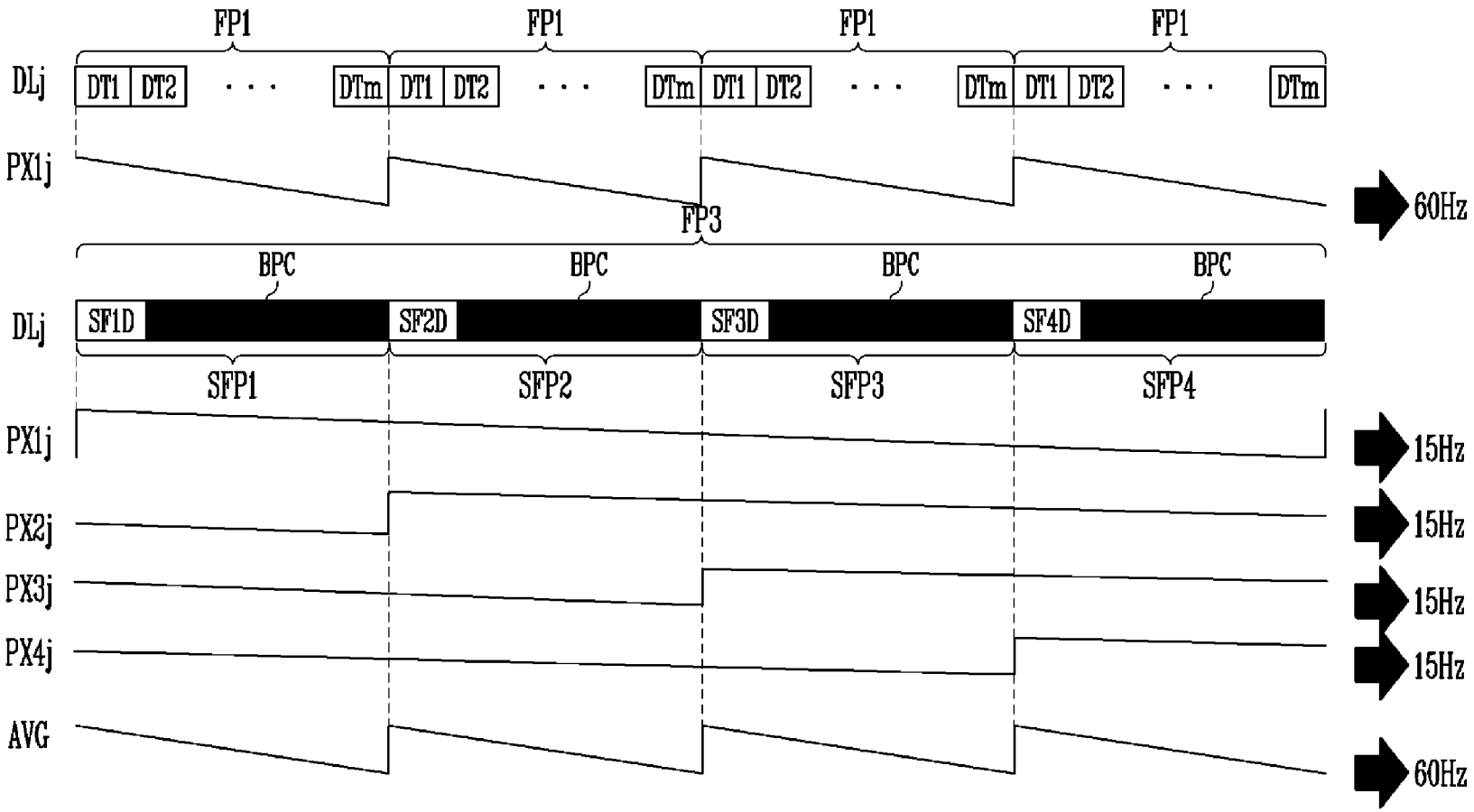

Referring to FIG. 21, a third frame period FP3 will be described. The display device 10 according to the third embodiment may operate in a third display mode including a plurality of third frame periods FP3 as well as the first display mode and the second display mode.

In FIG. 21, a luminance waveform of the first pixel PX1*j* in the first frame period FP1 may be the same as that of FIG. 10. Similarly, although not shown, luminance waveforms of the first pixel PX1*j* and the second pixel PX2*j* in the second frame period FP2 may be the same as those of FIG. 10.

The third frame period FP3 of FIG. 21 may be different from the second frame period FP2 in that it includes four sub-frame periods SFP1, SFP2, SFP3, and SFP4. For example, the third frame period FP3 may be four times the first frame period FP1. For example, when the first frame period FP1 is 1/60 second, the third frame period FP3 may be 1/15 second. For example, each of the sub-frame periods SFP1, SFP2, SFP3, and SFP4 may be 1/60 second.

In the second display mode, two pixel rows may form one group, but in the third display mode, there is a difference in that four adjacent pixel rows may form one group. The first pixel PX1*j* in the first pixel row may receive a data voltage SF1D in the first sub-frame period SFP1 and emit light with the highest luminance. The second pixel PX2*j* in the second pixel row may receive a data voltage SF2D in the second sub-frame period SFP2 and emit light with the highest luminance A third pixel PX3*j* in the third pixel row may receive a data voltage SF3D in a third sub-frame period SFP3 and emit light with the highest luminance A fourth pixel PX4*j* in the fourth pixel row may receive a data voltage SF4D in a fourth sub-frame period SFP4 and emit light with the highest luminance. Accordingly, even if each of the pixels PX1*j*, PX2*j*, PX3*j*, and PX4*j* emit light at 15 Hz, an average luminance waveform AVG of the group of pixels PX1*j*, PX2*j*, PX3*j*, and PX4*j* may be recognized as 60 Hz.

Figure 22:
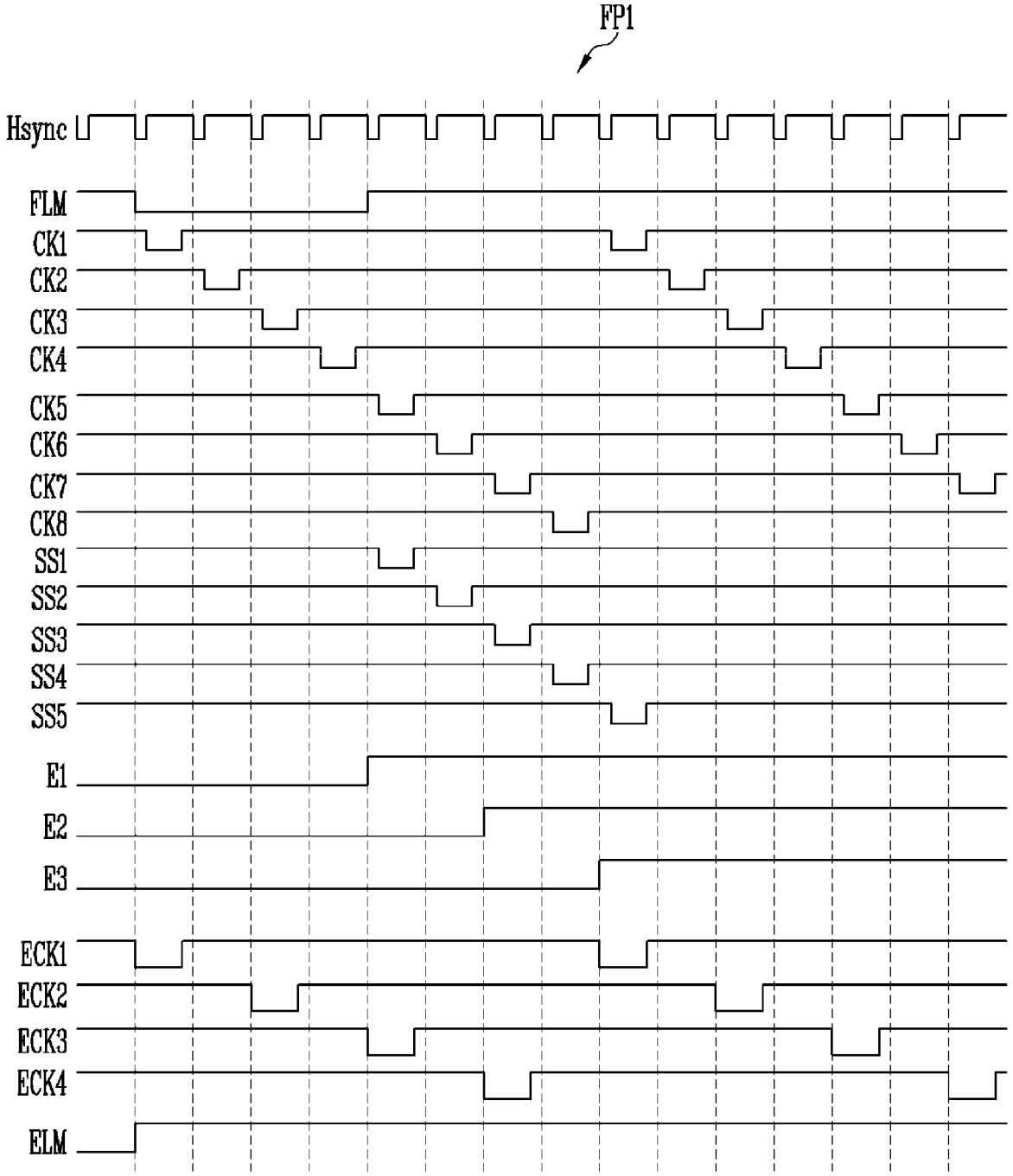

Referring to FIG. 22, the control signals in the first frame period FP1 are shown as an example. Each of the scan clock signals CK1, CK2, CK3, CK4, CK5, CK6, CK7, and CK8 may have a cycle of 8 horizontal periods 8H. Each of the emission clock signals ECK1, ECK2, ECK3, and ECK4 may have a cycle of 8 horizontal periods 8H. Since circuit configurations of the scan stage and the emission stage may be the same as described above, duplicate descriptions are omitted.

Figure 23:
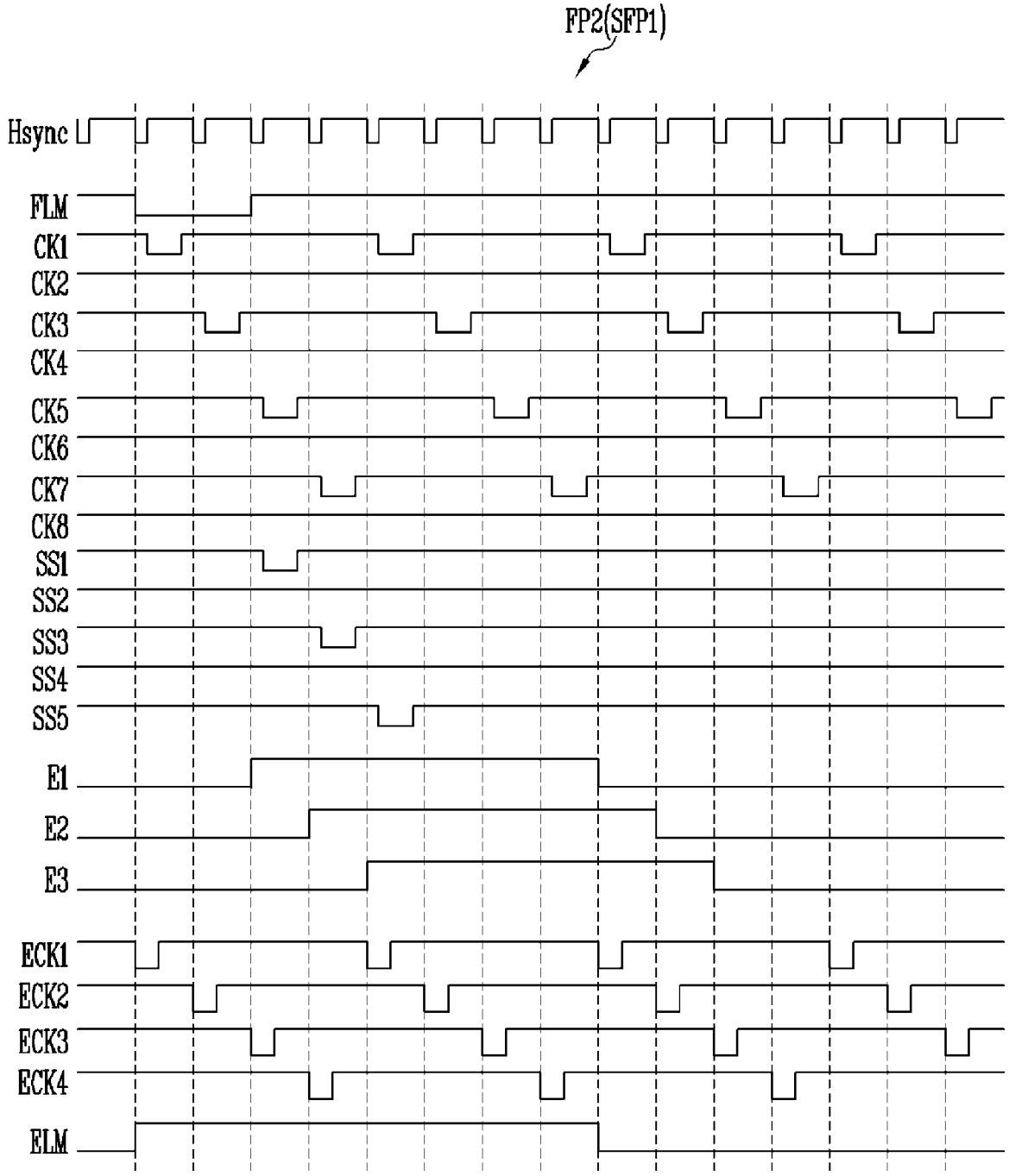

Referring to FIG. 23, the control signals in the first sub-frame period SFP1 of the second frame period FP2 are shown as an example. Each of first scan clock signals CK1 and CK5 and third scan clock signals CK3 and CK7 may have a cycle of 4 horizontal periods. Second scan clock signals CK2 and CK6 and fourth scan clock signals CK4 and CK8 may be maintained at a constant voltage level (turn-off level). Each of the emission clock signals ECK1, ECK2, ECK3, and ECK4 may have a cycle of 4 horizontal periods 4H. Since circuit configurations of the scan stage and the emission stage may be the same as described above, duplicate descriptions are omitted.

Figure 24:
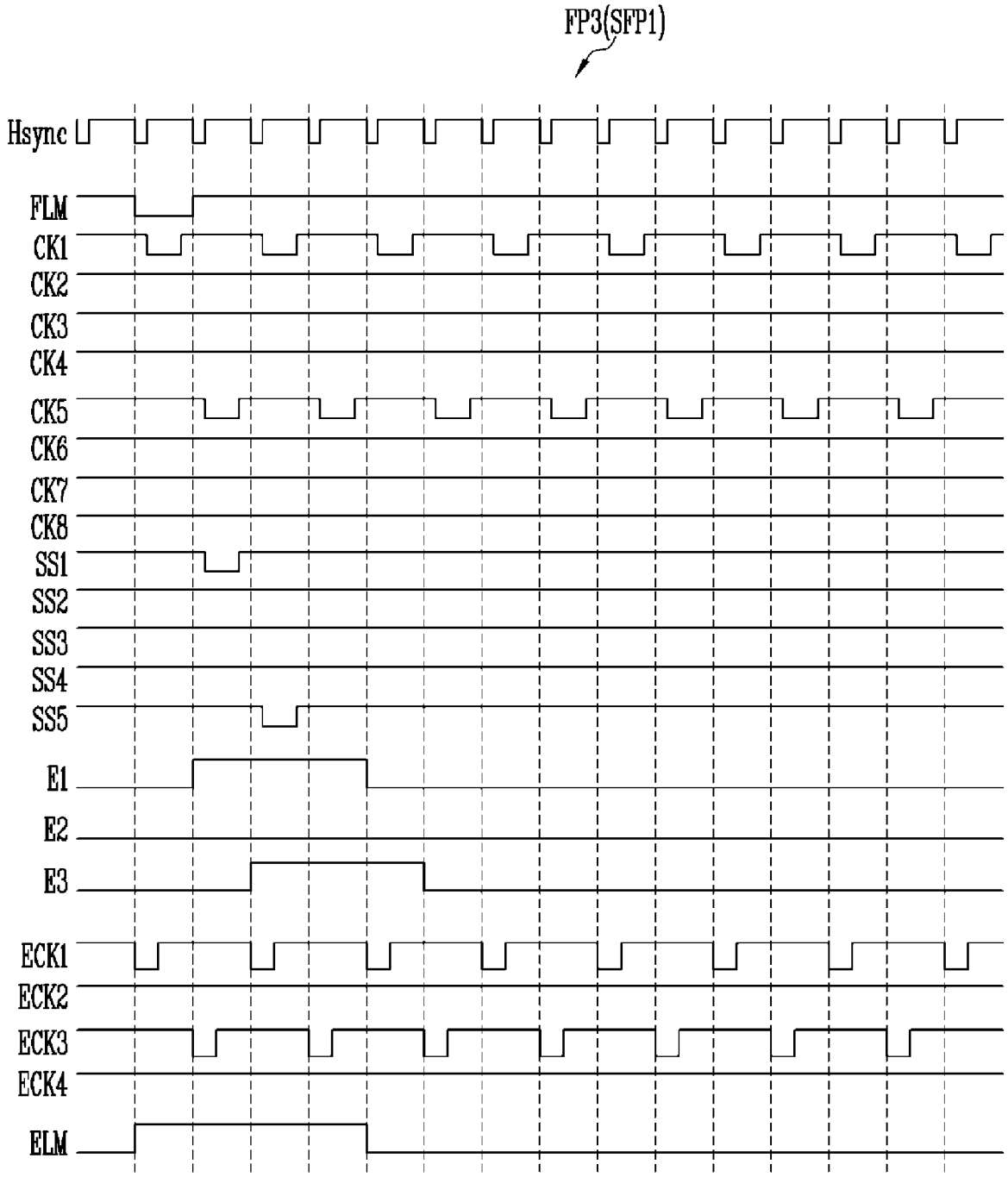

Referring to FIG. 24, the control signals in the first sub-frame period SFP1 of the third frame period FP3 are shown as an example. Each of the first scan clock signals CK1 and CK5 may have a cycle of 2 horizontal periods. The second scan clock signals CK2 and CK6, the third scan clock signals CK3 and CK7, and the fourth scan clock signals CK4 and CK8 may be maintained at the constant voltage level (turn-off level). Each of the first emission clock signals ECK1 and ECK3 may have a cycle of 2 horizontal periods 2H. The second emission clock signals ECK2 and ECK4 may be maintained at the constant voltage level (turn-off level). Since circuit configurations of the scan stage and the emission stage may be the same as described above, duplicate descriptions are omitted.

During the first frame period FP1, cycles of the first scan clock signals CK1 and CK5 applied to the first scan clock lines CKL1 and CKL5 may have the first time interval. During the first sub-frame period SFP1 of the second frame period FP2, the cycles of the first scan clock signals CK1 and CK5 may have the second time interval smaller than the first time interval. During the first sub-frame period SFP1 of the third frame period FP3, the cycles of the first scan clock signals CK1 and CK5 may have the third time interval less than the second time interval. For example, the first time interval may be 8 horizontal cycles, the second time interval may be 4 horizontal cycles 4H, and the third time interval may be 2 horizontal cycles 2H.

The second frame period FP2 may be twice the first frame period FP1, the third frame period FP3 may be four times the first frame period FP', the second time interval may be ½ times the first time interval, and the third time interval may be ¼ times the first time interval.

FIGS. 25, 26, 27, and 28 are diagrams for explaining a scan driver, a pixel unit, and an emission driver according to a fourth embodiment of the present disclosure.

Figure 25:
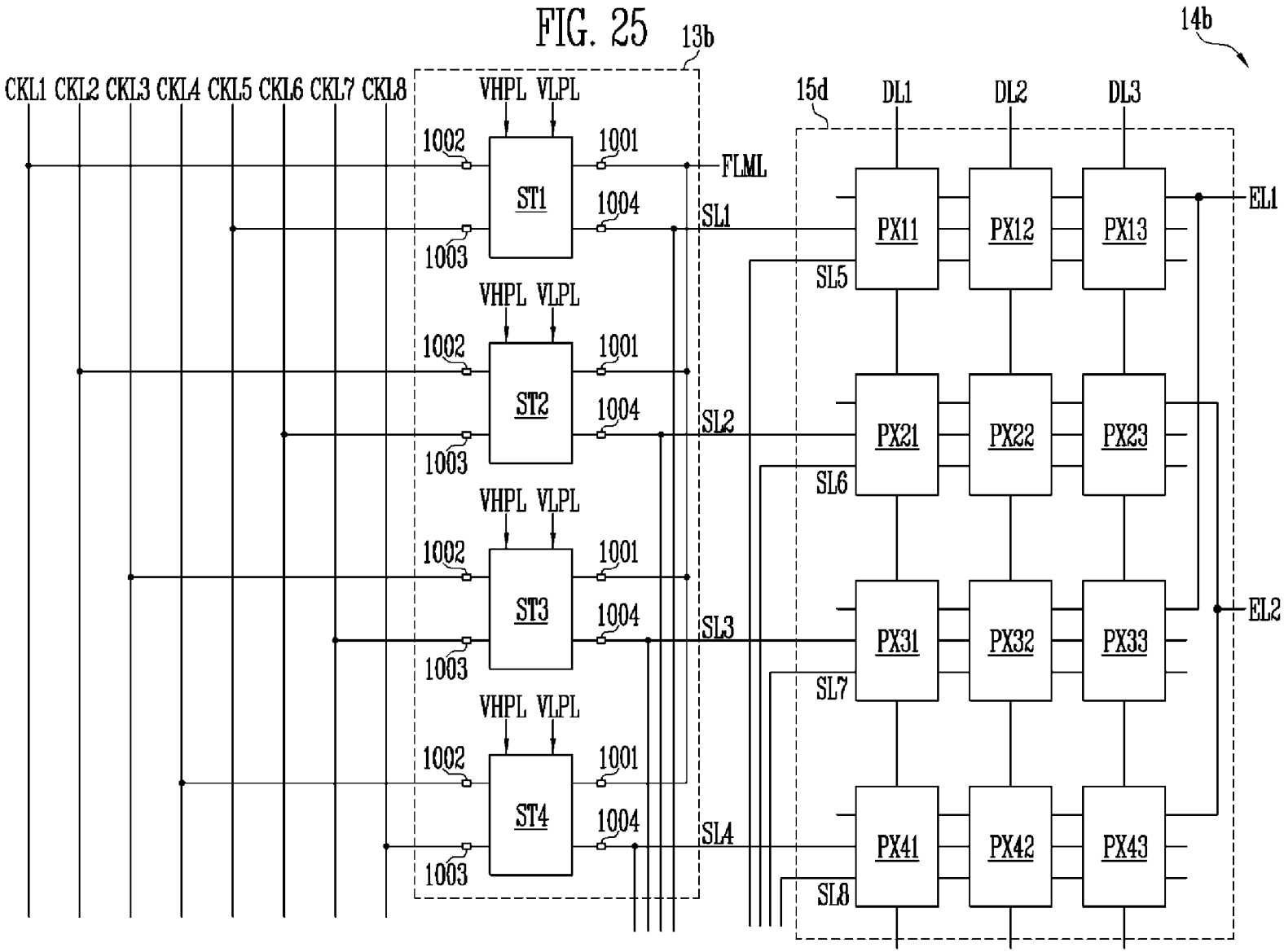
FIGS. 25, 26, 27, and 28 are diagrams for explaining a scan driver, a pixel unit, and an emission driver according to a fourth embodiment of the present disclosure.

Referring to FIG. 25, a connection relationship between a scan driver 13*b*, a pixel unit 15*d*, and an emission driver 14*b* according to the fourth embodiment is shown.

Since a connection relationship between the scan driver 13*b* and the pixel unit 15*d* of FIG. 25 may be the same as the connection relationship between the scan driver 13*b* and the pixel unit 15*c* of FIG. 20, duplicate descriptions thereof will be omitted.

Each of the first emission lines of the first emission stages among the emission stages may be connected to the adjacent first pixel row and the adjacent third pixel row. For example, the first emission line EL1 of the first emission stage EST11 may be connected to the adjacent first pixel row PX11, PX12, PX13, . . . and the adjacent third pixel row PX31, PX32, PX33, . . . .

Each of the second emission lines of the second emission stages among the emission stages may be connected to the adjacent second pixel row and the adjacent fourth pixel row. For example, the second emission line EL2 of the second emission stage EST12 may be connected to the adjacent second pixel row PX21, PX22, PX23, . . . and the adjacent fourth pixel row PX41, PX42, PX43, . . . .

Figure 26:
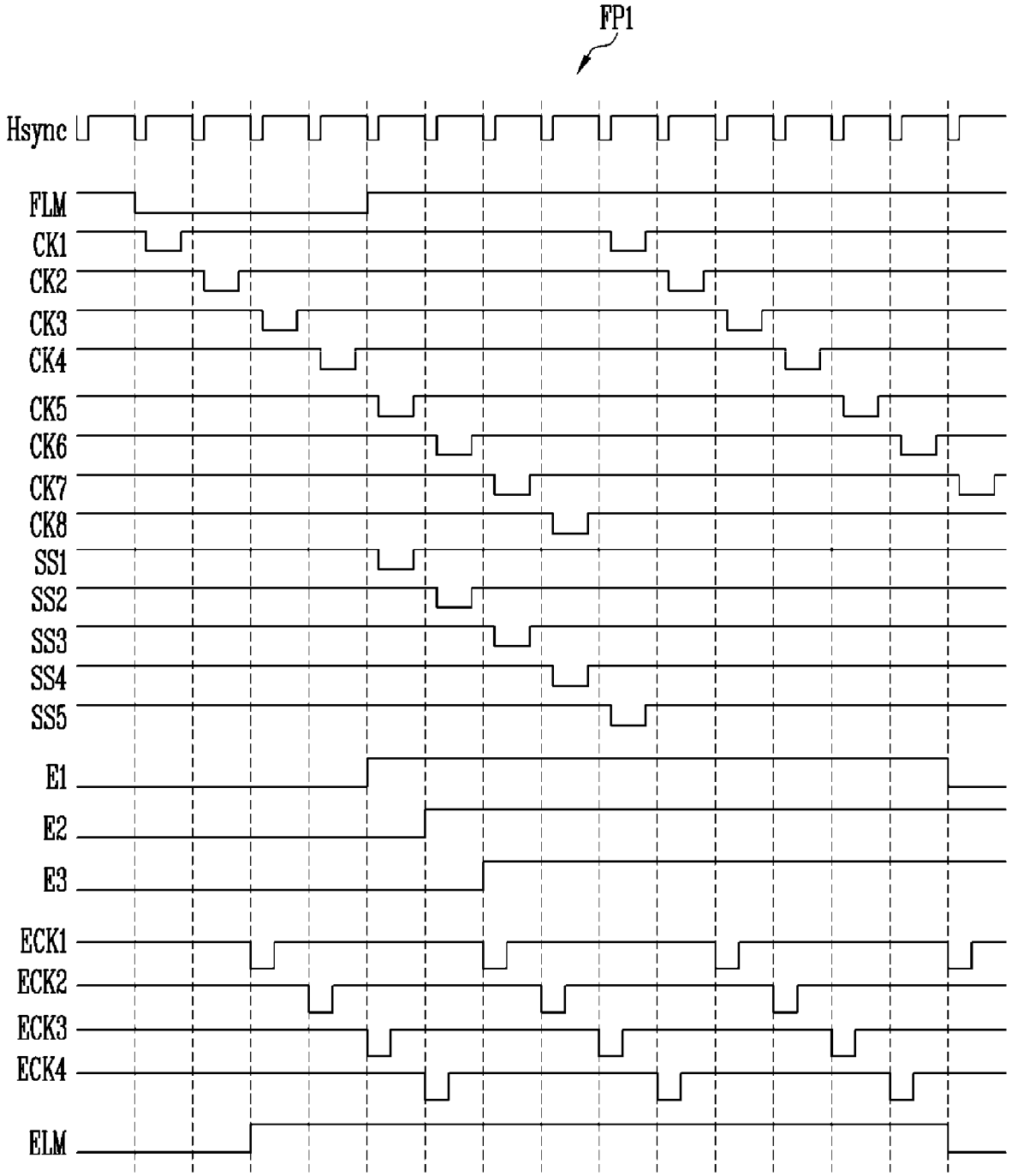

Referring to FIG. 26, the control signals in the first frame period FP1 are shown as an example. Each of scan clock signals CK1, CK2, CK3, CK4, CK5, CK6, CK7, and CK8 may have a cycle of 8 horizontal periods. Each of emission clock signals ECK1, ECK2, ECK3, and ECK4 may have a cycle of 4 horizontal periods 4H. Since circuit configurations of the scan stage and the emission stage may be the same as described above, duplicate descriptions are omitted.

Figure 27:
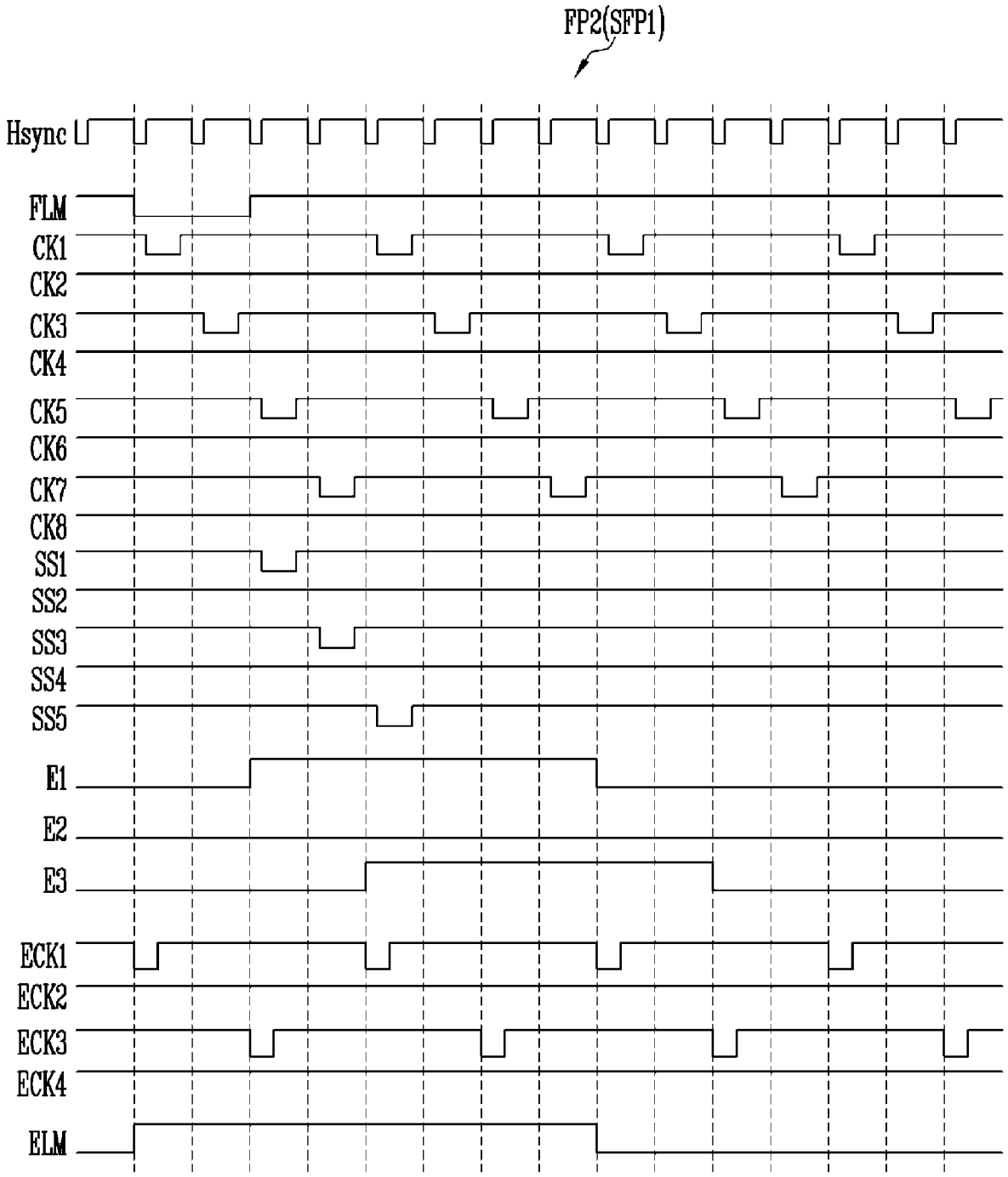

Referring to FIG. 27, the control signals in the first sub-frame period SFP1 of the second frame period FP2 are shown as an example. Each of the first scan clock signals CK1 and CK5 and the third scan clock signals CK3 and CK7 may have a cycle of 4 horizontal periods 4H. The second scan clock signals CK2 and CK6 and the fourth scan clock signals CK4 and CK8 may be maintained at the constant voltage level (turn-off level). Each of the first emission clock signals ECK1 and ECK3 may have a cycle of 4 horizontal periods 4H. The second emission clock signals ECK2 and ECK4 may be maintained at the constant voltage level (turn-off level). Since circuit configurations of the scan stage and the emission stage may be the same as described above, duplicate descriptions are omitted.

Figure 28:
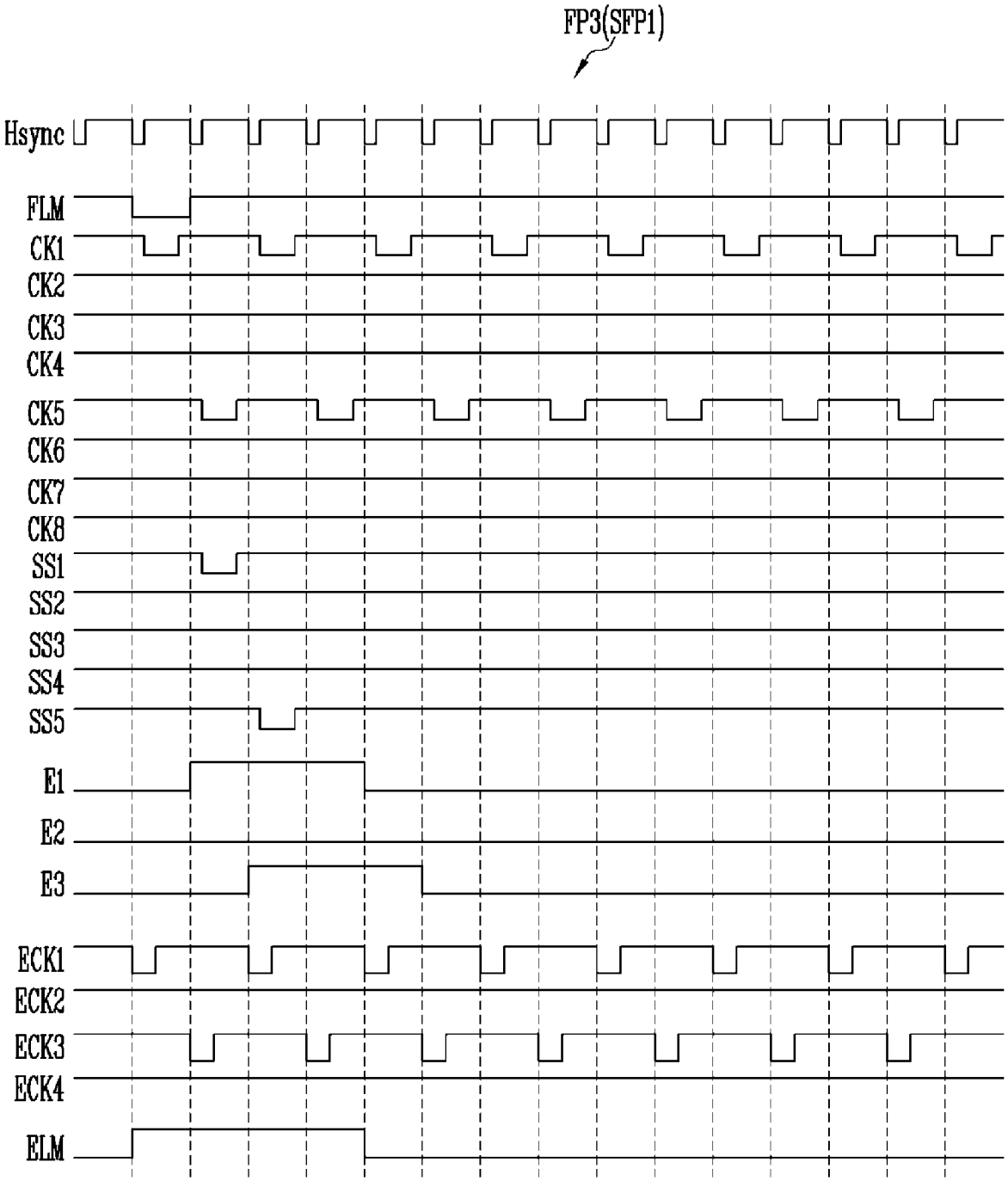

Referring to FIG. 28, the control signals in the first sub-frame period SFP1 of the third frame period FP3 are shown as an example. Each of the first scan clock signals CK1 and CK5 may have a cycle of 2 horizontal periods 2H. The second scan clock signals CK2 and CK6, the third scan clock signals CK3 and CK7, and the fourth scan clock signals CK4 and CK8 may be maintained at the constant voltage level (turn-off level). Each of the first emission clock signals ECK1 and ECK3 may have a cycle of 2 horizontal periods 2H. The second emission clock signals ECK2 and ECK4 may be maintained at the constant voltage level (turn-off level). Since circuit configurations of the scan stage and the emission stage may be the same as described above, duplicate descriptions are omitted.

FIGS. 29, 30, 31, and 32 are diagrams for explaining a scan driver, a pixel unit, and an emission driver according to a fifth embodiment of the present disclosure.

Figure 29:
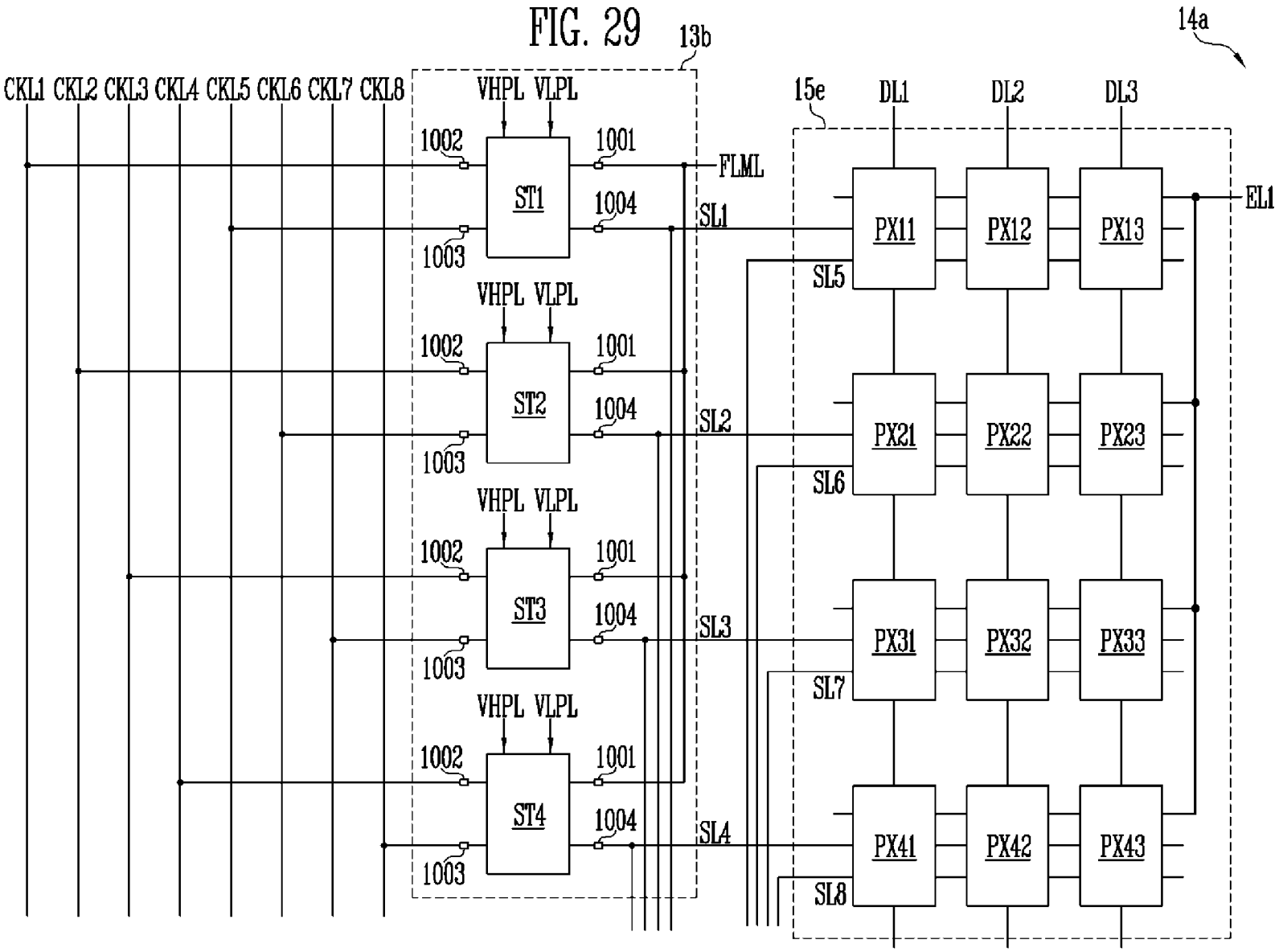
FIGS. 29, 30, 31, and 32 are diagrams for explaining a scan driver, a pixel unit, and an emission driver according to a fifth embodiment of the present disclosure.

Referring to FIG. 29, a connection relationship between a scan driver 13*b*, a pixel unit 15*e*, and an emission driver 14*a* according to the fifth embodiment is shown (see FIG. 7).

Since a connection relationship between the scan driver 13*b* and the pixel unit 15*e* of FIG. 29 may be the same as the connection relationship between the scan driver 13*b* and the pixel unit 15*c* of FIG. 20, duplicate descriptions thereof will be omitted.

Each of the emission lines of the emission stages may be connected to the adjacent first pixel row, the adjacent second pixel row, the adjacent third pixel row, and the adjacent fourth pixel row. For example, the emission line EL1 may be connected to the adjacent first pixel row PX11, PX12, PX13, . . . , the adjacent second pixel row PX21, PX22, PX23, . . . , the adjacent third pixel row PX31, PX32, PX33, . . . , and the adjacent fourth pixel row PX41, PX42, PX43, . . . .

Figure 30:
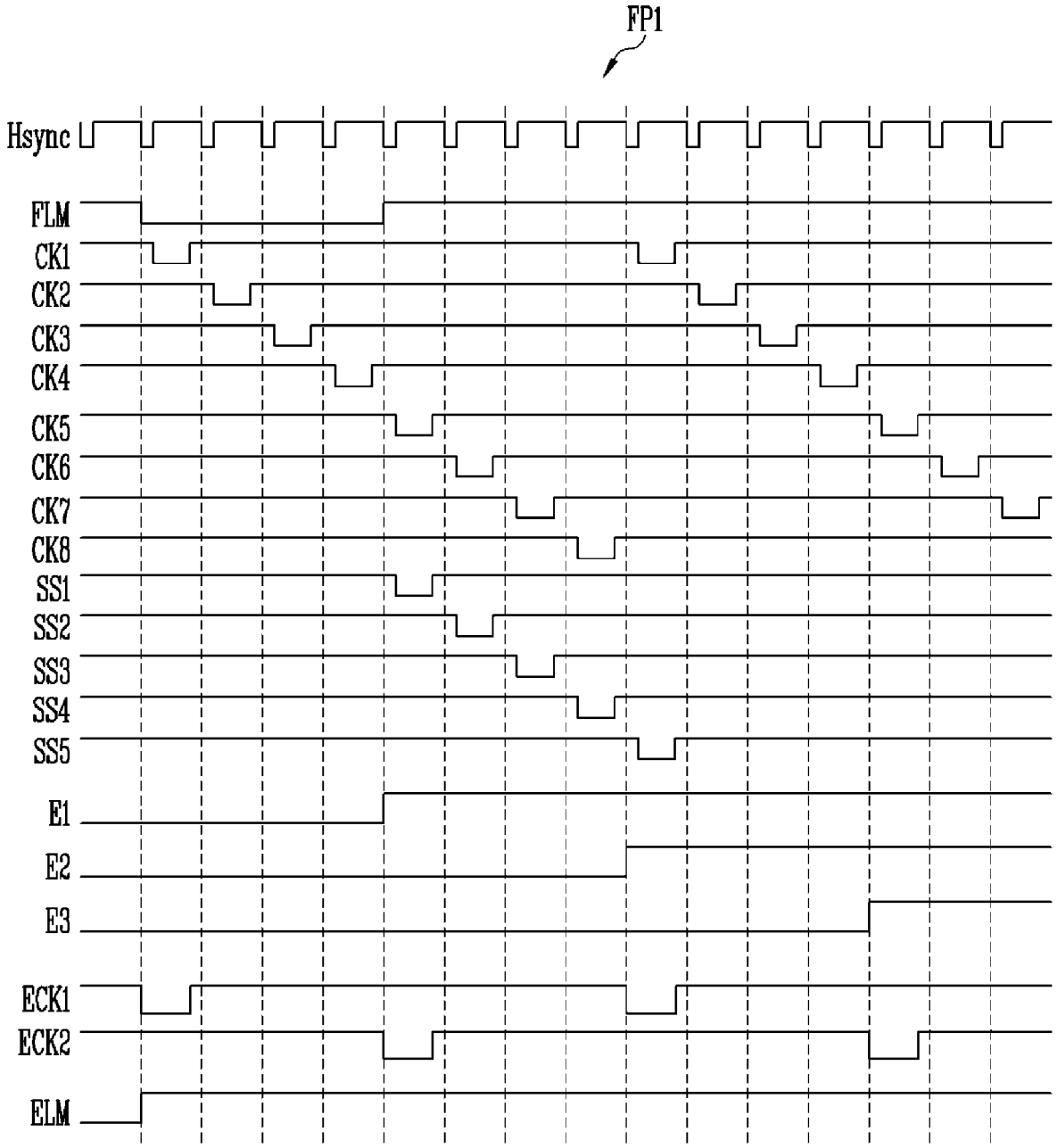

Referring to FIG. 30, the control signals in the first frame period FP1 are shown as an example. Each of scan clock signals CK1, CK2, CK3, CK4, CK5, CK6, CK7, and CK8 may have a cycle of 8 horizontal periods 8H. Each of the emission clock signals ECK1 and ECK2 may have a cycle of 8 horizontal periods 8H. Since circuit configurations of the scan stage and the emission stage may be the same as described above, duplicate descriptions are omitted.

Figure 31:
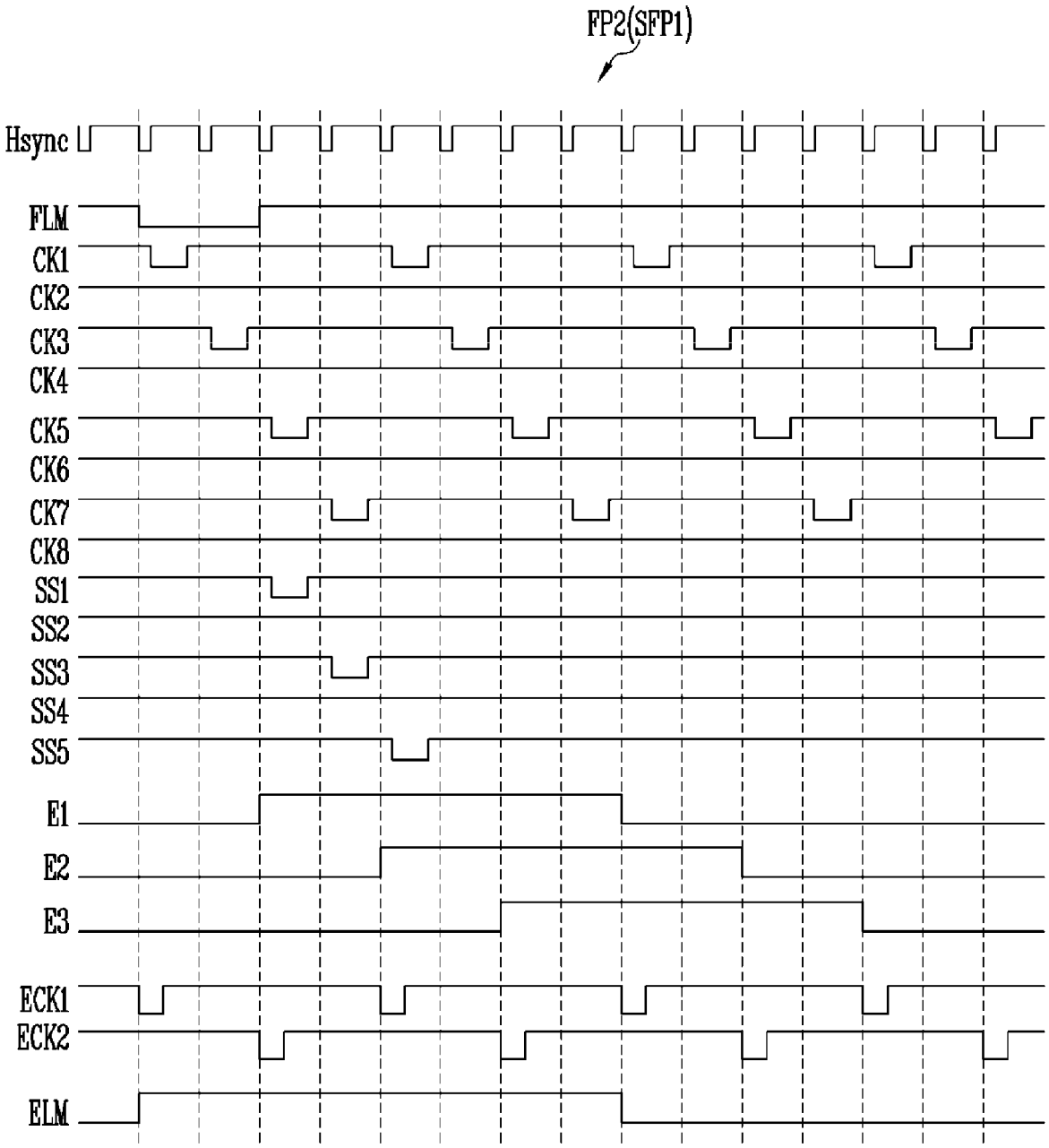

Referring to FIG. 31, the control signals in the first sub-frame period SFP1 of the second frame period FP2 are shown as an example. Each of the first scan clock signals CK1 and CK5 and the third scan clock signals CK3 and CK7 may have a cycle of 4 horizontal periods 4H. The second scan clock signals CK2 and CK6 and the fourth scan clock signals CK4 and CK8 may be maintained at the constant voltage level (turn-off level). Each of the emission clock signals ECK1 and ECK2 may have a cycle of 4 horizontal periods 4H. Since circuit configurations of the scan stage and the emission stage may be the same as described above, duplicate descriptions are omitted.

Figure 32:
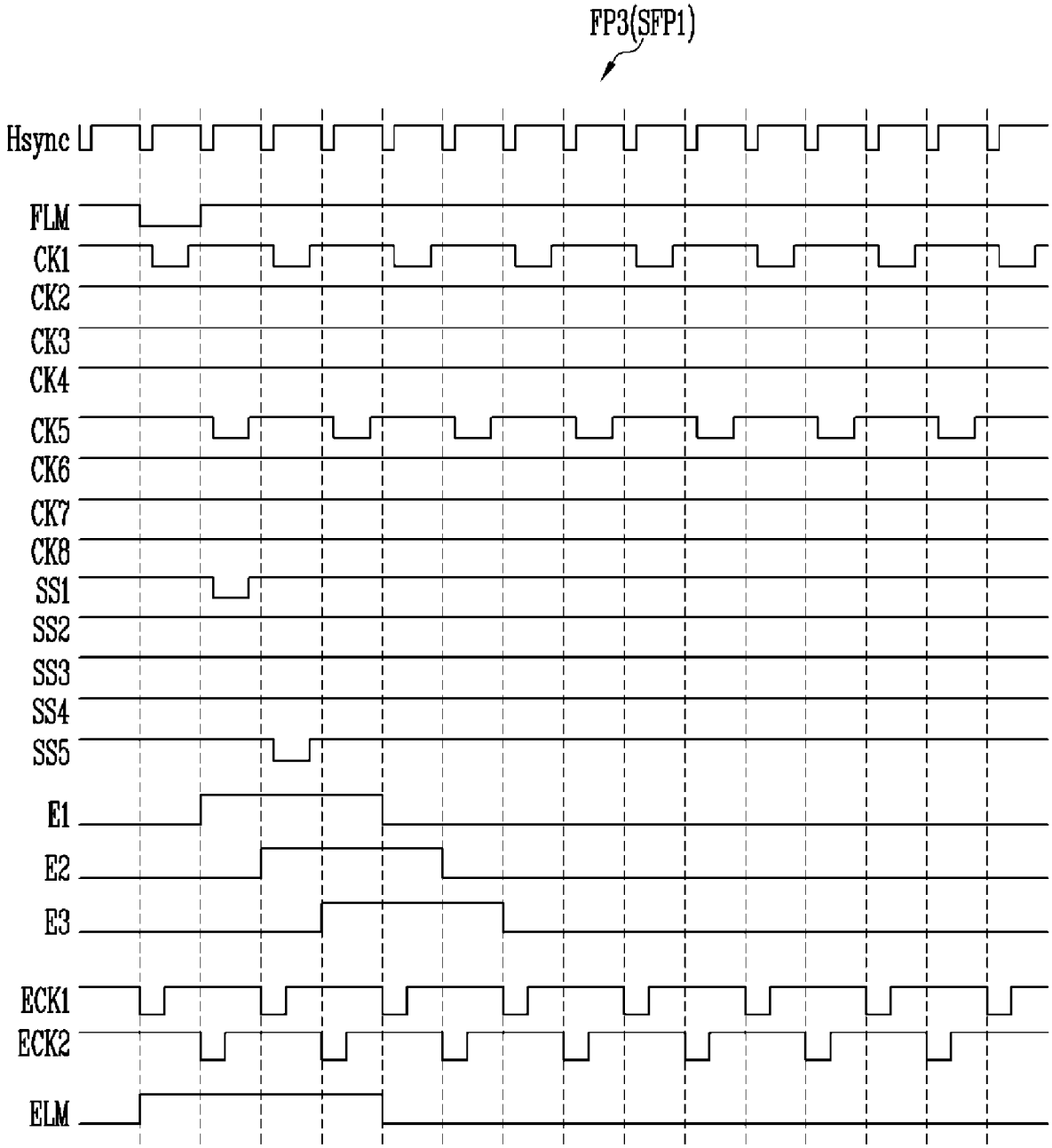

Referring to FIG. 32, the control signals in the first sub-frame period SFP1 of the third frame period FP3 are shown as an example. Each of the first scan clock signals CK1 and CK5 may have a cycle of 2 horizontal periods 2H. The second scan clock signals CK2 and CK6, the third scan clock signals CK3 and CK7, and the fourth scan clock signals CK4 and CK8 may be maintained at the constant voltage level (turn-off level). Each of the emission clock signals ECK1 and ECK2 may have a cycle of 2 horizontal periods 2H. Since circuit configurations of the scan stage and the emission stage may be the same as described above, duplicate descriptions are omitted.

The display device according to the present disclosure can change a display frequency and may maintain the same cycle in which luminance decreases when the display frequency is changed.

The drawings referred to heretofore and the detailed description of the present disclosure described above are merely illustrative of the present disclosure. It is to be understood that the present disclosure has been disclosed for illustrative purposes only and is not intended to limit the meaning or scope of the present disclosure as set forth in the claims. Therefore, those skilled in the art will appreciate that various modifications and equivalent embodiments are possible without departing from the scope of the present disclosure. Accordingly, the true technical protection scope of the present disclosure should be determined by the technical idea of the appended claims.

What is claimed is:

1. A display device comprising:

a pixel unit including first pixel rows connected to first scan lines and second pixel rows alternating with the first pixel rows and connected to second scan lines;

a scan driver including first scan stages connected to the first scan lines and second scan stages connected to the second scan lines; and an emission driver including emission stages in which each of emission lines is connected to at least two or more pixel rows, wherein the first scan stages are connected to first scan clock lines, wherein the second scan stages are connected to second scan clock lines which are different from the first scan clock lines, wherein one of the first scan stages and one of the second scan stages are connected to a same scan start line which is different from the first scan lines and the second scan lines, wherein each of the first scan stages except a first scan stage connected to the scan start line is connected to a first scan line of a previous first scan stage, and wherein each of the second scan stages except a second scan stage connected to the scan start line is connected to a second scan line of a previous second scan stage.

2. The display device of claim 1, wherein each of the emission lines of the emission stages is connected to an adjacent first pixel row and an adjacent second pixel row.

3. The display device of claim 2, wherein the emission stages are connected to a same emission clock lines, and wherein the remaining emission stages except an emission stage connected to an emission stop line among the emission stages are connected to an emission line of a previous emission stage.

4. The display device of claim 3, wherein, during a first frame period, cycles of first scan clock signals applied to the first scan clock lines, cycles of second scan clock signals applied to the second scan clock lines, and cycles of emission clock signals applied to the emission clock lines have a first time interval.

5. The display device of claim 4, wherein, during a first sub-frame period of a second frame period, the cycles of the first scan clock signals and the cycles of the emission clock signals have a second time interval less than the first time interval, and wherein, during the first sub-frame period, the second scan clock signals are maintained at a constant voltage level.

6. The display device of claim 5, wherein, during a second sub-frame period of the second frame period, the cycles of the second scan clock signals and the cycles of the emission clock signals have the second time interval, and wherein, during the second sub-frame period, the first scan clock signals are maintained at a constant voltage level.

7. The display device of claim 1, wherein each of first emission lines of first emission stages among the emission stages is connected to adjacent first pixel rows, and wherein each of second emission lines of second emission stages among the emission stages is connected to adjacent second pixel rows.

8. The display device of claim 7, wherein the first emission stages are connected to first emission clock lines, wherein the second emission stages are connected to second emission clock lines which are different from the first emission clock lines, wherein one of the first emission stages and one of the second emission stages are connected to a same emission stop line, wherein each of the first emission stages except for a first emission stage connected to the emission stop line is connected to an emission line of a previous first emission stage, and wherein each of the second emission stages except for a second emission stage connected to the emission stop line is connected to an emission line of a previous second emission stage.

9. The display device of claim 8, wherein, during a first frame period, cycles of first scan clock signals applied to the first scan clock lines, cycles of second scan clock signals applied to the second scan clock lines, cycles of first emission clock signals applied to the first emission clock lines, and cycles of second emission clock signals applied to the second emission clock lines have a first time interval.

10. The display device of claim 9, wherein, during a first sub-frame period of a second frame period, the cycles of the first scan clock signals have a second time interval which is less than the first time interval, wherein, during the first sub-frame period, the cycles of the first emission clock signals have the first time interval, and wherein, during the first sub-frame period, the second scan clock signals and the second emission clock signals are maintained at a constant voltage level.

11. The display device of claim 10, wherein, during a second sub-frame period of the second frame period, the cycles of the second scan clock signals have the second time interval, wherein, during the second sub-frame period, the cycles of the second emission clock signals have the first time interval, and wherein, during the second sub-frame period, the first scan clock signals and the first emission clock signals are maintained at a constant voltage level.

12. A display device comprising:

a pixel unit including first pixel rows connected to first scan lines, second pixel rows connected to second scan lines, third pixel rows connected to third scan lines, and fourth pixel rows connected to fourth scan lines;

a scan driver including first scan stages connected to first scan clock lines and the first scan lines, second scan stages connected to second scan clock lines and the second scan lines, third scan stages connected to third scan clock lines and the third scan lines, and fourth scan stages connected to fourth scan clock lines and the fourth scan lines; and an emission driver including emission stages in which each of emission lines is connected to at least two or more pixel rows, wherein one of the first scan stages, one of the second scan stages, one of the third scan stages, and one of the fourth scan stages are connected to a same scan start line, wherein each of the first scan stages except for a first scan stage connected to the scan start line is connected to a first scan line of a previous first scan stage, wherein each of the second scan stages except for a second scan stage connected to the scan start line is connected to a second scan line of a previous second scan stage, wherein each of the third scan stages except for a third scan stage connected to the scan start line is connected to a third scan line of a previous third scan stage, and wherein each of the fourth scan stages except for a fourth scan stage connected to the scan start line is connected to a fourth scan line of a previous fourth scan stage.

13. The display device of claim 12, wherein each of first emission lines of first emission stages among the emission stages is connected to an adjacent first pixel row and an adjacent second pixel row, and wherein each of second emission lines of second emission stages among the emission stages is connected to an adjacent third pixel row and an adjacent fourth pixel row.

14. The display device of claim 13, wherein the first emission stages are connected to first emission clock lines, wherein the second emission stages are connected to second emission clock lines different from the first emission clock lines, wherein one of the first emission stages and one of the second emission stages are connected to a same emission stop line respectively, wherein each of the first emission stages except a first emission stage connected to the emission stop line is connected to an emission line of a previous first emission stage, and wherein each of the second emission stages except a second emission stage connected to the emission stop line is connected to an emission line of a previous second emission stage.

15. The display device of claim 12, wherein each of first emission lines of first emission stages among the emission stages is connected to an adjacent first pixel row and an adjacent third pixel row, and wherein each of second emission lines of second emission stages among the emission stages is connected to an adjacent second pixel row and an adjacent fourth pixel row.

16. The display device of claim 15, wherein the first emission stages are connected to first emission clock lines, wherein the second emission stages are connected to second emission clock lines different from the first emission clock lines, wherein one of the first emission stages and one of the second emission stages are connected to the same emission stop line, wherein each of the first emission stages except a first emission stage connected to the emission stop line is connected to an emission line of a previous first emission stage, and wherein each of the second emission stages except a second emission stage connected to the emission stop line is connected to an emission line of a previous second emission stage.

17. The display device of claim 12, wherein each of the emission lines of the emission stages is connected to an adjacent first pixel row, an adjacent second pixel row, an adjacent third pixel row, and an adjacent fourth pixel row.

18. The display device of claim 17, wherein the emission stages are connected to the same emission clock lines, and wherein the remaining emission stages except for an emission stage connected to an emission stop line among the emission stages are connected to an emission line of a previous emission stage.

19. The display device of claim 12, wherein, during a first frame period, cycles of first scan clock signals applied to the first scan clock lines have a first time interval, wherein, during a first sub-frame period of a second frame period, the cycles of the first scan clock signals have a second time interval less than the first time interval, and wherein, during a first sub-frame period of a third frame period, the cycles of the first scan clock signals have a third time interval less than the second time interval.

20. The display device of claim 19, wherein the second frame period is twice of the first frame period, wherein the third frame period is four times of the first frame period, wherein the second time interval is ½ time of the first time interval, and wherein the third time interval is ¼ time of the first time interval.

* * * * *